US011441873B1

(12) United States Patent
Turner

(10) Patent No.: US 11,441,873 B1
(45) Date of Patent: Sep. 13, 2022

(54) METHOD AND SYSTEM FOR FIREARM SCOPE LEVELING

(71) Applicant: Paul J. Turner, Afton, WY (US)

(72) Inventor: Paul J. Turner, Afton, WY (US)

( * ) Notice: Subject to any disclaimer, the term of this patent is extended or adjusted under 35 U.S.C. 154(b) by 0 days.

(21) Appl. No.: 17/184,809

(22) Filed: Feb. 25, 2021

(51) Int. Cl.
*F41G 1/54* (2006.01)
*F41G 1/38* (2006.01)

(52) U.S. Cl.
CPC ..... *F41G 1/545* (2013.01); *F41G 1/38* (2013.01)

(58) Field of Classification Search
CPC ..... F41G 1/38; F41G 1/545
USPC ..... 42/111
See application file for complete search history.

(56) References Cited

U.S. PATENT DOCUMENTS

| | | | | |
|---|---|---|---|---|
| 9,115,957 | B1 * | 8/2015 | Winker | F41G 3/323 |
| 10,545,009 | B1 * | 1/2020 | Bartak | G01C 9/34 |
| D917,652 | S * | 4/2021 | Maynard | D22/110 |
| 2007/0113460 | A1 * | 5/2007 | Potterfield | F41G 1/44 42/120 |
| 2007/0175080 | A1 * | 8/2007 | Sammut | F41G 1/40 42/126 |
| 2013/0326893 | A1 * | 12/2013 | Schmidt | F41G 1/545 33/286 |
| 2018/0274886 | A1 * | 9/2018 | Goddard | F41G 1/545 |
| 2019/0301836 | A1 * | 10/2019 | Owens | F41G 1/545 |
| 2019/0376766 | A1 * | 12/2019 | Fruechtel | F41G 1/44 |
| 2020/0271418 | A1 * | 8/2020 | Echols | F41G 11/001 |
| 2021/0348886 | A1 * | 11/2021 | Havens | F41G 3/08 |
| 2021/0389101 | A1 * | 12/2021 | Hughes | F41G 11/004 |

FOREIGN PATENT DOCUMENTS

WO WO-2014159397 A1 * 10/2014 ..... F41G 1/44

OTHER PUBLICATIONS

"SendiT Original Electronic Level System" product listing available on ShortActionPrecison.com (Year: 2017).*
"Optic Leveler Small" product listing available on ArisakaDefense.com (Year: 2015).*
"User Zeroing the Long Range Arms Send iT electronic level" video posted by Long Range Arms Company on YouTube.com (Year: 2017).*

* cited by examiner

*Primary Examiner* — Samir Abdosh
(74) *Attorney, Agent, or Firm* — Hawley Troxell Ennis & Hawley LLP; Philip McKay

(57) ABSTRACT

Known "good" reference lines are provided for scope leveling using a reference device support platform attached to a rifle such that the reference device support platform first surface is parallel to rifle's horizontal bore center line and perpendicular to rifle's vertical bore center line. An alignment reference device, such as a laser leveling device, is then placed on the reference device support platform. When the alignment reference device is so placed, a horizontal axis of the alignment reference device will be parallel to the rifle's horizontal bore center line and a vertical axis of the alignment reference device will be perpendicular to the rifle's horizontal bore center line. Consequently, when vertical and/or horizontal reference lines are generated by the alignment reference device they are known "good" reference lines to be lined up with the scope's stadia lines.

10 Claims, 48 Drawing Sheets

METHOD AND SYSTEM FOR FIREARM SCOPE LEVELING

BACKGROUND

Firearms, and rifles in particular, have become increasingly accurate over the past several decades, with new levels of accuracy emerging virtually every year. Likewise, the performance and capabilities of optics, such as rifle scopes, has also increased significantly over the past several years. As a result of these increasing firearm and optics capabilities there is also an increasing number of shooters who desire to push the limits of long-range accuracy of these systems.

Throughout the discussion below, the terms "firearm" and "rifle" are used interchangeably and include any firearm, such as a pistol, long gun, rifle, musket, shotgun etc., as discussed herein, and/or are known in the art at the time of filing, and/or as are developed/made available after the time of filing. Therefore, in the discussion below where the term "rifle" is used, it is intended to include any firearm, such as a pistol, long gun, rifle, musket, shotgun etc., as discussed herein, and/or are known in the art at the time of filing, and/or as are developed/made available after the time of filing.

One important, but sometimes underemphasized, component of creating an accurate long-distance firearm and optic system is to ensure that the optic component of the system, e.g., the scope mounted to the rifle, and its reticle, is level with respect to the center line of the rifle's bore axis. Of note, leveling a rifle scope, and its reticle, to the rifle is not the same as leveling the rifle during shooting. Instead, as used herein, the term rifle scope leveling includes leveling the scope and its reticle stadia lines with respect to the centerline of the rifle's bore so that there is no cant introduced between the vertical or horizontal planes defined by the rifle scope's reticle stadia lines and vertical and horizontal planes that are at ninety degrees with respect to the rifle bore centerline.

FIG. 1 shows one illustrative example of a typical firearm and optic system 100. As seen in FIG. 1, a firearm scope 101 is typically mounted atop the firearm 102 using one or more of various mounting points and/or mechanisms 105 which are attached, in turn, to the firearm 102. The scope 101 itself is generally mounted within one or more scope rings 107 which include one or more clamping devices 108 sized to permit attachment to mounting points and/or mechanisms 105 by one or more scope ring securing bolts 109 passing through clamping holes in the ears 111. In the particular illustrative example of FIG. 1, the scope mounting system, including mounting points and/or mechanisms 105, is a system used to mount a Ziess scope and includes a mounting mechanism 105 with a machined flat upper surface 106. In other examples, various other scope mounting systems, such as weaver or picatinny rails systems, may be used as the mounting points and/or mechanisms 105.

Also shown in FIG. 1 is viewing end 120 of scope 101, rifle receiver 121, used to chamber rounds (not shown) via, in this specific example, a bolt mechanism (not shown), and rifle barrel receiver end 122 of rifle barrel 123 (not shown in full in FIG. 1) into which a round is chambered by the rifle's action (not shown) housed in rifle receiver 121. Opposite rifle barrel receiver end 122 is rifle barrel muzzle end (not shown in FIG. 1) through which a bullet leaves the rifle barrel 123 along a rifle longitudinal centerline (shown as element 211 in FIG. 2).

FIG. 2 shows a simplified typical scope reticle view, as viewed through end 120 of scope 101 in FIG. 1. Referring to FIG. 1 and FIG. 2 together, FIG. 2 includes a simplified block diagram of rifle receiver 121 as would be viewed in cutaway from end 120, mounting mechanism 105, in this example is a mounting mechanism 105 with a machined flat upper surface 106, as would be viewed in cutaway from end 120, rifle barrel receiver end 122 of rifle barrel 123 as would be viewed in cutaway from end 120, and a simplified representation of a rifle body buttstock 250, in cutaway. FIG. 2 also includes scope reticle 200 with vertical stadia line 201 and horizontal stadia line 203, referred to collectively as reticle stadia lines.

In the simplified diagram of FIG. 2, longitudinal rifle bore center line 211 extends longitudinally into the page down the center of rifle barrel 123 from rifle barrel receiver end 122 to the rifle barrel muzzle end (not shown) of the rifle 102. Longitudinal rifle bore center line 211 is a theoretical component used to represent the longitudinal centerline of the circular bore of rifle barrel 123. The rifle barrel 123 extends longitudinally, along longitudinal rifle bore center line 211, into the page extending from rifle barrel receiver end 122 to the rifle barrel muzzle end (not shown). As shown in FIG. 2, rifle barrel receiver has a vertical centerline 222 extending from the top of the receiver 260 to the bottom of the receiver 261 and that is at ninety degrees to longitudinal rifle bore center line 211.

Also shown in FIG. 2 are vertical and horizontal bore center lines 221 and 223, respectively. Vertical bore center line 221 is a theoretical component that runs vertically through the middle of longitudinal rifle bore center line 211 along rifle receiver centerline 222 and perpendicular to longitudinal rifle bore center line 211. Likewise. Horizontal bore center line 223 is a theoretical component that runs horizontally through the middle of longitudinal rifle bore center line 211, perpendicular to rifle receiver centerline 222, and perpendicular to both longitudinal rifle bore center line 211 and vertical bore center line 221.

Referring to FIGS. 1 and 2 together, as noted above, scope 101 itself is generally mounted within one or more scope rings 107 which include one or more clamping devices 108. Typically, this scope ring configuration allows longitudinal rotation, e.g., clockwise 290 or counterclockwise 291 rotation, of the scope 101 within its ring(s) 107 so that the scope's reticle stadia lines 201 and 203 can be oriented such that the vertical stadia line 201 can, ideally, be aligned perfectly with vertical bore center line 221 and rifle receiver centerline 222, and at ninety degrees to longitudinal rifle bore center line 211. This vertical orientation is referred to herein as true or "good" vertical orientation. Likewise, a scope ring configuration allows longitudinal rotation of the scope 101 within its ring(s) 107 so that the horizontal stadia line 203 can, ideally, be aligned perfectly with horizontal bore center line 223, and at ninety degrees to longitudinal rifle bore center line 211 and rifle receiver centerline 222. This horizontal orientation is referred to herein as true or "good" horizontal orientation.

Consequently, for ideal scope leveling, the scope's reticle stadia lines 201 and 203 would be oriented such that the vertical stadia line 201 is aligned perfectly parallel with vertical bore center line 221 and rifle receiver centerline 222, and at ninety degrees to longitudinal rifle bore center line 211, and the horizontal stadia line 203 is aligned perfectly parallel with horizontal bore center line 223, and at ninety degrees to longitudinal rifle bore center line 211 and rifle receiver centerline 222.

FIG. 3A shows the simplified illustration of the results of an ideal scope leveling configuration. Referring to FIGS. 2 and 3A, FIG. 3A includes common vertical line 300 through which, ideally, runs through rifle receiver centerline 222 and vertical bore center line 221. As seen in FIG. 3A, vertical stadia line 201 is aligned perfectly with vertical bore center line 221 along common vertical line 300. In addition, horizontal stadia line 203 is aligned perfectly parallel with horizontal bore center line 223 as indicated by horizontal stadia line 203 being perfectly parallel aligned with horizontal line 301 and horizontal bore center line 223 being perfectly parallel aligned with horizontal line 303 that runs parallel to horizontal line 301. The ideally leveled scope configuration of FIG. 3A can theoretically result in ideal shot placement 350 in the center of target 351.

Of note, in practice, it is often assumed that vertical stadia line 201 and horizontal stadia line 203 are positioned perfectly at ninety degrees to each other in the reticle as provided by the manufacturer. This is referred to as the vertical and horizontal stadia lines being "in plumb." Therefore, in theory, if vertical stadia line 201 is aligned perfectly with vertical bore center line 221 along common vertical line 300, then horizontal stadia line 203 is automatically aligned perfectly with horizontal bore center line 223. Consequently, in many cases, only the alignment of vertical stadia line 201 with vertical bore center line 221, or horizontal stadia line 203 with horizontal bore center line 223, is performed.

FIG. 3B shows a line diagram of the ideal relationship between longitudinal rifle bore center line 211, vertical bore center line 221 and vertical stadia line 201, and horizontal bore center line 223 and horizontal stadia line 203. As seen in FIG. 3B, ideally, vertical bore center line 221 and vertical stadia line 201 are parallel and at right angles to longitudinal rifle bore center line 211. In addition, horizontal bore center line 223 and horizontal stadia line 203 are parallel and at right angles to both longitudinal rifle bore center line 211, and vertical bore center line 221, and vertical stadia line 201. Just as shown in FIG. 3A, the result is the ideally leveled scope configuration of FIG. 3A that can theoretically result in ideal shot placement 350 in the center of target 351.

When shooting, and of particular concern when shooting at long distance, a shooter must adjust the angle of a shot to account for the drop of the bullet during its trajectory to the target. In order to compensate for this drop, the shooter will typically move the rifle upward by some mechanism, typically by moving the target image vertically downward along the vertical stadia line 201. However, if the scope 101 is aligned with the longitudinal rifle bore center line 211 only at the center or crosshair of the horizontal and vertical scope stadia line 201 and 203, i.e., the scope 101 is misaligned vertically, which is often the case, as the target image is moved away from the crosshair along the vertical scope stadia line 201, a horizontal error will be introduced.

FIG. 4 shows one exaggerated example of a scope 101 incorrectly canted clockwise 290. As seen in FIG. 4, the result is a cant angle 401 between common vertical line 300 and vertical stadia line 201, and between horizontal line 301 and horizontal stadia line 203. This, in turn, means a cant angle 401 between vertical stadia line 201 and vertical bore center line 221 as well as a cant angle 401 between horizontal stadia line 203 and horizontal bore center line 223.

As seen in FIG. 4, when scope 101 is incorrectly canted clockwise, shot placement 450 typically lands to the right of the center of target 451 as compared with ideal shot placement 350 in the center of target 351 of FIGS. 3A and 3B.

FIG. 5 shows one example of a scope 101 incorrectly canted counterclockwise 291. As seen in FIG. 5, the result is a cant angle 501 between common vertical line 300 and vertical stadia line 201 and between horizontal line 301 and horizontal stadia line 203. This, in turn, means a cant angle 501 between vertical stadia line 201 and vertical bore center line 221 as well as a cant angle 501 between horizontal stadia line 203 and horizontal bore center line 223.

As seen in FIG. 5, when scope 101 is incorrectly canted counterclockwise, shot placement 550 typically lands to the right of the center of target 551 as compared with ideal shot placement 350 in the center of target 351 of FIGS. 3A and 3B.

When peering through the scope 101, a shooter will naturally attempt to correct a canted scope situation by tilting/canting the rifle 102, in the direction opposite to that of the scope tilt or cant, in this example assume the clockwise cant of angle 401 and a shooter induced counterclockwise tilt of approximately angle 401. Many scopes 101 even have bubble, or other leveling device, which facilitate that manipulation (not shown). However, this still creates a canting issue especially at long-ranges.

The long-range inaccuracies problem arises from the fact that a bullet does not travel in a straight line but rather in a parabolic curve. To illustrate, if a person drops an object from the same height as the muzzle end of a level rifle at the exact instant a bullet is fired horizontally, the bullet will fly the same time as it takes the dropped object to fall vertically to the ground (neglecting to take air resistance, wind, and other forces into account). In other words, for level ground and a level scope, the fired bullet will drop the same vertical distance as the dropped object in the same time. This is because both the bullet and the dropped object are subject to the same gravitational force in the vertical direction and accelerate in the vertical direction at the same constant rate of 32 feet per second, per second. Consequently, the downward velocity of both the bullet and the dropped object increases by 32 feet per second each second between when the object is dropped and the bullet is fired and when the object hits the ground, or the bullet hits the target.

However, because this 32 feet per second, per second is a constant, the vertical velocity of both the bullet and the dropped object is faster at the end of the first second than it was at the beginning. Consequently, the bullet must be fired upwards, or lobbed, in a parabolic path for its trajectory to follow an arcuate path which will intersect with the scope's reticle stadia lines 201 and 203 at the designated target range. Pointing the barrel upwards imposes an upward component upon the bullet which partially offsets the gravitational downward component constantly acting upon it.

For a more complete illustration, assume that the firearm barrel is pointed upwards but at a little less than the pitch which would allow it to strike the bull's eye of a distant target. In a short while, the duration of which depends upon the upwards or pitch angle of the barrel with reference to the attitude of the scope, the bullet trajectory crosses the scope sighting line. That conjunction is the proximal bullet trajectory and scope sighting horizontal plane intersection point. Then the bullet passes through an intermediate trajectory sector. At any point within intermediate trajectory sector, the bullet is above the scope sighting line.

Eventually, depending upon the barrel's pitch angle with reference to the scope's attitude, the bullet trajectory again crosses the scope sighting line, this time arcing downwards toward the target. That conjunction is the distal bullet trajectory and scope sighting horizontal plane intersection point. It is at this point that the bullet would, if the barrel were properly pitched, be expected to strike the bull's eye of the target. In the given circumstances, the bullet then passes through a distal trajectory sector. At any point within the distal trajectory sector, the bullet is below the scope sighting line.

The foregoing illustration deals with the trajectory of a bullet from a non-canted firearm. It ignores windage, non-level terrain, temperature, humidity, aerodynamic effects upon the bullet and other likely relevant factors as well as terminal velocity due to air resistance.

However, when, as described above, the shooter attempts to correct the situation by tilting/canting the rifle 102, in the direction opposite to that of the scope tilt or cant, the bullet now fired from firearm 102 canted counterclockwise with respect to the scope 101 travels forward and passes through the proximal trajectory sector below the scope sighting horizontal plane but has been impelled slightly to the left of the scope sighting vertical plane, which is oriented at true vertical with respect to the scope's vertical stadia line 201 by the counter cant. In this case, the bullet has not dropped quite as far as desired because by canting the firearm 102, the operator has actually slightly raised the firearm barrel, causing the bullet to initiate its trajectory from the ever-so-slightly higher level.

In keeping with the explanation above, the bullet trajectory for a bullet fired from a canted firearm quickly crosses the scope sighting horizontal plane but now, because of the raised initial emission height caused by canting the firearm 102, it crosses that plane at a point slightly nearer the operator than the proximal bullet trajectory and scope sighting horizontal plane intersection point for a bullet fired from a non-canted firearm. It has also strayed farther to the left. A target situated at the non-canting intersection point might even be struck above the bull's eye depending upon how much initial vertical displacement occurs by attempting to compensate for a given cant angle. This is a trivial point, however, since the greatest error in bullet trajectory from canted firing will be in azimuth. In fact, in applying the seemingly corrective counterclockwise canting manipulation, a portion of the bullet's upward impelling angle is lost. After all, if that manipulation were continued all of the way to the scope sighting horizontal plane, the pitch angle would be reduced to zero and the trajectory would be that observed merely in horizontal firing, albeit directed away in azimuth.

As the bullet impelled by the canted firing traverses the intermediate trajectory sector, it may be only slightly above the scope sighting horizontal plane, having failed to attain its intended altitude by reason of the loss of some of the barrel's pitch angle, but it is still progressing leftward along its path.

Then, as the bullet trajectory again crosses the scope sighting horizontal plane, it does so at a point nearer the operator than the distal bullet trajectory and scope sighting horizontal plane intersection point for a non-canted firearm, tracing out its declining arc toward the target. It is at this point that the bullet would, if the barrel were not canted and were properly pitched, be expected to strike the bull's eye of the target. Instead, it has reached a point significantly to the left, and slightly below, the bull's eye.

In the given circumstances, which permit observation of the complete trajectory, the bullet then passes through the distal trajectory sector, at any point within which, it is displaced even farther below the scope sighting horizontal plane and farther left of the bull's eye of the target.

Finally, the bullet misses the target, going dramatically downward and to the left. The shot may properly be characterized as having gone "wild".

FIG. 6 summarizes the effects of the introduction of scope canting as set forth in FIGS. 2, 3A, 3B, 4 and 5, and as discussed above. FIG. 6 shows more realistic examples where the cant is not as exaggerated as the cant shown in FIGS. 4 and 5.

Historically, expensive, and often complicated, adjustment mechanisms were employed to try and achieve the ideal scope leveling alignment of FIGS. 2, 3A and 3B. In many situations, precise scope leveling attempted without benefit of such elaborate equipment was all but impossible. In addition, even when using the prior art elaborate and expensive systems, precise scope leveling could not be achieved because the shooter desiring to align the scope's vertical stadia line 201 perfectly with vertical bore center line 221, and at ninety degrees to longitudinal rifle bore center line 211, and/or to align the scope's horizontal stadia line 203 with horizontal bore center line 223, could not see the various components used for scope leveling and the object of alignment simultaneously, or even successively, with any acceptable degree of continuity. Even more difficult, as discussed below, using many prior art systems, even if perfect alignment, or any desired/acceptable alignment, were momentarily achieved that alignment had to be maintained while the user attempted to tighten down scope ring securing bolts 109 to, in turn, secure scope 101 in scope rings 107.

FIG. 7 shows one example of one prior art scope leveling system 700. Referring to FIGS. 1 and 7, as seen in FIG. 7, prior art scope leveling system 700 includes no less than four leveling devices 701, 702, 703, and 704, that have to be mounted precisely and made level simultaneously by keeping the individual level bubbles centered. As noted, keeping all four leveling devices, and their respective level bubbles centered, while lining up the scope's horizontal stadia line 203 and scope's vertical stadia line with the object of alignment simultaneously, or even successively, is extremely difficult and is often not achieved with any acceptable degree of continuity. As also noted above, even more difficult, using many prior art systems, even if perfect alignment, or any desired/acceptable alignment, were momentarily achieved, that alignment has to be maintained while the user attempts to tighten down scope ring securing bolts 109 passing through clamping holes in the ears 111 to, in turn, secure scope 101 in scope rings 107.

Several other examples of prior scope leveling systems are known. However, all suffer from various significant disadvantages ranging form unacceptable complexity and cost, to unacceptable mounting modifications required and/or potential damage to the firearm, to simple inability to actually achieve scope leveling with any acceptable degree of accuracy and/or continuity.

What is needed is a method and system for solving the long-standing technical problem of scope leveling that is relatively simple, relatively inexpensive, and uses readily available components, yet provides scope leveling with a high acceptable degree of accuracy and continuity.

SUMMARY

Embodiments of the present disclosure provide a solution to the long-standing technical problem of scope leveling by disclosing a method and system for scope leveling that is relatively simple, relatively inexpensive, uses readily available components, and yet provides scope leveling with a high degree of accuracy and continuity.

To this end, in one embodiment, a reference device support platform is provided that is removably attached to a rifle such that a reference device support platform first surface is parallel rifle's action, and therefore the rifle's horizontal bore center line, and perpendicular to rifle's receiver centerline and therefore the rifle's vertical bore center line. In one embodiment, once the reference device support platform is removably attached to the rifle such that a reference device support platform first surface is parallel rifle's horizontal bore center line and perpendicular to rifle's vertical bore center line, an alignment reference device, such as a laser leveling device, can be placed on the reference device support platform first surface and thereby be supported by the reference device support platform.

When the alignment reference device is so placed, a horizontal axis of the alignment reference device will automatically be parallel to the rifle's horizontal bore center line and perpendicular to rifle's vertical bore center line. Likewise, when the alignment reference device is so placed, a vertical axis of the alignment reference device will be perpendicular to the rifle's horizontal bore center line and parallel to rifle's vertical bore center line. Consequently, when the alignment reference device generates vertical and/or horizontal reference lines, such as laser leveling lines, a generated vertical reference line will be parallel to the rifle's vertical bore center line and a generated horizontal reference line will be parallel to the rifle's horizontal bore center line.

Consequently, using the disclosed embodiments, known "good" or true vertical and/or horizontal reference lines, such as laser leveling lines, i.e., vertical reference lines known to be parallel to the rifle's vertical bore center line and horizontal reference lines known to be parallel to the rifle's horizontal bore center line, are provided. The scope's vertical stadia line and/or horizontal stadia line, can then be adjusted to line up with these known good vertical and/or horizontal reference lines, respectively. Then once lined up, the scope rings, or other attachment mechanism, can be tightened or adjusted to secure the scope in place in a now known leveled position.

Consequently, using the disclosed embodiments, known "good" or true vertical and/or horizontal reference lines, such as laser leveling lines, i.e., vertical reference lines known to be parallel to the rifle's vertical bore center line and horizontal reference lines known to be parallel to the rifle's horizontal bore center line, are provided. The scope's vertical stadia line and/or horizontal stadia line, can then be adjusted to line up with these known good vertical and/or horizontal reference lines, respectively. Then once lined up, the scope rings, or other attachment mechanism, can be tightened or adjusted to secure the scope in place in a now known leveled position.

In other embodiments, a reference device support platform is provided that is removably attached to a rifle such that a reference device support platform first surface is perpendicular to the rifle's action, and therefore the rifle's horizontal bore center line, and parallel to rifle's receiver centerline and therefore the rifle's vertical bore center line. In one embodiment, once the reference device support platform is removably attached to the rifle such that a reference device support platform first surface is perpendicular rifle's horizontal bore center line and parallel to rifle's vertical bore center line, an alignment reference device, such as a laser leveling device, can be placed on the reference device support platform first surface and thereby be supported by the reference device support platform.

When the alignment reference device is so placed, a horizontal axis of the alignment reference device will automatically be perpendicular to the rifle's horizontal bore center line and parallel to rifle's vertical bore center line. Likewise, when the alignment reference device is so placed, a vertical axis of the alignment reference device will be parallel to the rifle's horizontal bore center line and perpendicular to rifle's vertical bore center line. Consequently, when the alignment reference device generates vertical and/or horizontal reference lines, such as laser leveling lines, a generated vertical reference line will be parallel to the rifle's horizontal bore center line and a generated horizontal reference line will be to parallel the rifle's vertical bore center line.

Consequently, using the disclosed embodiments, known "good" or true vertical and/or horizontal reference lines, such as laser leveling lines, i.e., vertical reference lines known to be parallel to the rifle's horizontal bore center line and horizontal reference lines known to be parallel to the rifle's vertical bore center line, are provided. The scope's vertical stadia line and/or horizontal stadia line, can then be adjusted to line up with these known good vertical and/or horizontal reference lines, respectively. Then once lined up, the scope rings, or other attachment mechanism, can be tightened or adjusted to secure the scope in place in a now known leveled position.

Using the disclosed embodiments, and the known good vertical reference lines and/or horizontal reference lines generated, there is no need for expensive, and often complicated, adjustment mechanisms that were employed in the prior art to try and achieve the ideal scope leveling alignment. In addition, using the disclosed embodiments, rather than trying to level and see the various components and the object of alignment simultaneously, or even successively, the operator/shooter need only align the scope's vertical stadia line with the known good vertical reference line and/or the scope's horizontal stadia line with the known good horizontal reference line provided using the disclosed embodiments. In short, there is only one alignment, and at most two alignments, that must be observed and maintained while the scope rings, or other attachment mechanism, is tightened or adjusted to secure the scope in place in a now known leveled position.

In addition, the human eye can observe the alignment of two lines, such as a scope's horizontal stadia line with the known good horizontal reference line of the disclosed embodiments, or the scope's vertical stadia line with the known good vertical reference line of the disclosed embodiments, or both, more readily/easily, and far more accurately, than the eye can determine the center point of anything, such as a leveling bubble. In short, it is easier for the human eye to line up two-dimensional lines that one-dimensional points. Consequently, not only are the disclosed embodiments simpler to use, but they also yield more accurate and consistent results.

In addition, the disclosed embodiments make use of simple materials and components such as metal and/or magnetic bars; simple, removable, and non-invasive attachment mechanisms; and readily available, and relatively inexpensive, alignment reference devices, such as inexpensive laser-based alignment reference devices commonly used in carpentry and construction.

Consequently, as discussed in more detail below, the disclosed embodiments provide a technical solution to the long-standing technical problem of providing a method and system for solving the long-standing technical problem of scope leveling that is relatively simple, relatively inexpensive, and uses readily available components, yet provides scope leveling with a high degree of accuracy and continuity.

BRIEF DESCRIPTION OF THE DRAWINGS

Common reference numerals are used throughout the figures (FIGs.) and the detailed description to indicate like elements. One skilled in the art will readily recognize that the above FIGs. are merely illustrative examples and that other architectures, modes of operation, orders of operation, and elements/functions can be provided and implemented without departing from the characteristics and features of the invention, as set forth in the claims.

DETAILED DESCRIPTION

Figure 1:
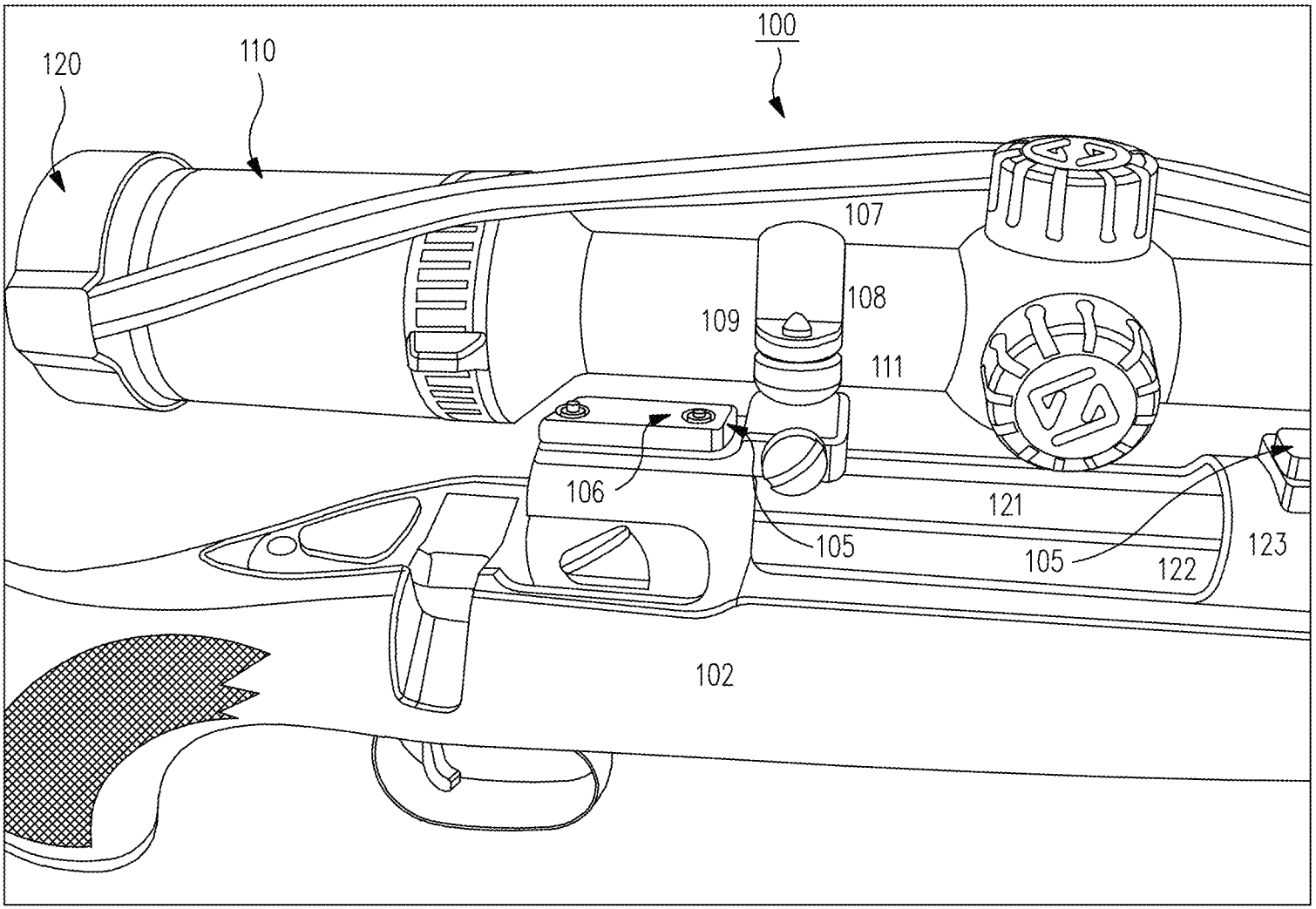
FIG. 1 shows one illustrative example of a typical firearm and optic system.

Embodiments will now be discussed with reference to the accompanying figures, which depict one or more exemplary embodiments. Embodiments may be implemented in many different forms and should not be construed as limited to the embodiments set forth herein, shown in the figures, or described below. Rather, these exemplary embodiments are provided to allow a complete disclosure that conveys the principles of the invention, as set forth in the claims, to those of skill in the art.

According to the disclosed embodiments, a reference device support platform is provided that has a length dimension and a width dimension. In one embodiment, the reference device support platform has a reference device support platform first surface with a length dimension and a width dimension and a reference device support platform second surface, opposite the reference device support platform first surface with a length dimension and a width dimension. In one embodiment, the reference device support platform has a reference device support platform thickness separating the first and second surfaces and forming a reference device support platform first side, reference device support platform second side, reference device support platform first end, and reference device support platform second end each of a respective thickness.

In some embodiments, the reference device support platform is made of a metallic material. In some embodiments, the reference device support platform is made of a magnetic material. In some embodiments, the reference device support platform includes magnetic material and/or magnets positioned in only some areas of the reference device support platform. In various embodiments, the reference device support platform is made of any material, or combination of materials, desired and as described herein, and/or known in the art at the time of filing, and/or as becomes known after the time of filing that can be used to form a relatively ridged reference device support platform.

In one embodiment, the reference device support platform first surface lies in a reference device support platform first surface plane. In one embodiment, the reference device support platform is removably attached to a rifle such that the reference device support platform first surface plane is perpendicular to a centerline of the rifle's receiver extending down from the top of the rifle receiver to the bottom of the rifle receiver and parallel to the rifle bore's longitudinal centerline. Consequently, when removably attached as disclosed, the reference device support platform first surface is parallel to the rifle's horizontal bore center line and perpendicular to the rifle's vertical bore center line.

As discussed above, in some embodiments, the reference device support platform is made of a magnetic material or includes magnetic material and/or magnets positioned in only some areas of the reference device support platform. In these embodiments, the reference device support platform is removably attached to the rifle by magnetic forces and by attaching the reference device support platform to metallic surfaces of the firearms action or scope mounts, or any other metallic part of the rifle that is flat, or provides for flat attachment, and whose flat surface, or surfaces are parallel to the rifle's action and therefore the rifle's horizontal bore center line and perpendicular to the rifle's vertical bore center line.

As a specific example, in one embodiment, the reference device support platform is removably attached to the rifle by magnetically attaching the reference device support platform to the flat surface of a scope mounting system mechanism that includes a flat upper surface that is in a plane parallel to the rifle bore horizontal axis and perpendicular to the rifle bore vertical axis.

A very specific illustrative example of this type of scope mounting system mechanism is a Ziess scope mounting system mechanism that includes a scope mounting system mechanisms that includes a flat upper surface that is in a plane parallel to the rifle's action and therefore the rifle's bore horizontal axis and perpendicular to the rifle bore vertical axis.

As noted, in one embodiment, at least part of the reference device support platform is magnetic. In one embodiment, this magnetic portion is used to removably attach the reference device support platform to the rifle by magnetic forces between the magnetic portion of the reference device support platform and the metallic flat upper surface of the scope mounting system mechanism. The result is that the reference device support platform is attached to the firearm such that the reference device support platform first surface plane is perpendicular to a centerline of the rifle's receiver extending down from the top of the rifle receiver to the bottom of the rifle receiver and parallel to the rifle's action and the bore's longitudinal centerline. Consequently, when removably attached as disclosed, the reference device support platform first surface is parallel to the rifle's horizontal bore center line and perpendicular to the rifle's vertical bore center line.

In other embodiments, the reference device support platform is removably attached to the rifle using various parts of the rifle, such as bolt guide rails, and/or receiver surfaces, that allow the reference device support platform to be removably attached to a rifle such that the reference device support platform first surface plane is perpendicular to a centerline of the rifle's receiver extending down from the top of the rifle receiver to the bottom of the rifle receiver and parallel to the rifle's action and the bore's longitudinal centerline.

In other embodiments, the reference device support platform is removably attached to the rifle using mechanical mechanisms and various attachment systems such as a picatinny or weaver rail system that allows the reference device support platform to be removably attached to a rifle such that the reference device support platform first surface plane is perpendicular to a centerline of the rifle's receiver extending down from the top of the rifle receiver to the bottom of the rifle receiver and parallel to the rifle's action and the bore's longitudinal centerline.

In one embodiment, once the reference device support platform is removably attached such that the reference device support platform first surface is parallel to the rifle's horizontal bore center line and perpendicular to the rifle's vertical bore center line, an alignment reference device, such as a laser leveling device, can be placed on the reference device support platform first surface and thereby supported by the reference device support platform.

As discussed herein, in some embodiments, the reference device support platform is made of a magnetic material or includes magnetic material and/or magnets positioned in only some areas of the reference device support platform. In these embodiments, the alignment reference device can be supported on the reference device support platform via a magnetic force between the reference device support platform and any metallic part of the alignment reference device.

In other embodiments, the alignment reference device can be supported on the reference device support platform via one or more attachment holes and/or one or more mechanical attachment devices such as a clamp or screw mechanism. In other embodiments, the alignment reference device can be supported on the reference device support platform via gravitational force by simply placing the alignment reference device on the first surface of the reference device support platform. In various other embodiments, the alignment reference device can be supported on the reference device support platform using any mechanism discussed herein, and/or as known in the art at the time of filing, and/or as developed after the time of filing for securing an alignment reference device to a support platform.

When the alignment reference device is so placed, a horizontal axis of the alignment reference device will be parallel to the reference device support platform first surface plane. As a result, the horizontal axis of the alignment reference device will also be parallel to the rifle's horizontal bore center line and perpendicular to rifle's vertical bore center line. Likewise, when the alignment reference device is so placed, a vertical axis of the alignment reference device will be perpendicular to the reference device support platform first surface plane. As a result, the vertical axis of the alignment reference device will also be perpendicular to the rifle's horizontal bore center line and parallel to rifle's vertical bore center line.

Consequently, once the alignment reference device is placed on the reference device support platform first surface, any vertical reference line generated by the alignment reference device along the alignment reference device's vertical axis will be perpendicular to the rifle's horizontal bore center line and parallel to rifle's vertical bore center line. Likewise, any horizontal reference line generated by the alignment reference device along the alignment reference device's horizontal axis will be parallel to the rifle's horizontal bore center line and perpendicular to rifle's vertical bore center line.

In one embodiment, the alignment reference device is then placed on the reference device support platform first surface and used to generate a vertical reference line, or a horizontal reference line, or both a vertical reference line and a horizontal reference line. A generated vertical reference line can be used for leveling the scope using the fact that the generated vertical reference line is now known to be parallel to rifle's vertical bore center line. A generated horizontal reference line can be used for leveling the scope using the fact that the generated horizontal reference line is now known to be parallel to rifle's horizontal bore center line. Using both a generated horizontal and vertical reference line, both can be used for leveling the scope using the fact that the generated reference lines are now known to be parallel to rifle's vertical bore center line horizontal bore center line, respectively.

Consequently, using the disclosed embodiments, vertical reference lines known to be parallel to rifle's vertical bore center line and/or horizontal reference lines known to be parallel to rifle's horizontal bore center line can be generated and used for scope leveling. Using the disclosed embodiments, these "known good" vertical reference lines and/or horizontal reference lines can then be lined up with the scope's vertical stadia line and/or horizontal stadia line, respectively by rotating the scope along the scope's longitudinal access clockwise of counterclockwise. Then once lined up, the scope rings, or other attachment mechanism, can be tightened or adjusted to secure the scope in place in a leveled position.

In other embodiments, a reference device support platform is provided that is removably attached to a rifle such that a reference device support platform first surface is perpendicular to the rifle's action, and therefore the rifle's horizontal bore center line, and parallel to rifle's receiver centerline and therefore the rifle's vertical bore center line. In one embodiment, once the reference device support platform is removably attached to the rifle such that a reference device support platform first surface is perpendicular rifle's horizontal bore center line and parallel to rifle's vertical bore center line, an alignment reference device, such as a laser leveling device, can be placed on the reference device support platform first surface and thereby be supported by the reference device support platform.

When the alignment reference device is so placed, a horizontal axis of the alignment reference device will automatically be perpendicular to the rifle's horizontal bore center line and parallel to rifle's vertical bore center line. Likewise, when the alignment reference device is so placed, a vertical axis of the alignment reference device will be parallel to the rifle's horizontal bore center line and perpendicular to rifle's vertical bore center line. Consequently, when the alignment reference device generates vertical and/or horizontal reference lines, such as laser leveling lines, a generated vertical reference line will be parallel to the rifle's horizontal bore center line and a generated horizontal reference line will be to parallel the rifle's vertical bore center line.

Consequently, using the disclosed embodiments, known "good" or true vertical and/or horizontal reference lines, such as laser leveling lines, i.e., vertical reference lines known to be parallel to the rifle's horizontal bore center line and horizontal reference lines known to be parallel to the rifle's vertical bore center line, are provided. The scope's vertical stadia line and/or horizontal stadia line, can then be adjusted to line up with these known good vertical and/or horizontal reference lines, respectively. Then once lined up, the scope rings, or other attachment mechanism, can be tightened or adjusted to secure the scope in place in a now known leveled position.

As shown above, and as discussed in more detail below, the disclosed embodiments provide a technical solution to the long-standing technical problem of providing a method and system for solving the long-standing technical problem of scope leveling that is relatively simple, relatively inexpensive, and uses readily available components, yet provides scope leveling with a high acceptable degree of accuracy and continuity.

Figure 8A:
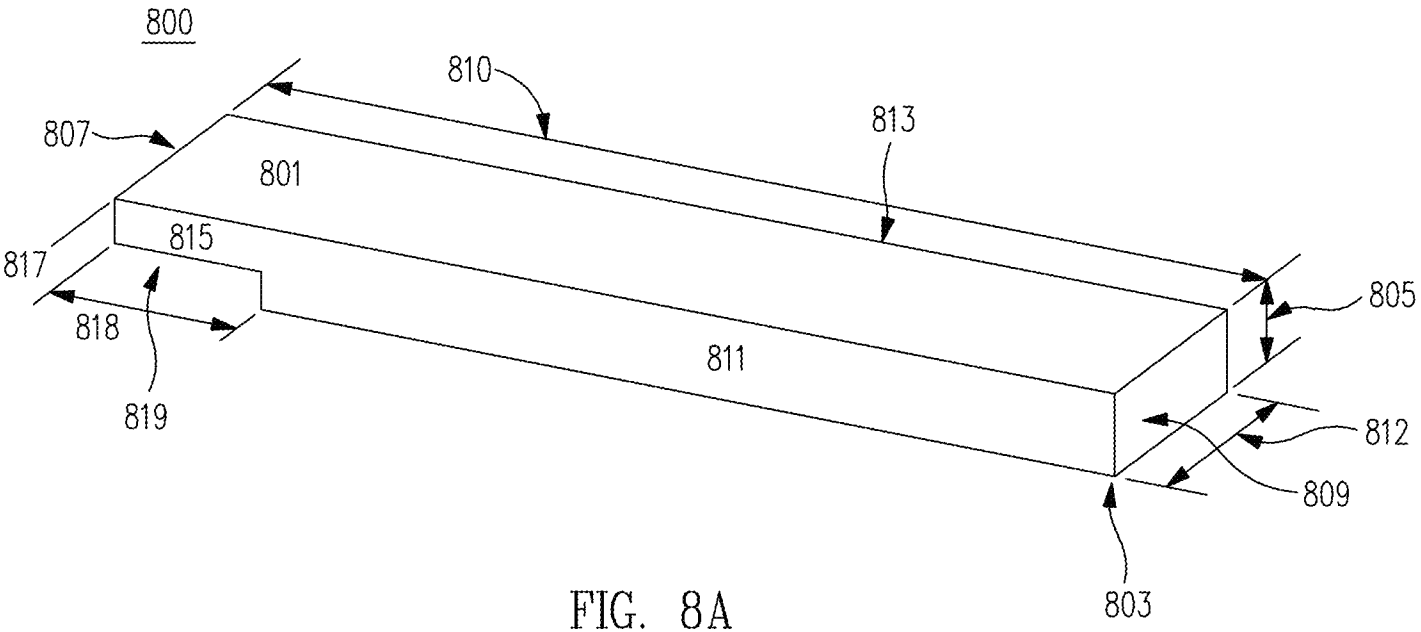
FIG. 8A shows a line drawing of a perspective view a reference device support platform in accordance with one embodiment.

FIG. 8A shows a line drawing of a perspective view a reference device support platform 800 in accordance with one embodiment. As seen in FIG. 8A, reference device support platform 800 includes a reference device support platform first or upper surface 801 and a reference device support platform second or lower surface 803 opposite reference device support platform first or upper surface 801.

As also seen in FIG. 8A, reference device support platform 800 includes reference device support platform first or attachment end 807 and reference device support platform second or support end 809 opposite reference device support platform first end 807. As also seen in FIG. 8A, reference device support platform first surface 801 is separated from reference device support platform second surface 803 by reference device support platform body thickness 805.

As seen in FIG. 8A, reference device support platform first end 807 is separated from reference device support platform second end 809 by reference device support platform length dimension 810. As also seen in FIG. 8A, reference device support platform first surface 801 is separated from reference device support platform second surface 803 by reference device support platform body thickness 805. As also seen in FIG. 8A, reference device support platform 800 includes reference device support platform first side 811 and reference device support platform second side 813 opposite reference device support platform first side 811. As seen in FIG. 8A, reference device support platform first side 811 is separated from reference device support platform second side 813 by reference device support platform width dimension 812.

Of note, the particular embodiment of reference device support platform 800 of FIG. 8A includes attachment portion 815 at reference device support platform first end 807 of attachment portion thickness 817 forming an attachment notch 819 of attachment notch length 818. As discussed in more detail below with respect to FIGS. 14A through 14E, the specific embodiment of FIG. 8A that can be used with a scope mounting system mechanisms that includes a flat upper surface that is in a plane parallel to the rifle bore horizontal axis and perpendicular to the rifle bore vertical axis in accordance with one embodiment.

In one embodiment, reference device support platform length dimension 810 is in the range of 1.5 to 4.5 inches. In one embodiment, reference device support platform width dimension 812 is in the range of ½ to 1.5 inches. In one embodiment, reference device support platform body thickness 805 is in the range of 1/16 to ¼ inch. In one embodiment, attachment notch length 818 is in the range of ½ to 1.5 inches.

Figure 8B:
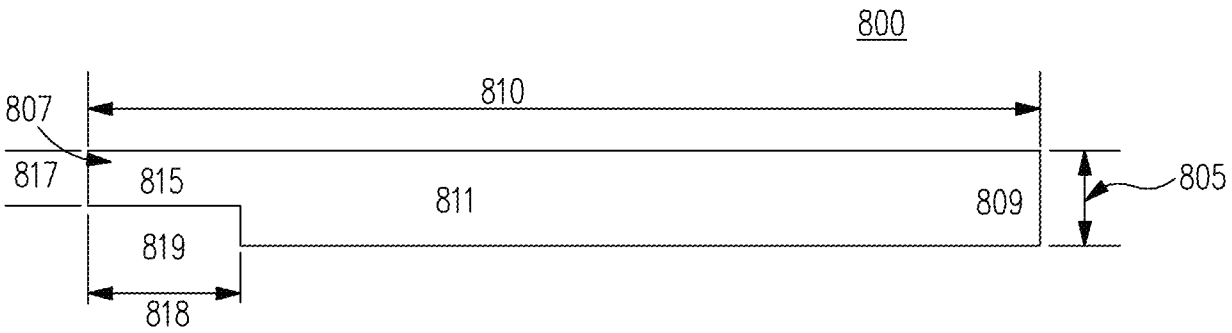
FIG. 8B shows a line drawing of a side view a reference device support platform in accordance with one embodiment.
Figure 8C:
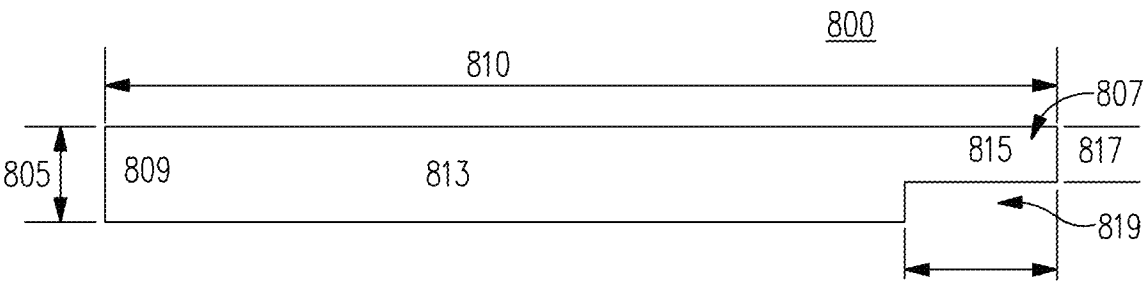
FIG. 8C shows a line drawing of a side view a reference device support platform in accordance with one embodiment.

FIG. 8B shows a line drawing of one embodiment of reference device support platform 800 of FIG. 8A, as viewed from reference device support platform first side 811. FIG. 8C shows a line drawing of reference device support platform 800 of FIGS. 8A and 8B, as viewed from reference device support platform second side 813. Referring to FIGS. 8A, 8B, and 8C together, shown in FIGS. 8B and 8C are reference device support platform body thickness 805; reference device support platform first end 807; reference device support platform second end 809; reference device support platform length dimension 810; attachment portion 815; attachment portion thickness 817; attachment notch 819, and attachment notch length 818.

Figure 8D:
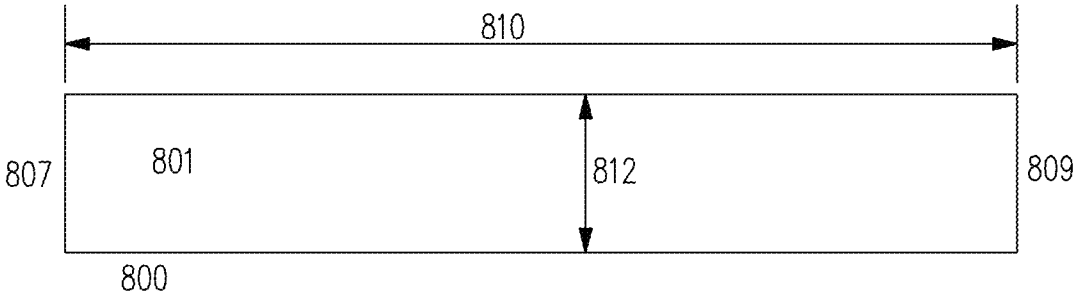
FIG. 8D shows a line drawing of a top view of a first surface of a reference device support platform in accordance with one embodiment.

FIG. 8D shows a line drawing of one embodiment of a top view of reference device support platform first surface 801 of reference device support platform 800 of FIGS. 8A, 8B, and 8C in accordance with one embodiment. Referring to FIGS. 8A, 8B, and 8C together, shown in FIG. 8D are reference device support platform first end 807; reference device support platform second end 809; reference device support platform length dimension 810; and reference device support platform width dimension 812.

Figure 8E:
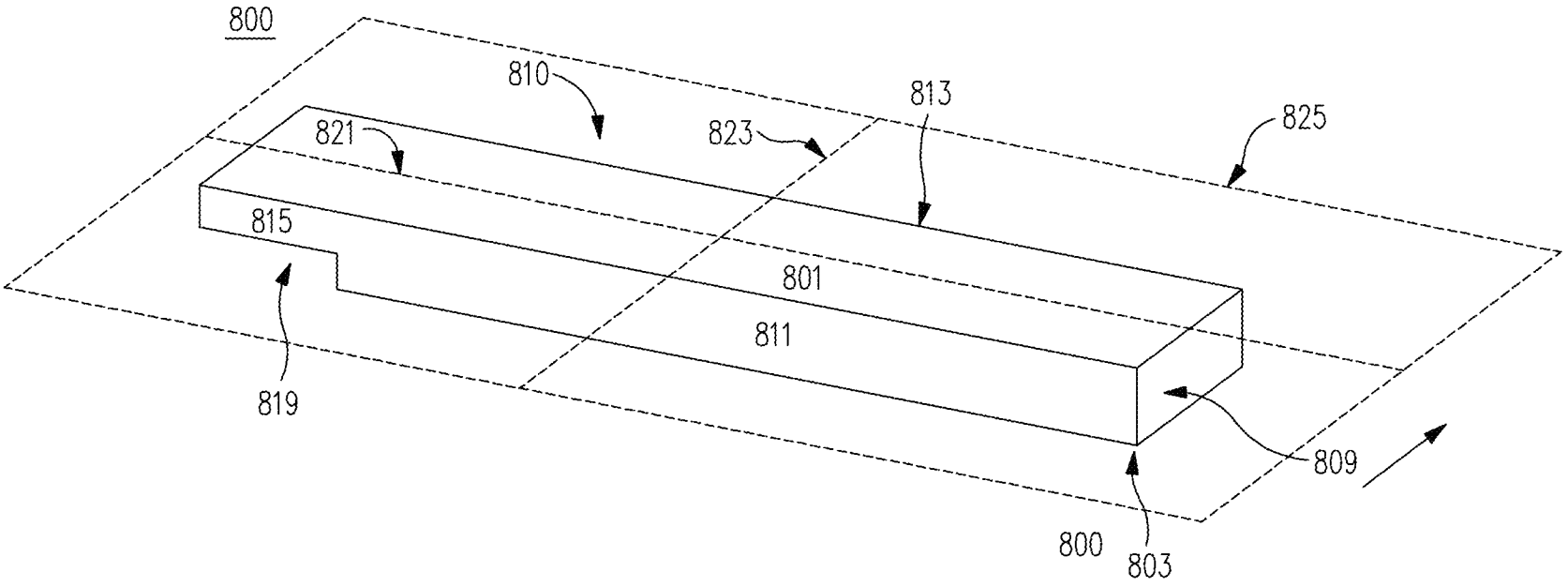
FIG. 8E shows a line drawing of a perspective view of the reference device support platform of FIG. 8A in accordance with one embodiment including reference device support platform first surface length axis and reference device support platform first surface width axis which define a reference device support platform first surface plane in which the reference device support platform first surface lies.

FIG. 8E shows a line drawing of a perspective view of one embodiment of reference device support platform 800 of FIG. 8A in accordance with one embodiment. Shown in FIG. 8D are reference device support platform first surface length axis 821 and reference device support platform first surface width axis 823 which define a reference device support platform first surface plane 825 in which the reference device support platform first surface 801 lies.

Figure 8F:
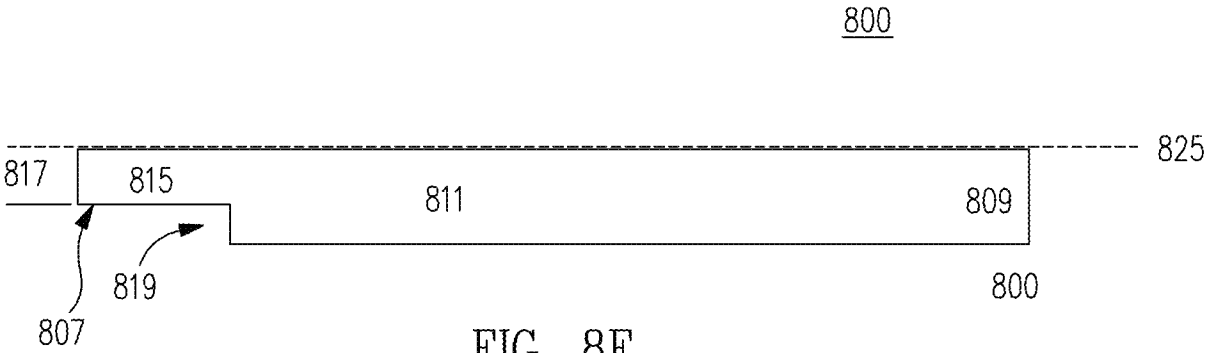
FIG. 8F shows a line drawing of a side view a reference device support platform of FIG. 8B in accordance with one embodiment including a side view of the reference device support platform first surface plane of FIG. 8D.

FIG. 8F shows a line drawing of a reference device support platform first side 811 view one embodiment of the reference device support platform of FIG. 8D. Also shown in FIG. 8F is a side view of reference device support platform first surface plane 825 of FIG. 8D.

Figure 8G:
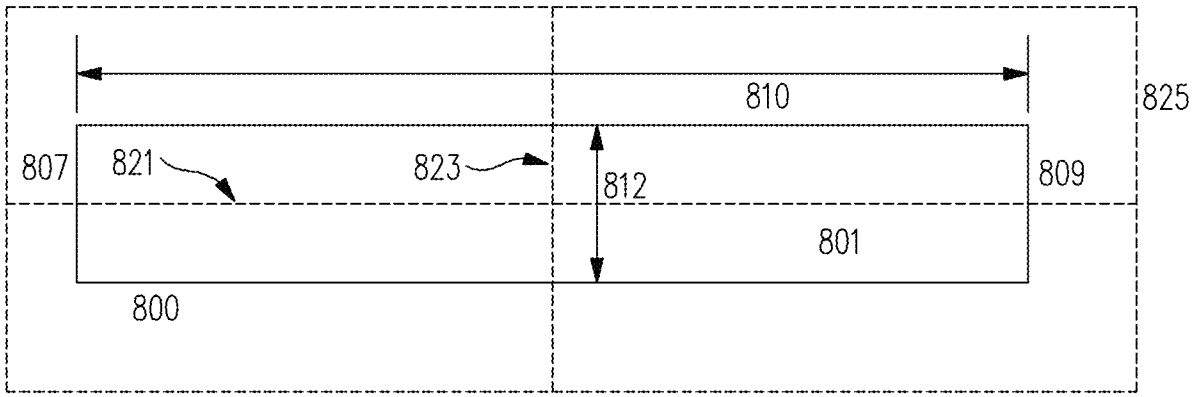
FIG. 8G shows a line drawing of a top view of a first surface of a reference device support platform of FIG. 8C in accordance with one embodiment including a top view of reference device support platform first surface length axis and reference device support platform first surface width axis which define reference device support platform first surface plane in which the reference device support platform first surface lies.

FIG. 8G shows a line drawing of a top view of a reference device support platform first surface 801 of FIG. 8CD in accordance with one embodiment. Also shown in FIG. 8G are top view of reference device support platform first surface length axis 821 and reference device support platform first surface width axis 823 which define reference device support platform first surface plane 825 in which the reference device support platform first surface 801 lies.

In some embodiments, reference device support platform 800 is made of a metallic material. In some embodiments, reference device support platform 800 includes magnetic material and/or magnets positioned in only some areas of the reference device support platform 800, such as attachment portion 815. In various embodiments, reference device support platform 800 is made of any material, or combination of materials desired and as described herein, and/or known in the art at the time of filing, and/or as becomes known after the time of filing that can be used to form a relatively ridged reference device support platform.

Referring to FIGS. 1, 2, 3A, 3B, 4, 5, and 8A through 8G, as noted above, in one embodiment, the reference device support platform first surface 801 lies in a reference device support platform first surface plane 825. In one embodiment, the reference device support platform 800 is removably attached to a rifle 102 such that the reference device support platform first surface plane 825 is perpendicular to centerline of the rifle's receiver/action extending down common vertical line 300 from the top of the rifle receiver to the bottom of the rifle receiver. In one embodiment, the reference device support platform 800 is removably attached to a rifle 102 such that the reference device support platform first surface plane 825 parallel to the rifle bore's longitudinal centerline 211. Consequently, when reference device support platform 800 is removably attached as disclosed, the reference device support platform first surface 801 is parallel to the rifle's horizontal bore center line 223 and perpendicular to the rifle's vertical bore center line 221.

As discussed in more detail below, in some embodiments, reference device support platform 800 is made of a magnetic material or includes magnetic material and/or magnets positioned in only some areas of the reference device support platform 800, such as reference device support platform first or attachment end 807. In these embodiments, the reference device support platform 800 is removably attached to the rifle 102 by magnetic forces by attaching the reference device support platform 800 magnetic portions to metallic surfaces of the firearm's action or scope mounts, or any other metallic part of the rifle that is flat, or provides for flat attachment, and whose flat surface, or surfaces are parallel to the rifle's horizontal bore center line 223 and perpendicular to the rifle's vertical bore center line 221. In some embodiments, the magnetic material and/or magnets positioned in only some areas of the reference device support platform 800 can be coated with plastic or any other material to prevent magnetic material and/or magnets positioned in only some areas of the reference device support platform 800 from scratching the rifle 102.

As a specific example, in one embodiment, the reference device support platform 800 is removably attached to the rifle 102 by magnetically attaching the reference device support platform 800 magnetic portions to the flat surface of a scope mounting system mechanism that includes a flat upper surface that is in a plane parallel to the rifle bore horizontal axis 223 and perpendicular to the rifle bore vertical axis 221. In this way, reference device support platform first surface plane 825 and reference device support platform first surface 801 are also parallel to the rifle bore horizontal axis 223 and perpendicular to the rifle bore vertical axis 221.

As noted, in one embodiment, at least part of the reference device support platform 800 is magnetic. In one embodiment, this magnetic portion is used to removably attach the reference device support platform 800 to the rifle by magnetic forces between the magnetic portion of the reference device support platform 800 and the metallic flat upper surface 106 of the scope mounting system mechanism. The result is that the reference device support platform 800 is attached to the firearm such that the reference device support platform first surface plane 825 is perpendicular to a centerline of the rifle's receiver extending along common vertical line 300 down from the top of the rifle receiver to the bottom of the rifle receiver and parallel to the rifle bore's longitudinal centerline 211. Consequently, when the reference device support platform 800 is removably attached as disclosed, the reference device support platform first surface plane 825, and reference device support platform first surface 801, is parallel to the rifle's horizontal bore center line 223 and perpendicular to the rifle's vertical bore center line 221.

In other embodiments discussed in more detail below, the reference device support platform 800 is removably attached to the rifle using various other parts of the rifle, such as the action and/or bolt guide rails, that allow the reference device support platform 800 to be removably attached to a rifle 102 such that the reference device support platform first surface plane 825, and reference device support platform first surface 801, is parallel to the rifle's horizontal bore center line 223 and perpendicular to the rifle's vertical bore center line 221.

In other embodiments discussed in more detail below, the reference device support platform 800 is removably attached to the rifle 102 using mechanical mechanisms and various attachment systems, such as a picatinny or weaver rail system, that allows the reference device support platform 800 to be removably attached to a rifle 102 such that the reference device support platform first surface plane 825, and reference device support platform first surface 801, is parallel to the rifle's horizontal bore center line 223 and perpendicular to the rifles receiver centerline 222 and vertical bore center line 221.

Figure 2:
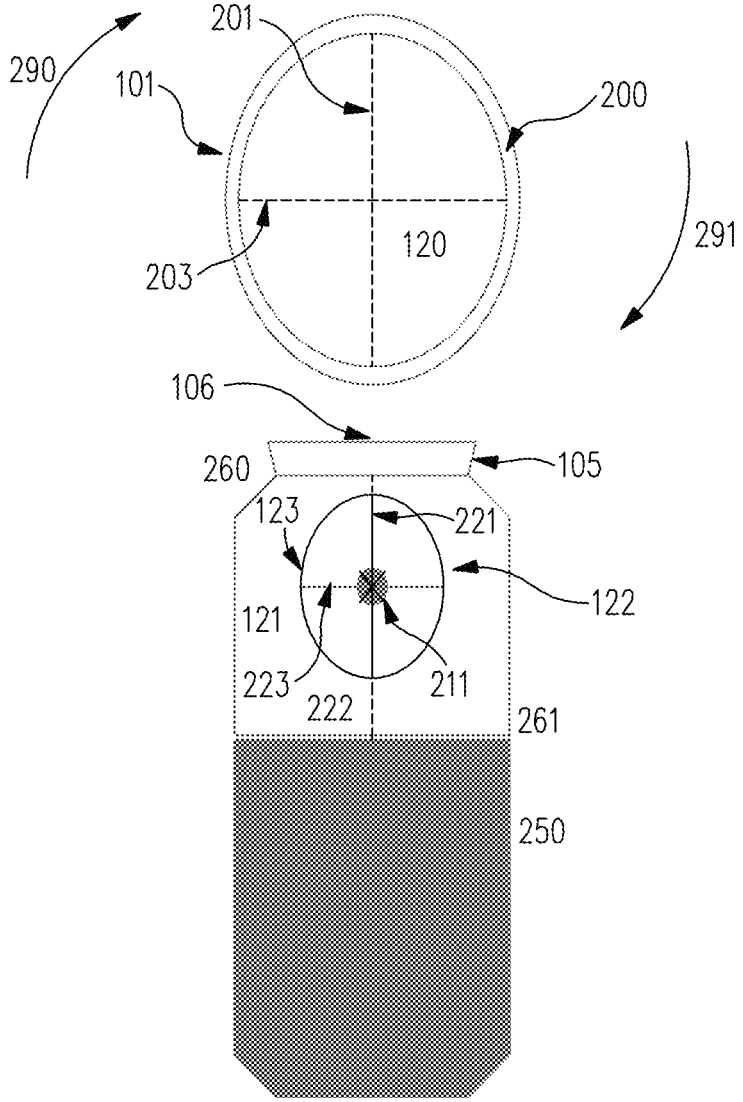
FIG. 2 shows a simplified typical scope reticle view, as viewed in cutaway, cutaway action, cutaway rifle barrel, and buttstock as viewed from a viewing end of the scope and with desired scope leveling.
Figure 3A:
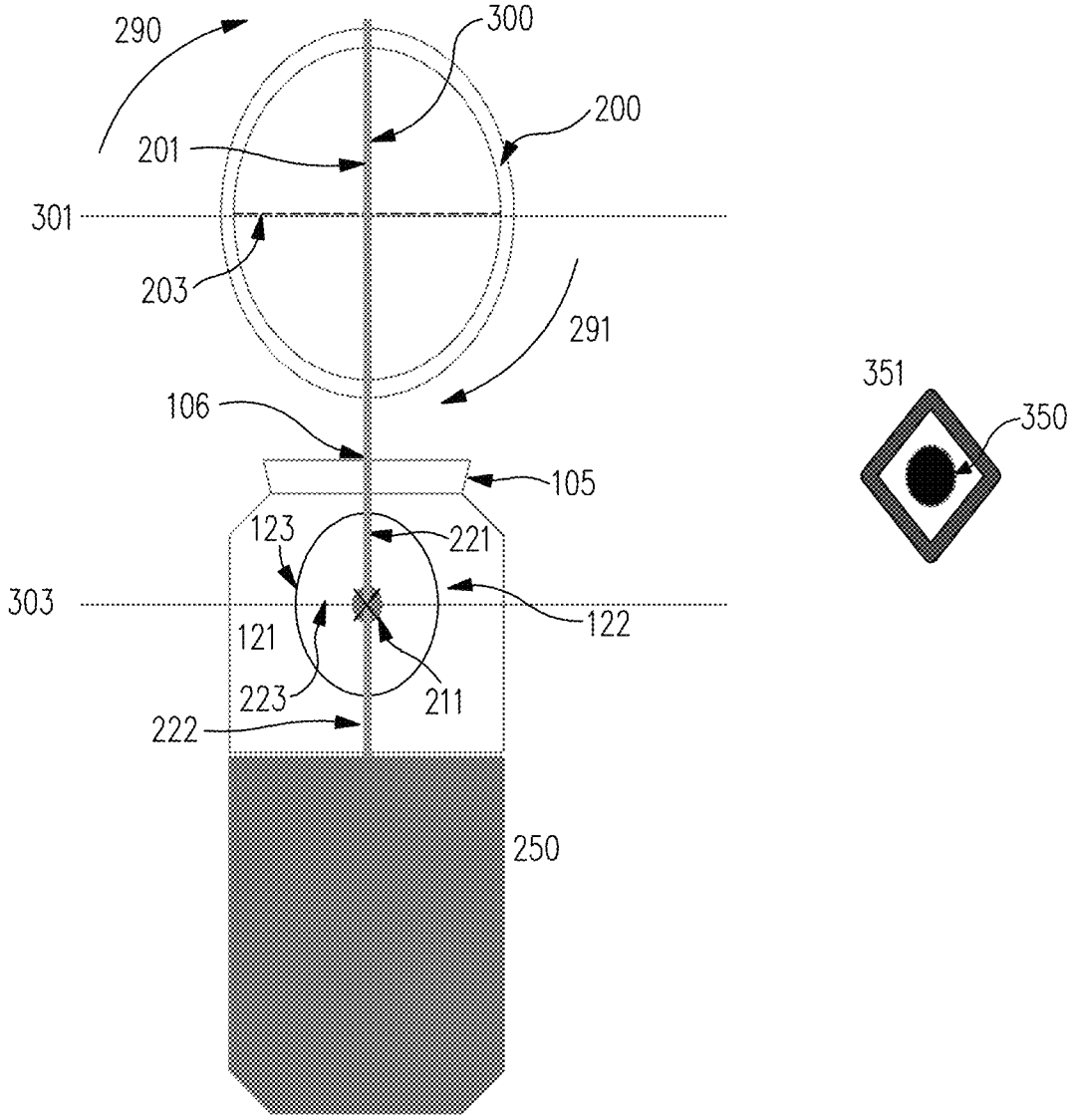
FIG. 3A shows a simplified typical scope reticle view, as viewed in cutaway, cutaway action, cutaway rifle barrel, and buttstock as viewed from a viewing end of the scope and with desired scope leveling as well as the shot placement associated with this proper scope configuration.
Figure 3B:
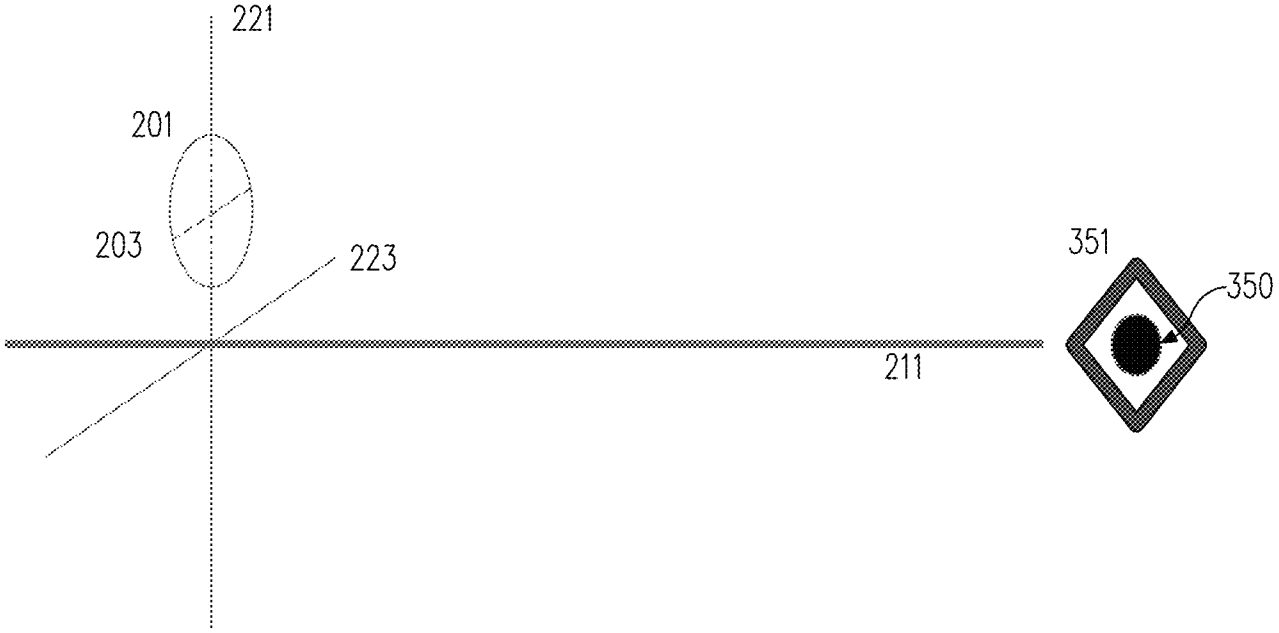
FIG. 3B shows a line diagram of the ideal relationship between a longitudinal rifle bore center line, a vertical bore center line and vertical scope stadia line, and a horizontal bore center line and horizontal scope stadia line.
Figure 4:
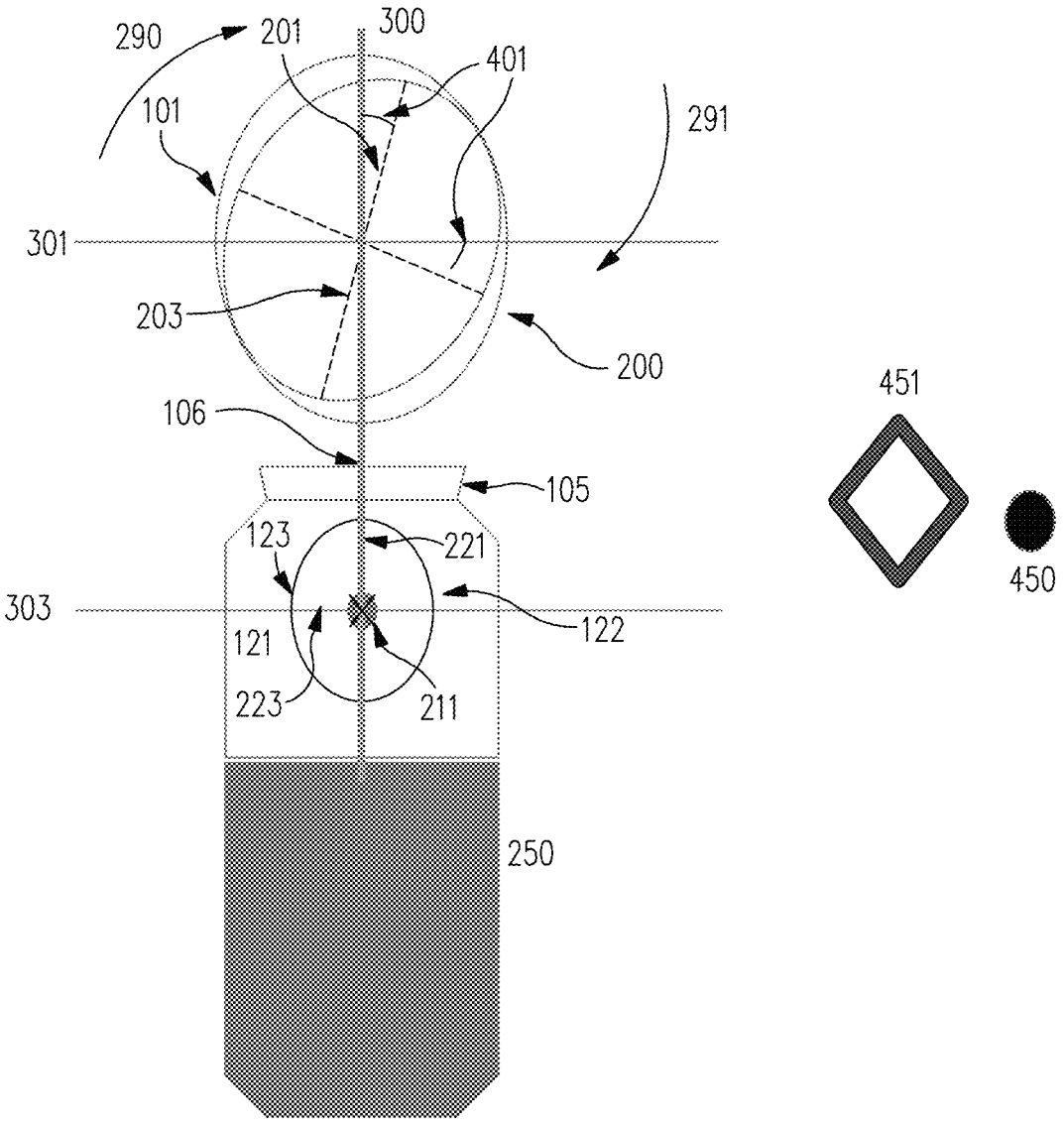
FIG. 4 shows a simplified typical scope reticle view, as viewed in cutaway, cutaway action, cutaway rifle barrel, and cutaway buttstock as viewed from a viewing end of the scope and with an incorrectly clockwise canted scope as well as the shot placement associated with this incorrectly clockwise canted scope.
Figure 5:
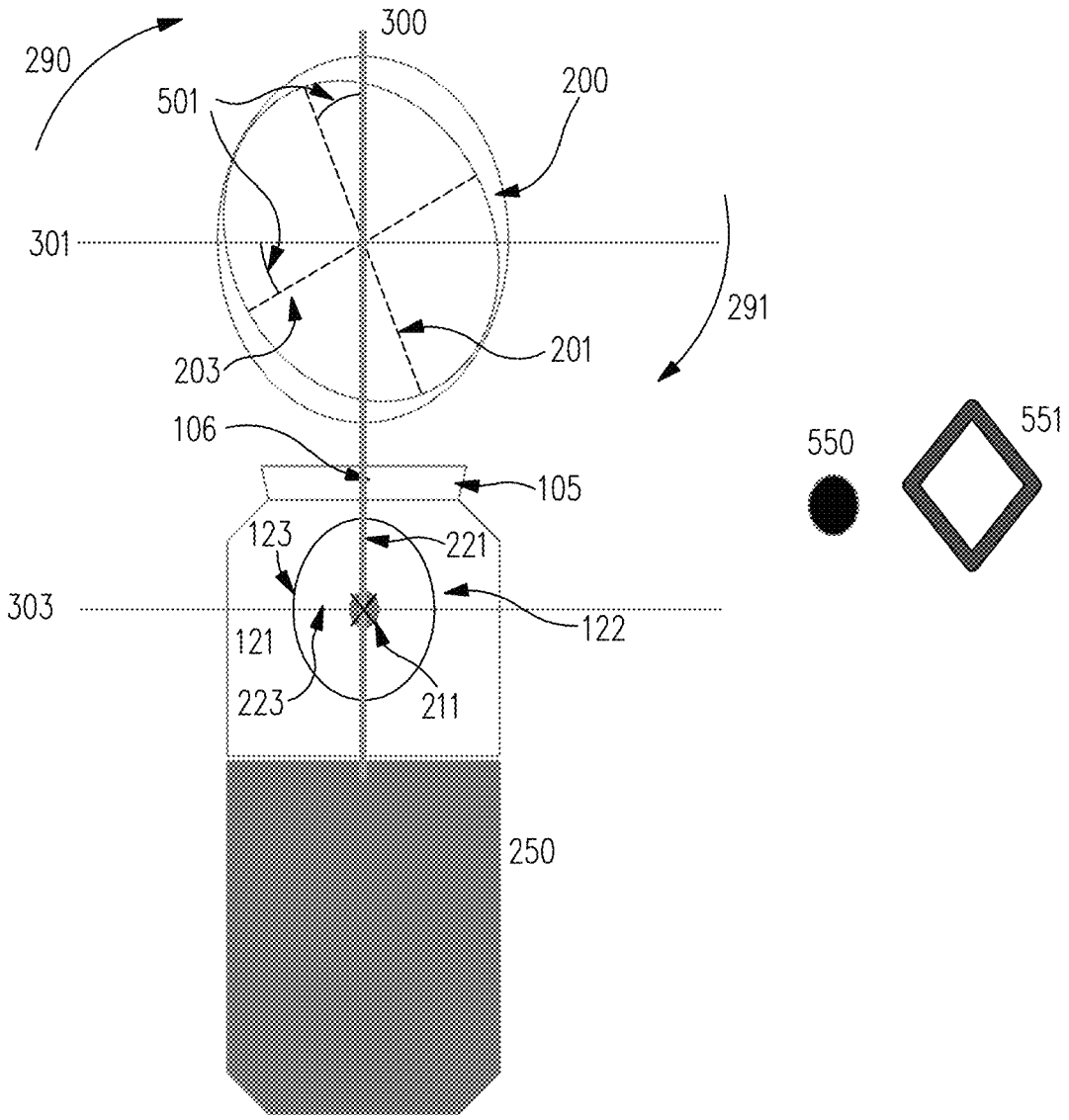
FIG. 5 shows a simplified typical scope reticle view, as viewed in cutaway, cutaway action, cutaway rifle barrel, and cutaway buttstock as viewed from a viewing end of the scope and with an incorrectly counterclockwise canted scope as well as the shot placement associated with this incorrectly counterclockwise canted scope.
Figure 6:
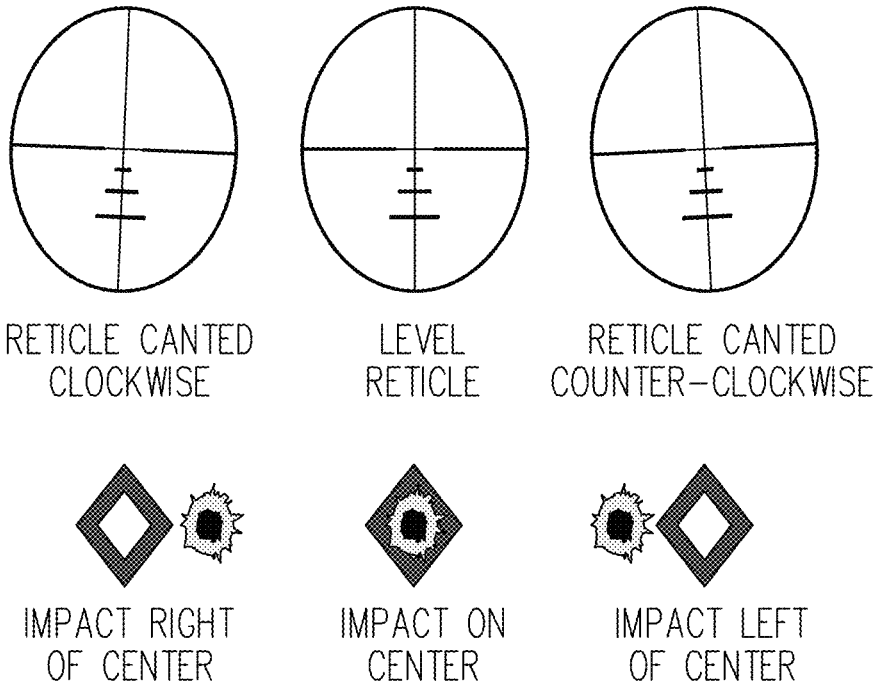
FIG. 6 is a diagram summarizing the effects of the introduction of scope canting as set forth in FIGS. 2, 3A, 3B, 4, and 5.
Figure 7:
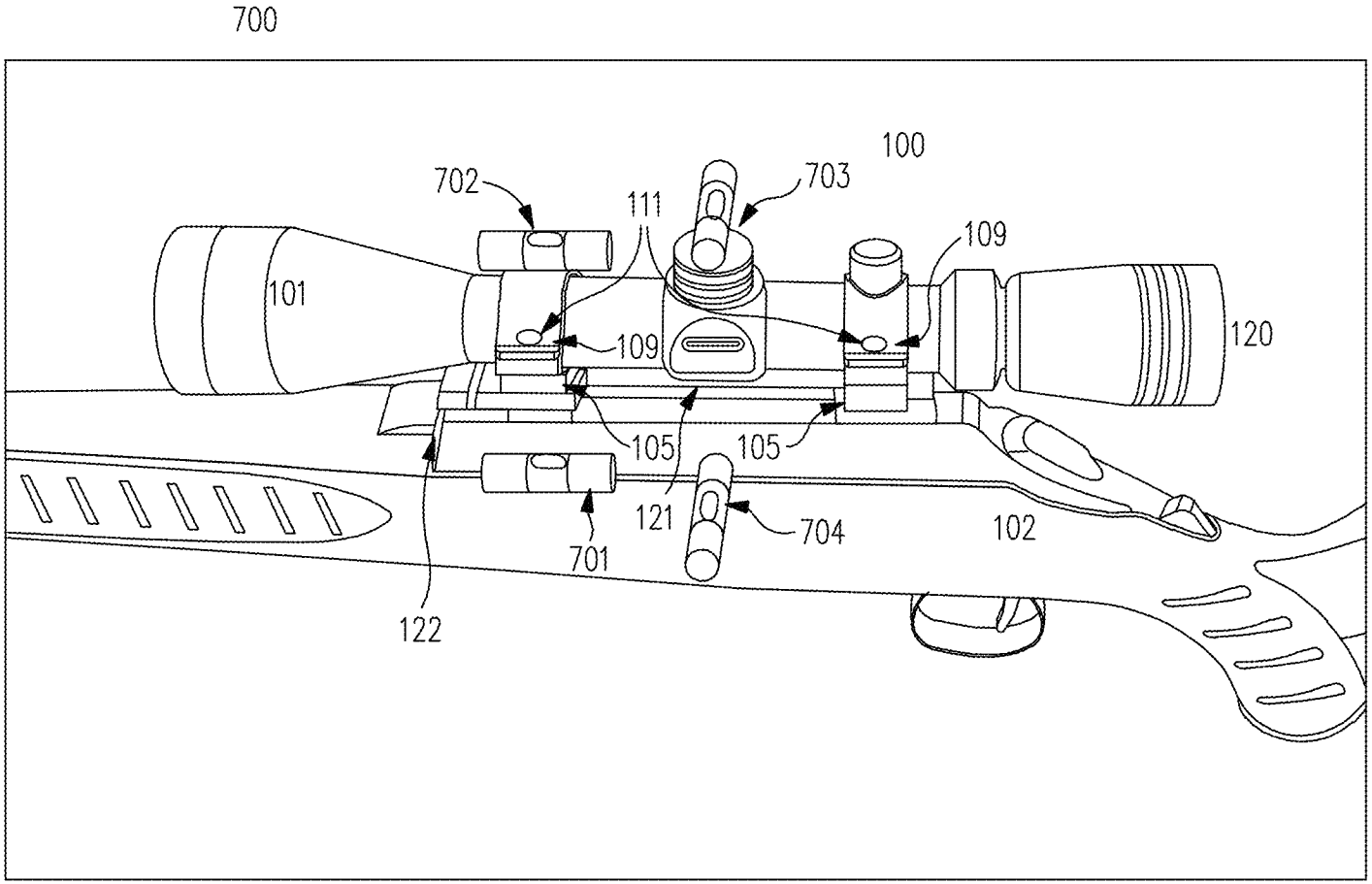
FIG. 7 (PRIOR ART)
FIG. 7 shows one example of prior art scope leveling system.
Figure 9A:
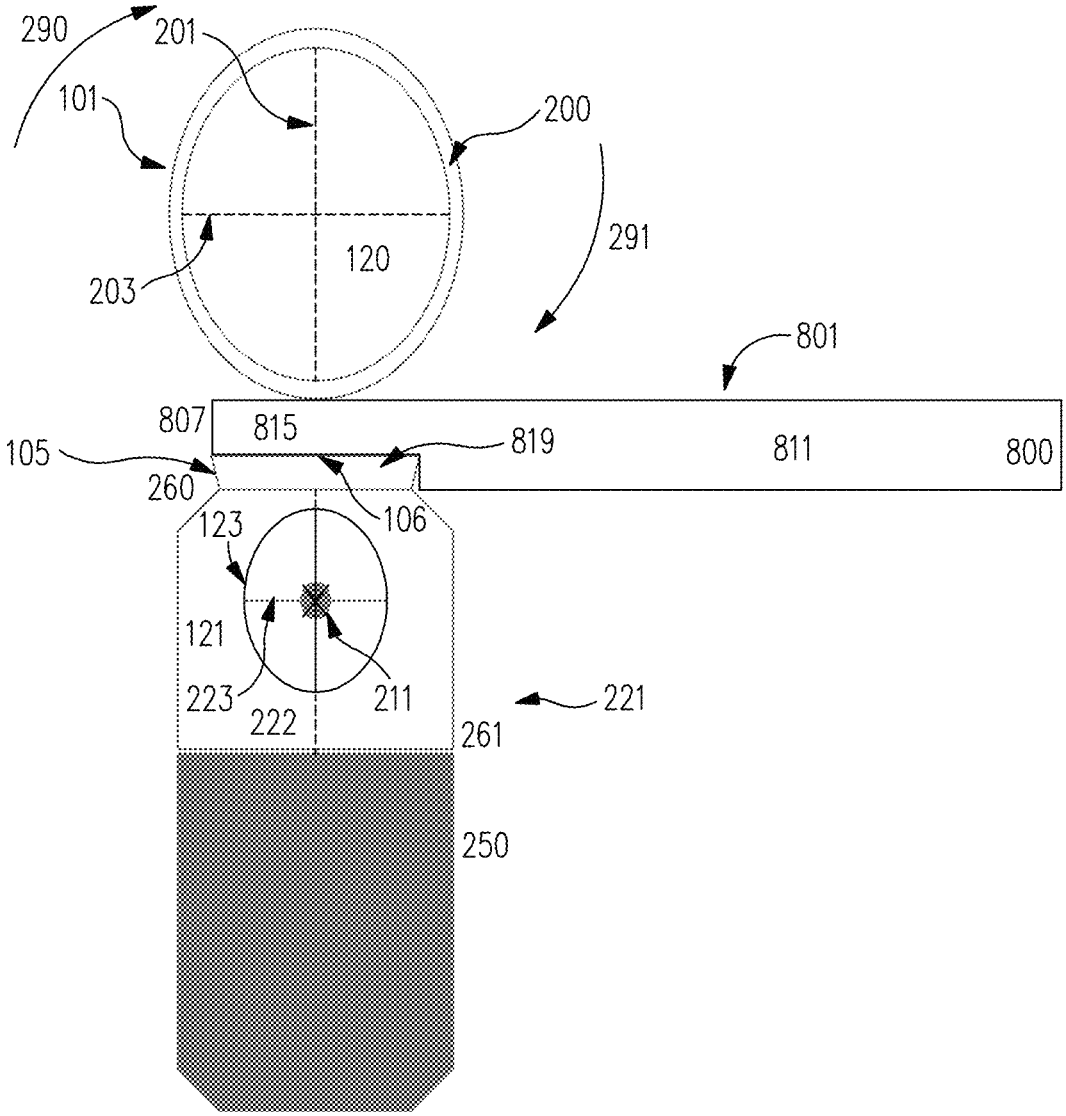
FIG. 9A shows a simplified typical scope reticle view in cutaway, cutaway action, cutaway rifle barrel, and cutaway buttstock as viewed from a viewing end of the scope and with desired scope leveling with the reference device support platform of FIGS. 8A through 8G attached in accordance with one embodiment.

FIG. 9A shows a simplified typical scope reticle view in cutaway, cutaway action, cutaway rifle barrel, and cutaway buttstock similar to that shown in FIG. 2 and as viewed from a viewing end 120 of the scope 101. However, FIG. 9A includes the reference device support platform of FIGS. 8A through 8G attached in accordance with one embodiment.

Referring to FIG. 1 and FIG. 9A together, FIG. 9A includes a simplified block diagram of rifle receiver 121 as would be viewed in cutaway from end 120, mounting mechanism 105, in this example a mounting mechanism 105 with a machined flat upper surface 106, as would be viewed in cutaway from end 120, rifle barrel receiver end 122 of rifle barrel 123 as would be viewed in cutaway from end 120, and a simplified representation of a rifle body buttstock 250, in cutaway. FIG. 9A also includes reticle 200 with vertical stadia line 201 and horizontal stadia line 203, referred to collectively as reticle stadia lines.

In the simplified diagram of FIG. 9A, the longitudinal rifle bore center line 211 extends longitudinally into the page along the rifle's action and down the center of rifle barrel 123 from rifle barrel receiver end 122 to the rifle barrel muzzle end of the rifle 102 (not shown). Longitudinal rifle bore center line 211 is a theoretical component used to represent the longitudinal centerline of the circular bore of rifle barrel 123. The rifle barrel 123 extends longitudinally, along longitudinal rifle bore center line 211, into the page extending from rifle barrel receiver end 122. along the rifle's action, to the rifle barrel muzzle end (not shown). As shown in FIG. 9A, rifle receiver centerline 222 extending from the top of the receiver 260 to the bottom of the receiver 261 and is at ninety degrees to rifle receiver centerline 222 and longitudinal rifle bore center line 211.

Also shown in FIG. 9A are vertical and horizontal bore center lines 221 and 223. Vertical bore center line 221 is a theoretical component that runs vertically along rifle receiver centerline 222 through the middle of longitudinal rifle bore center line 211 and at ninety degrees to longitudinal rifle bore center line 211. Likewise, horizontal bore center line 223 is a theoretical component that runs horizontally through the middle of longitudinal rifle bore center line 211 and at ninety degrees to longitudinal rifle bore center line 211 and both rifle receiver centerline 222 and vertical bore center line 221.

As discussed above, in some embodiments, reference device support platform 800 is made of a magnetic material or includes magnetic material and/or magnets positioned in only some areas of the reference device support platform 800, such as attachment portion 815. In these embodiments, the reference device support platform 800 is removably attached to the rifle 102 by magnetic forces and by attaching the reference device support platform first or attachment end 807 of reference device support platform 800 to metallic surface flat surface 106.

Consequently, as seen in FIG. 9A, in one embodiment, reference device support platform first or attachment end 807 of reference device support platform 800 is attached to rifle 102 via attachment portion 815 and attachment notch 819 coming into contact with mounting point/mechanism 105 which, in the example of FIG. 9A, has a metallic flat surface 106 that fits into attachment notch 819. Of note, metallic flat surface 106 lies in a plane, not shown, that is parallel to horizontal bore center line 223 and perpendicular to rifle receiver centerline 222 and vertical bore center line 221. Consequently, as discussed below, when reference device support platform first or attachment end 807 of reference device support platform 800 is attached to rifle 102 via attachment to metallic flat surface 106, reference device support platform first surface 801 is also parallel to horizontal bore center line 223 and perpendicular to rifle receiver centerline 222 and vertical bore center line 221.

Various ways to attach reference device support platform 800 to rifle 102 are introduced above and discussed in more detail below. For the current discussion it is sufficient to assume that reference device support platform 800 is removably attached to rifle 102 using any of the methods discussed herein, and/or as known in the art at the time of filing, and/or as developed/become available after the time of filing, for removably attaching reference device support platform 800 to rifle 102.

However, in accordance with the disclosed embodiments, reference device support platform 800 is attached to rifle 102 such that the reference device support platform first surface plane 825, and therefore reference device support platform first surface 801, is parallel to the rifle's horizontal bore center line 223 and perpendicular to the rifle's vertical bore center line 221.

Figure 9B:
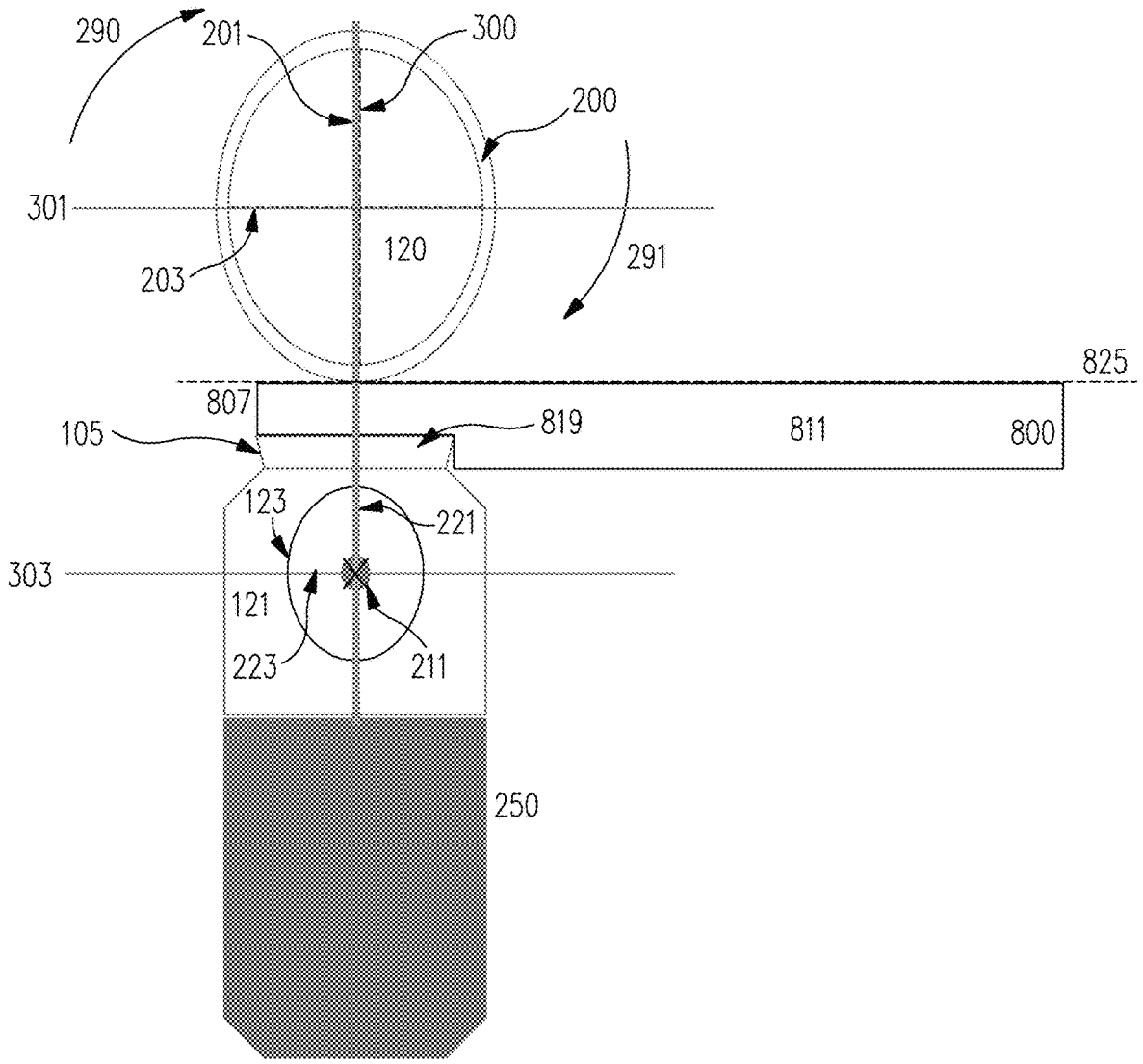
FIG. 9B shows a simplified typical scope reticle view in cutaway, cutaway action, cutaway rifle barrel, and cutaway buttstock as viewed from a viewing end of the scope and with desired scope leveling with the reference device support platform of FIGS. 8A through 8G attached and includes reference lines and proper orientation in accordance with one embodiment.

FIG. 9B shows the simplified typical scope reticle view in cutaway, cutaway action, cutaway rifle barrel, and cutaway buttstock with reference device support platform of FIGS. 8A through 8G attached of FIG. 9A. However, FIG. 9B also shows reference device support platform first surface plane 825.

As seen in FIGS. 9A and 9B, in accordance with the disclosed embodiments, reference device support platform 800 is attached to rifle 102 such that the reference device support platform first surface plane 825, and therefore reference device support platform first surface 801, is parallel to the rifle's horizontal bore center line 223 and perpendicular to the rifle's vertical bore center line 221.

As noted above, one way this orientation is achieved is by removably attaching reference device support platform first or attachment end 807 of reference device support platform 800 to rifle 102 via magnetic forces between a magnetic attachment portion 815 and attachment notch 819 and mounting point/mechanism 105 which, in the example of FIG. 9B, has a metallic flat surface 106 that fits into attachment notch 819. Since metallic flat surface 106 lies in a plane, not shown, that is parallel to horizontal bore center line 223 and perpendicular to rifle receiver centerline 222 and vertical bore center line 221, when reference device support platform first or attachment end 807 of reference device support platform 800 is attached to rifle 102 via attachment to metallic flat surface 106, reference device support platform first surface 801 that lies in reference device support platform first surface plane 825 is also parallel to horizontal bore center line 223 and perpendicular to rifle receiver centerline 222 and vertical bore center line 221.

Figure 9C:
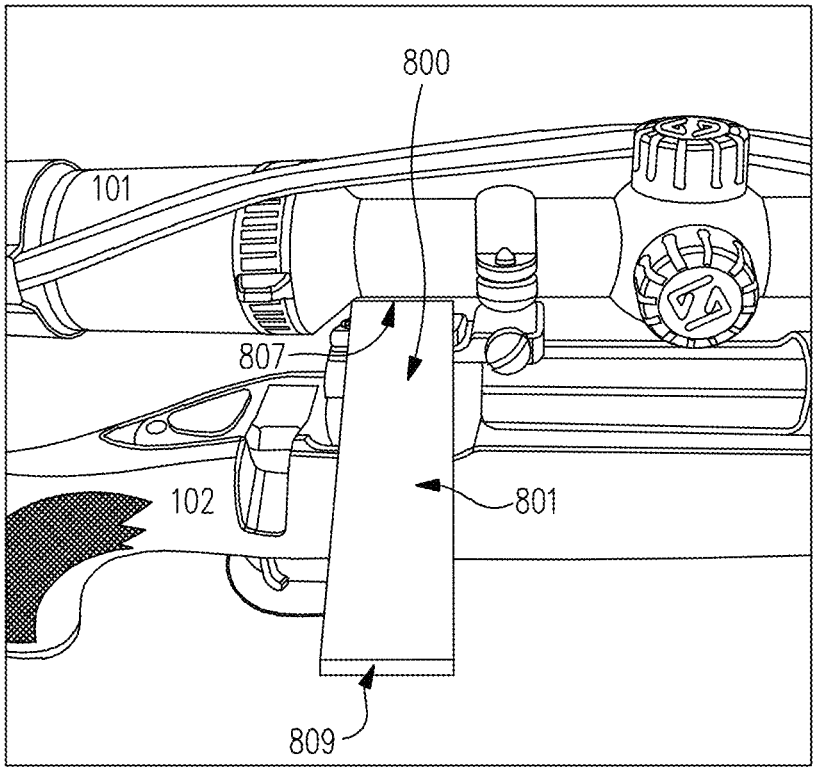
FIG. 9C is a photograph of one embodiment of a reference device support platform removably attached to a rifle and scope system.

FIG. 9C is a photograph of one embodiment of a reference device support platform 800 removably attached to a rifle and scope system using the system described above with respect to FIGS. 9A and 9B such that such that the reference device support platform first surface plane 825, and therefore reference device support platform first surface 801, is parallel to the rifle's horizontal bore center line 223 and perpendicular to the rifle's vertical bore center line 221. This configuration is discussed in more detail below with respect to FIGS. 14A through 14G.

Figure 9D:
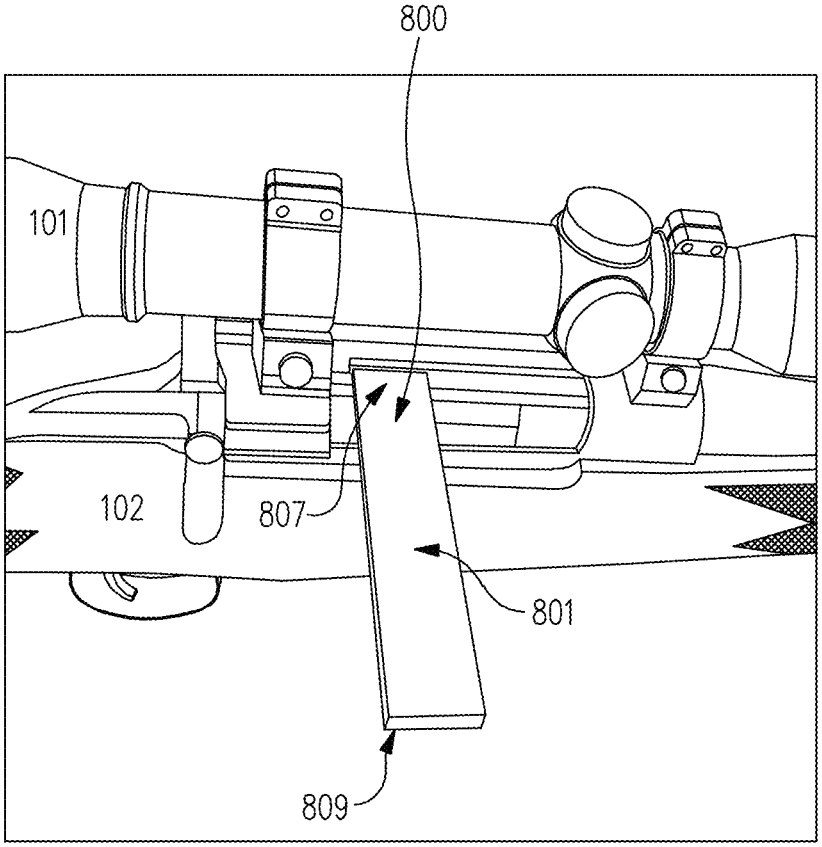
FIG. 9D is a photograph of another embodiment of a reference device support platform removably attached to a rifle and scope system.

FIG. 9D is a photograph of another embodiment of a reference device support platform 800 removably attached to a rifle and scope system on bolt rail top surfaces such that the reference device support platform first surface plane 825, and therefore reference device support platform first surface 801, is parallel to the rifle's horizontal bore center line 223 and perpendicular to the rifle's vertical bore center line 221. This configuration is discussed in more detail below with respect to FIGS. 15A through 15G.

In one embodiment, once the reference device support platform 800 is removably attached such that the reference device support platform first surface 801 is parallel to the rifle's horizontal bore center line 223 and perpendicular to the rifle's vertical bore center line 221, an alignment reference device, such as a laser leveling device, e.g., a laser projection device, can be placed on the reference device support platform first surface 801 and thereby be supported by the reference device support platform 800.

In various embodiments, alignment reference device 1000 can be a general-purpose laser-based alignment reference device such as those used in carpentry and construction. As discussed in more detail below, this type of alignment reference device uses one or more lasers and lenses to generate one or more reference lines. Typically, the reference lines generated are: vertical reference lines that run parallel to a vertical axis of the alignment reference device and perpendicular to a horizontal axis of the alignment reference device; and/or horizontal reference lines that run parallel to a horizontal axis of the alignment reference device and perpendicular to a vertical axis of the alignment reference device; and/or both vertical reference lines that run parallel to a vertical axis of the alignment reference device and perpendicular to a horizontal axis of the alignment reference device, and horizontal reference lines that run parallel to a horizontal axis of the alignment reference device and perpendicular to a vertical axis of the alignment reference device. In various embodiments, alignment reference device 1000 has adjustment mechanism that allow for the vertical adjustment of the horizontal reference lines generated and/or the horizontal adjustment of the vertical reference lines to accommodate any offset of the alignment reference device 1000 from the rifle stadia lines.

Laser-based alignment reference devices are well known in the construction and carpentry arts and numerous types and brands are readily available. In addition, unlike prior art leveling system components, general purpose laser-based alignment reference devices are relatively inexpensive, sturdy, and various laser-based alignment reference devices are designed to generate reference lines of various colors.

The Inventor realized that advances in general purpose laser-based alignment reference devices have made these devices relatively inexpensive and readily available. However, prior to the disclosed embodiments, the general-purpose laser-based alignment reference devices were not well suited for use with scope leveling because, absent the disclosed embodiments, there was no way to provide removable reference device support platform that provided the necessary orientation of known good reference lines for use in scope leveling applications. Consequently, prior to the disclosed embodiments, these general-purpose laser-based alignment reference devices were not considered suitable for use in the scope leveling applications. As a result, prior to the disclosed embodiments, only very specialized, and expensive, laser systems were considered for scope leveling applications.

In addition, while red laser general-purpose laser-based alignment reference devices work extremely well for scope leveling applications, the Inventor has discovered that green laser general-purpose laser-based alignment reference devices work particularly well for scope leveling applications.

Figure 10A:
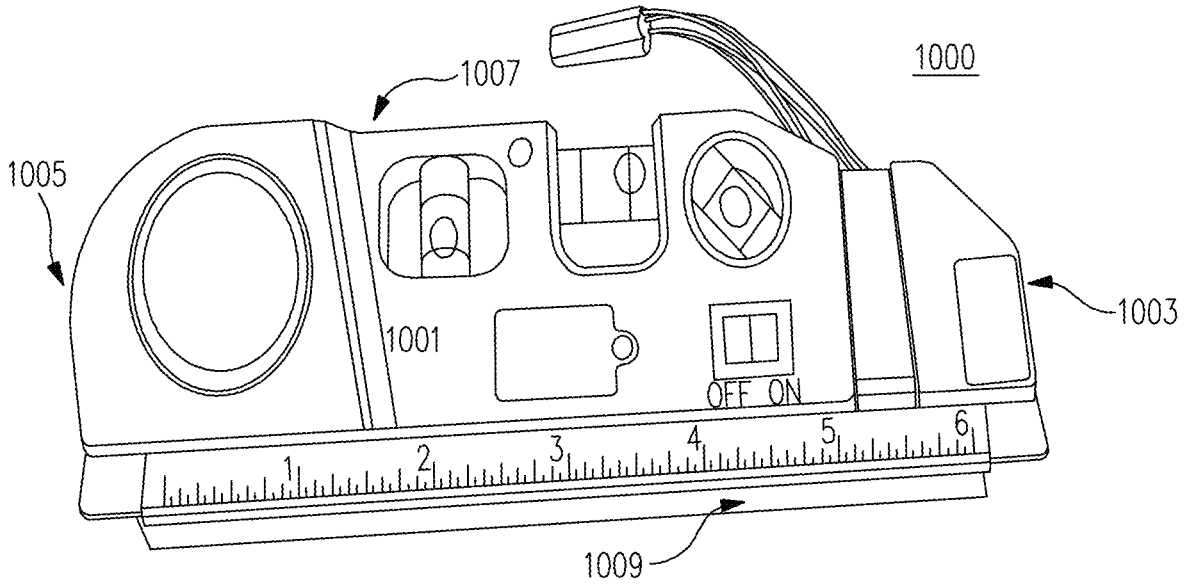
FIG. 10A shows a photograph of one example of an alignment reference device that can be used with the disclosed embodiments.

FIG. 10A shows a photograph of one example of an alignment reference device 1000 that can be used with the disclosed embodiments.

Figure 10B:
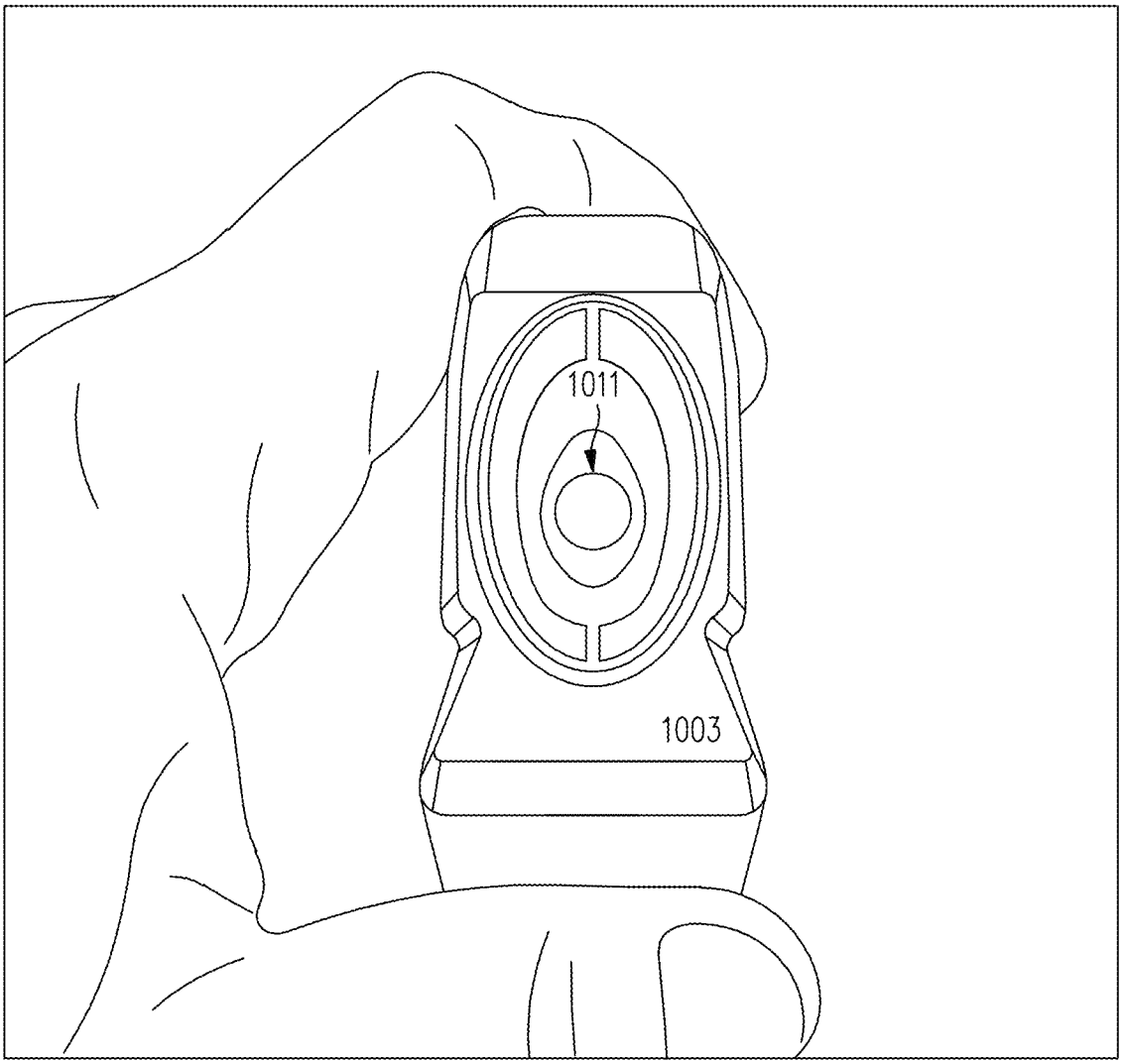
FIG. 10B shows a photograph of one example of a laser projection end of the alignment reference device of FIG. 10A that can be used with the disclosed embodiments.

FIG. 10B shows a photograph of one example of a laser projection end 1003 of the alignment reference device 1000 of FIG. 10A that can be used with the disclosed embodiments.

Figure 10E:
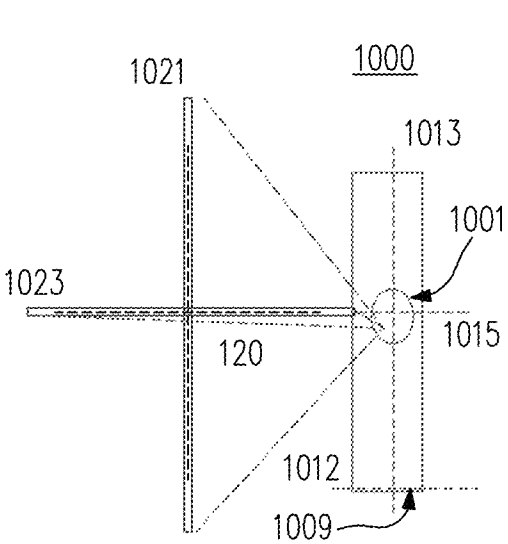
FIG. 10E shows a simplified line drawing of an alignment reference device generating both a vertical and a horizontal reference line that can be used with the disclosed embodiments.
Figure 10D:
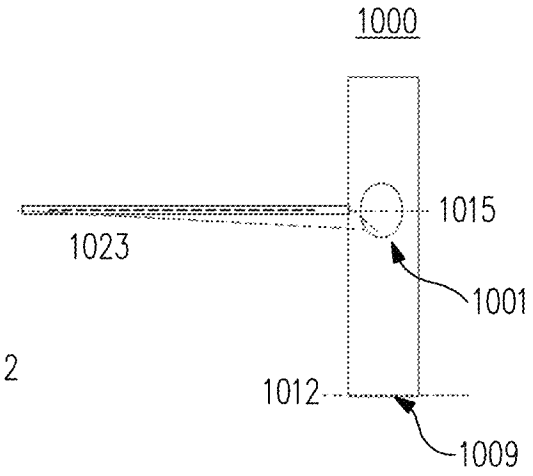
FIG. 10D shows a simplified line drawing of an alignment reference device generating a horizontal reference line that can be used with the disclosed embodiments.
Figure 10C:
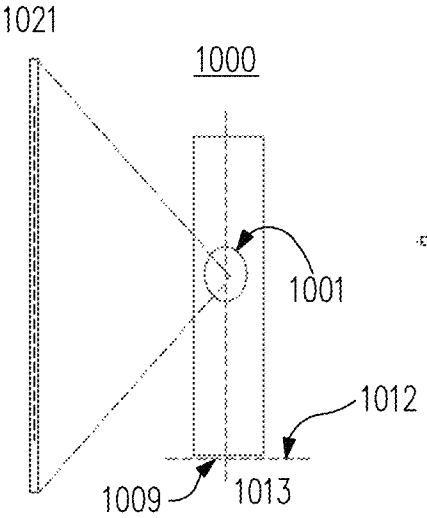
FIG. 10C shows a simplified line drawing of an alignment reference device generating a vertical reference line that can be used with the disclosed embodiments.

FIG. 10C shows a simplified line drawing of an alignment reference device, such as alignment reference device 1000 of FIG. 10A, generating a vertical reference 1021 line that can be used with the disclosed embodiments. Shown in simplified line drawing in FIG. 10B is alignment reference device 1000, laser and/or laser lens 1001, alignment reference device vertical axis 1013, alignment reference device bottom surface 1009, alignment reference device bottom surface plane 1012, and vertical reference line 1021 generated by alignment reference device 1000 emanating from laser and/or laser lens 1001 in parallel to alignment reference device vertical axis 1013. Of important note is the fact that vertical reference line 1021 is parallel to alignment reference device vertical axis 1013 of FIGS. 10A, 10B and 10D, and perpendicular to the alignment reference device horizontal axis 1015 of FIGS. 10A, 10C and 10D, alignment reference device bottom surface 1009, and alignment reference device bottom surface plane 1012.

FIG. 10D shows a simplified line drawing of an alignment reference device, such as alignment reference device 1000 of FIGS. 10A and 10B, generating a horizontal reference line 1023 that can be used with the disclosed embodiments. Shown in the simplified line drawing in FIG. 10C is alignment reference device 1000, laser and/or laser lens 1001, alignment reference device horizontal axis 1015, alignment reference device bottom surface 1009, alignment reference device bottom surface plane 1012, and horizontal reference line 1023 generated by alignment reference device 1000 emanating from laser and/or laser lens 1001 and parallel to alignment reference device horizontal axis 1015. Of important note is the fact that horizontal reference line 1023 is parallel to alignment reference device horizontal axis 1015 of FIGS. 10A, 10C and 10D, alignment reference device bottom surface 1009, and alignment reference device bottom surface plane 1012. In addition, horizontal reference line 1023 is perpendicular to the alignment reference device vertical axis 1013 of FIGS. 10A, 10C and 10D.

FIG. 10E shows a simplified line drawing of an alignment reference device, such as alignment reference device 1000 of FIGS. 10A, 10B, and 10C generating a vertical reference line 1021 and horizontal reference line 1023 that can be used with the disclosed embodiments. Shown in the simplified line drawing in FIG. 10D is alignment reference device 1000, laser and/or laser lens 1001, alignment reference device vertical axis 1013 and alignment reference device horizontal axis 1015, alignment reference device bottom surface 1009, alignment reference device bottom surface plane 1012, and vertical reference line 1021 and horizontal reference line 1023 generated by alignment reference device 1000 emanating from laser and/or laser lens 1001. Of important note is the fact that vertical reference line 1021 is parallel to alignment reference device vertical axis 1013 of FIGS. 10A, 10B and 10D, and perpendicular to the alignment reference device horizontal axis 1015 of FIGS. 10A, 10C and 10D. In addition, alignment reference device vertical axis 1013 is perpendicular to the alignment reference device horizontal axis 1015 of FIGS. 10A, 10C and 10D, alignment reference device bottom surface 1009, and alignment reference device bottom surface plane 1012. Likewise, horizontal reference line 1023 is parallel to alignment reference device horizontal axis 1015 of FIGS. 10A, 10C and 10D alignment reference device bottom surface 1009, and alignment reference device bottom surface plane 1012, and perpendicular to the alignment reference device vertical axis 1013 of FIGS. 10A, 10C and 10D.

In one embodiment, once the reference device support platform 800 is removably attached to the rifle 102 such that the reference device support platform first surface 801 is parallel to the rifle's horizontal bore center line 223 and perpendicular to the rifle's vertical bore center line 221, and an alignment reference device 1000 is obtained, the alignment reference device 1000 is removably attached to the reference device support platform 800 such that the alignment reference device bottom surface 1009 is supported by the reference device support platform first surface 801 and alignment reference device bottom surface plane 1012 is parallel to reference device support platform first surface plane 825.

As discussed herein, in some embodiments, the reference device support platform 800 is made of a magnetic material or at least includes magnetic material and/or magnets positioned in only some areas of the reference device support platform, such as first or attachment end 807 and/or second or support end 809. In these embodiments, the alignment reference device 1000 can be supported on the reference device support platform 800 via a magnetic force between the magnetic reference device support platform 800 and the metallic alignment reference device bottom surface.

In other embodiments, the alignment reference device 1000 can be supported on the reference device support platform 800 via one or more attachment holes and one or more mechanical attachment devices such as a clamp or screw mechanism and/or a mounting hole in the second or support end 809 of the reference device support platform 800. In other embodiments, the alignment reference device 1000 can be supported on the reference device support platform 800 via gravitational force by simply placing the alignment reference device 1000 on the reference device support first surface 801 of the reference device support platform 800. In various other embodiments, the alignment reference device 1000 can be supported on the reference device support platform 800 using any mechanism discussed herein, and/or as known in the art at the time of filing, and/or as developed after the time of filing for securing and alignment reference device to a support platform.

Figure 11A:
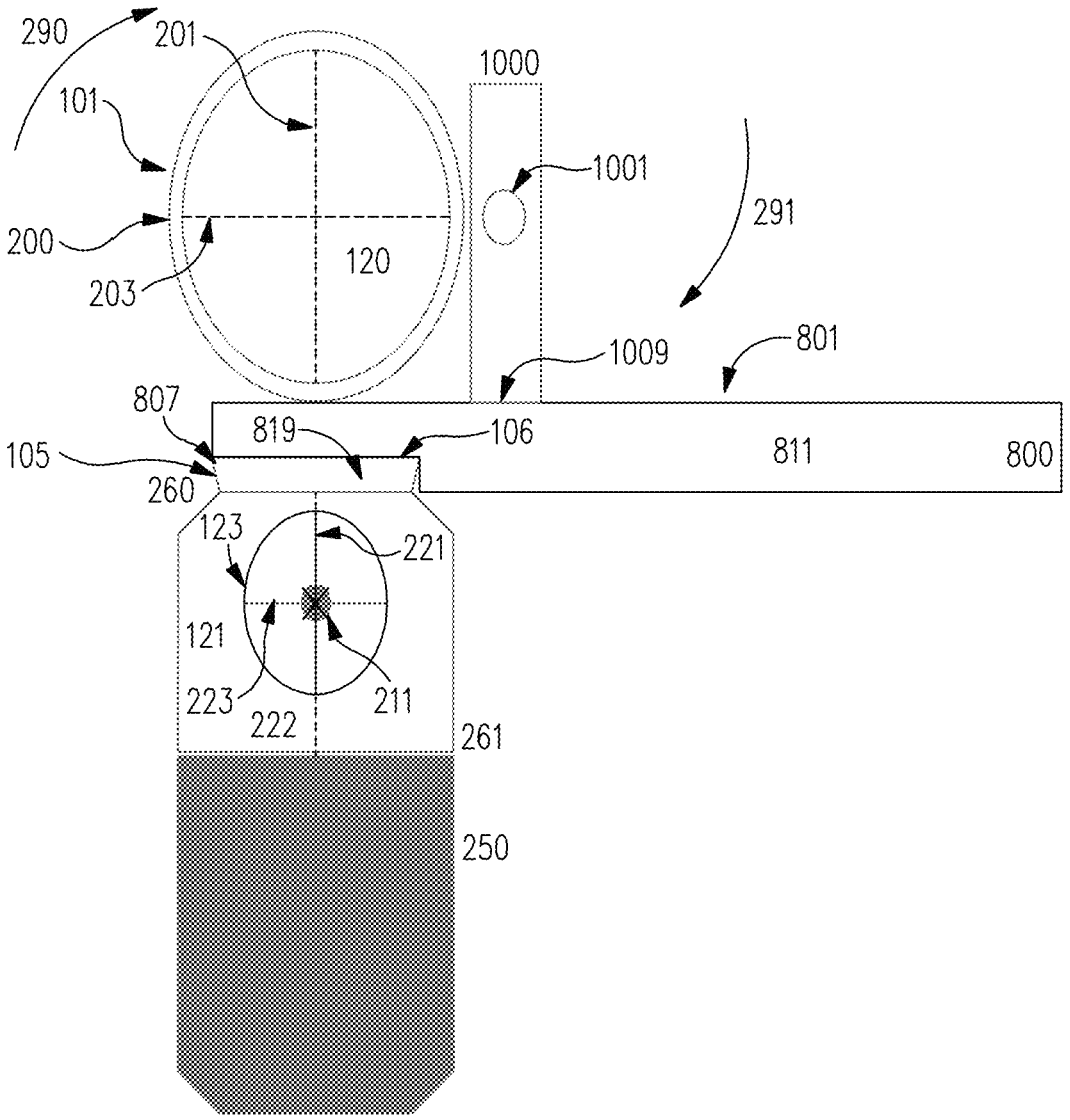
FIG. 11A shows a simplified typical scope reticle view in cutaway, cutaway action, cutaway rifle barrel, and cutaway buttstock as viewed from a viewing end of the scope and with desired scope leveling with the reference device support platform of FIGS. 8A through 8G attached and supporting an alignment reference device in accordance with one embodiment.

FIG. 11A shows a simplified typical scope reticle view in cutaway, cutaway action, cutaway rifle barrel, and cutaway buttstock as viewed from a viewing end of the scope and with desired scope leveling with the reference device support platform of FIGS. 8A through 8G attached and supporting an alignment reference device of FIGS. 10A, 10B, 10C, and 10D, in accordance with one embodiment.

Referring to FIG. 1, FIGS. 9A, 10A, 10B, 10C, and 10D, and 11A together, FIG. 11A includes a simplified block diagram of rifle receiver 121 as would be viewed in cutaway from end 120, mounting mechanism 105, in this example a mounting mechanism 105 with a machined flat upper surface 106, as would be viewed in cutaway from end 120, rifle barrel receiver end 122 of rifle barrel 123 as would be viewed in cutaway from end 120, and a simplified representation of a rifle body buttstock 250, in cutaway. FIG. 11A also includes reticle 200 with vertical stadia line 201 and horizontal stadia line 203, referred to collectively as reticle stadia lines.

In the simplified diagram of FIG. 11A, longitudinal rifle bore center line 211 extends longitudinally into the page down the center of rifle barrel 123 from rifle barrel receiver end 122 to the rifle barrel muzzle end of the rifle 102 (not shown). Longitudinal rifle bore center line 211 is a theoretical component used to represent the longitudinal centerline of the circular bore of rifle barrel 123. The rifle barrel 123 extends longitudinally, along longitudinal rifle bore center line 211, into the page extending from rifle barrel receiver end 122 to the rifle barrel muzzle end (not shown). As shown in FIG. 11A, rifle receiver centerline 222 extends from the top of the receiver 260 to the bottom of the receiver 261 and is at ninety degrees to rifle receiver centerline 222 and longitudinal rifle bore center line 211.

Also shown in FIG. 11A are vertical and horizontal bore center lines 221 and 223. Vertical bore center line 221 is a theoretical component that runs vertically along rifle receiver centerline 222 through the middle of longitudinal rifle bore center line 211 and at ninety degrees to longitudinal rifle bore center line 211. Likewise, horizontal bore center line 223 is a theoretical component that runs horizontally through the middle of longitudinal rifle bore center line 211 and at ninety degrees to longitudinal rifle bore center line 211 and both rifle receiver centerline 222 and vertical bore center line 221.

As discussed above, in some embodiments, reference device support platform 800 is made of a magnetic material or includes magnetic material and/or magnets positioned in only some areas of the reference device support platform 800, such as attachment portion 815. In these embodiments, the reference device support platform 800 is removably attached to the rifle 102 by magnetic forces and by attaching the reference device support platform first or attachment end 807 of reference device support platform 800 to metallic surface flat surface 106.

Consequently, as seen in FIG. 11A, in one embodiment, reference device support platform first or attachment end 807 of reference device support platform 800 is attached to rifle 102 via attachment portion 815 and attachment notch 819 coming into contact with mounting point/mechanism 105 which, in the example of FIG. 11A, has a metallic flat surface 106 that fits into attachment notch 819. Of note, metallic flat surface 106 lies in a plane, not shown, that is parallel to horizontal bore center line 223 and reference device support platform first surface plane 825. In addition, metallic flat surface 106 lies in a plane, not shown, that is perpendicular to rifle receiver centerline 222 and vertical bore center line 221. Consequently, when reference device support platform first or attachment end 807 of reference device support platform 800 is attached to rifle 102 via attachment to metallic flat surface 106, reference device support platform first surface 801 is also parallel to horizontal bore center line 223 and perpendicular to rifle receiver centerline 222 and vertical bore center line 221.

As also shown in FIG. 11A, in one embodiment, once the reference device support platform 800 is removably attached to the rifle 102 such that the reference device support platform first surface 801 is parallel to the rifle's horizontal bore center line 223 and perpendicular to the rifle's vertical bore center line 221, the alignment reference device is removably attached to the reference device support platform 800 such that the alignment reference device bottom surface 1009 is supported by the reference device support platform first surface 801 and alignment reference device bottom surface plane 1012 is parallel to reference device support platform first surface plane 825. In addition, alignment reference device bottom surface plane 1012 is parallel to alignment reference device horizontal axis 1015.

Figure 11B:
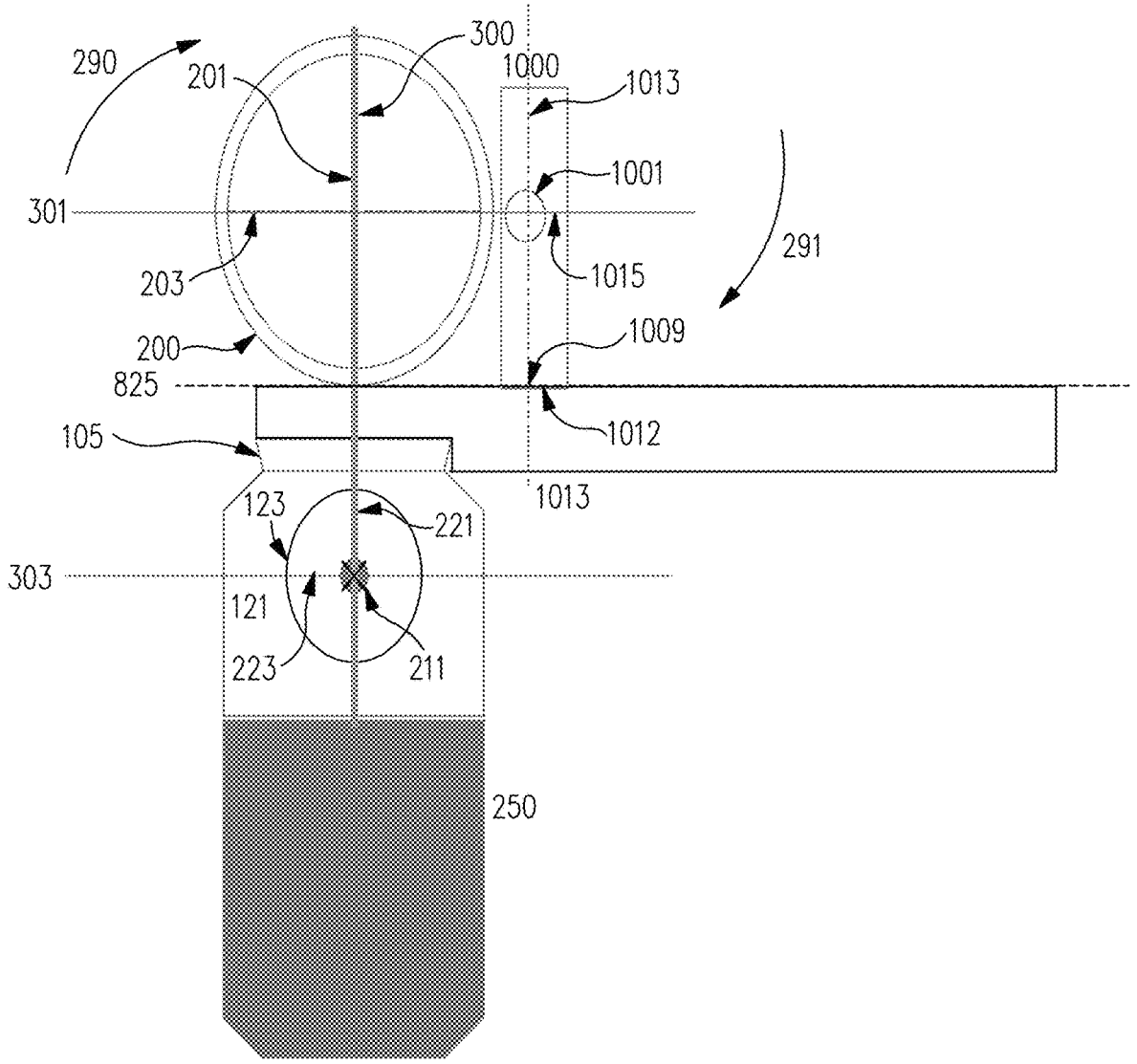
FIG. 11B shows a simplified typical scope reticle view in cutaway, cutaway action, cutaway rifle barrel, and cutaway buttstock as viewed from a viewing end of the scope and with desired scope leveling with the reference device support platform of FIGS. 8A through 8G attached and supporting an alignment reference device including reference and alignment reference lines in accordance with one embodiment.

FIG. 11B shows this relationship with various reference elements. In particular, the FIG. 11B is the simplified typical scope reticle view in cutaway, cutaway action, cutaway rifle barrel, and cutaway buttstock as viewed from a viewing end of the scope and with desired scope leveling with the reference device support platform of FIGS. 8A through 8G attached and supporting an alignment reference device of FIGS. 10A, 10B, 10C, and 10D, in accordance with one embodiment of FIG. 11A. FIG. 11B also shows reference device support platform first surface plane 825, alignment reference device vertical axis 1013, alignment reference device horizontal axis 1015, common vertical line 300 and various other alignment and orientation elements.

As seen in FIG. 11B, in accordance with the disclosed embodiments, reference device support platform 800 is attached to rifle 102 such that the reference device support platform first surface plane 825 in side view, and therefore reference device support platform first surface 801, is parallel to the rifle's horizontal bore center line 223 and perpendicular to the rifle's vertical bore center line 221.

In addition, when the reference device support platform 800 is so attached and the alignment reference device 1000 is placed on the reference device support platform first surface 801 as shown, alignment reference device bottom surface 1009 is in contact with reference device support platform first surface 801. Consequently, alignment reference device bottom surface plane 1012 is parallel to reference device support platform first surface plane 825. Since, by definition, the rifle's horizontal bore center line 223 is parallel to reference device support platform first surface plane 825 and reference device support platform first surface plane 825 is parallel to reference device bottom surface plane 1012 which, in turn, is parallel to alignment reference device horizontal axis 1015, it follows that alignment reference device horizontal axis 1015 is also parallel to horizontal bore center line 223.

Likewise, when the reference device support platform 800 is so attached and the alignment reference device 1000 is placed on the reference device support platform first surface 801 as shown, alignment reference device bottom surface 1009 is in contact with reference device support platform first surface 801. Consequently, alignment reference device bottom surface plane 1012 is parallel to reference device support platform first surface plane 825. Since, by definition, the rifle's vertical bore center line 221 is perpendicular to reference device support platform first surface plane 825 and reference device support platform first surface plane 825 is parallel to reference device bottom surface plane 1012 which, in turn, is parallel to alignment reference device horizontal axis 1015, it follows that alignment reference device vertical axis 1013 is also perpendicular to horizontal bore center line 223 and parallel to vertical bore center line 221.

Consequently, as shown above, when the reference device support platform 800 is so attached and the alignment reference device 1000 is placed on the reference device support platform first surface 801 as shown, alignment reference device vertical axis 1013 is perpendicular to horizontal bore center line 223 and parallel to vertical bore center line 221 and common vertical line 300. Likewise, as shown above, when the reference device support platform 800 is so attached and the alignment reference device 1000 is placed on the reference device support platform first surface 801 as shown, alignment reference device horizontal axis 1015 is parallel to horizontal bore center line 223 and perpendicular to vertical bore center line 221 and common vertical line 300. It follows that alignment reference device vertical axis 1013 and alignment reference device horizontal axis 1015 are known good lines for scope leveling in that alignment reference device vertical axis 1013 is parallel to vertical bore center line 221 and perpendicular to horizontal bore center line 223 and alignment reference device horizontal axis 1015 is perpendicular to vertical bore center line 221 and parallel to horizontal bore center line 223.

In addition, since a vertical reference line, such as vertical reference line 1021 generated by alignment reference device 1000 is parallel to alignment reference device vertical axis 1013, a vertical reference line, such as vertical reference line 1021 generated by alignment reference device 1000 is also parallel to vertical bore center line 221 and perpendicular to horizontal bore center line 223. Consequently, a vertical reference line, such as vertical reference line 1021 generated by alignment reference device 1000 is a known good vertical reference line for scope leveling.

Likewise, since a horizontal reference line, such as horizontal reference line 1023 generated by alignment reference device 1000 is parallel to alignment reference device horizontal axis 1015, a horizontal reference line, such as horizontal reference line 1023 generated by alignment reference device 1000 is perpendicular to vertical bore center line 221 and parallel to horizontal bore center line 223. Consequently, a horizontal reference line, such as horizontal reference line 1023 generated by alignment reference device 1000 is a known good horizontal reference line for scope leveling.

Figure 11C:
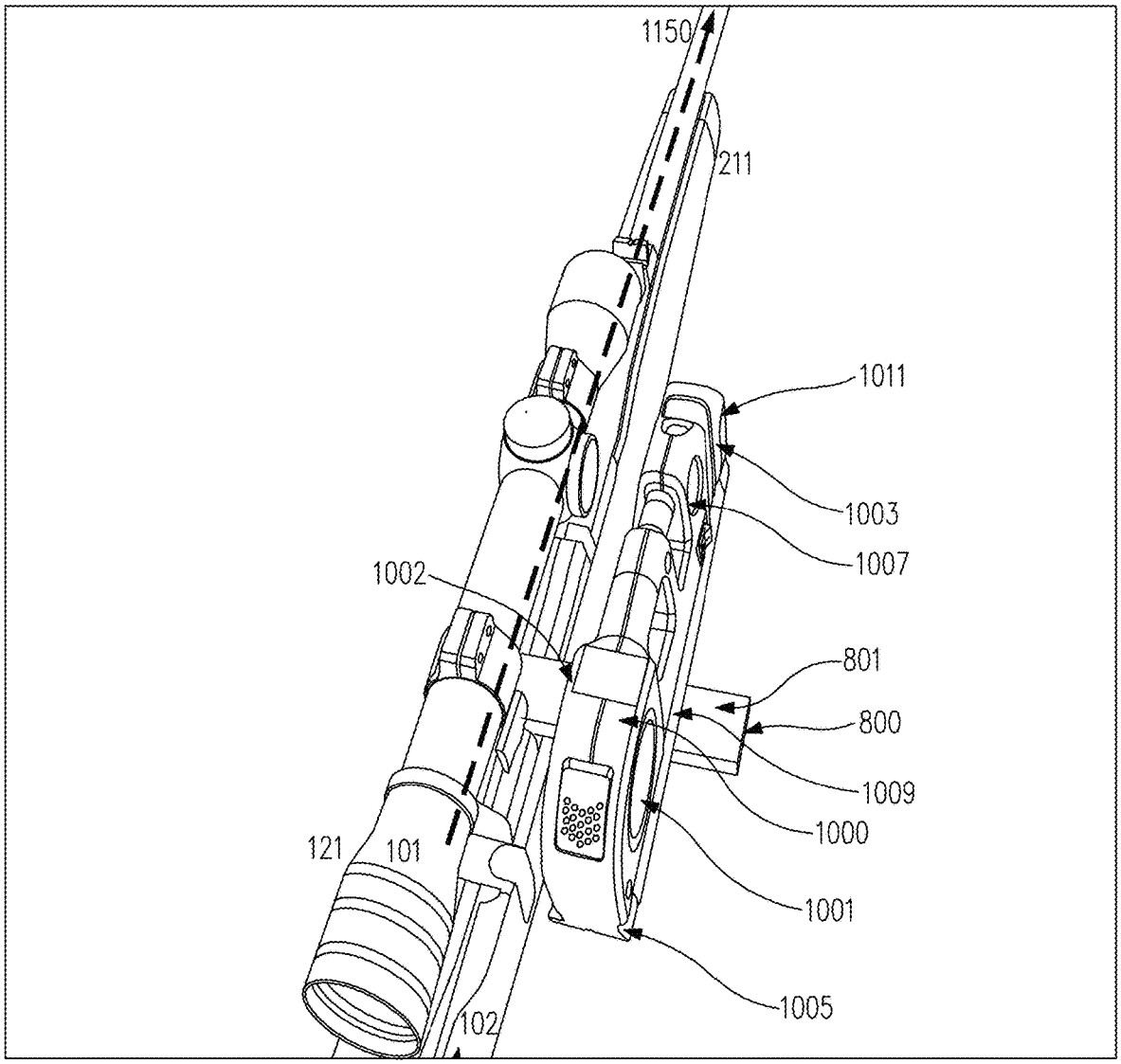
FIG. 11C is a photograph of one embodiment of a reference device support platform removably attached to a rifle and scope system and supporting an alignment reference device.

FIG. 11C is a photograph of one embodiment of a reference device support platform removably attached to a rifle and scope system and supporting an alignment reference device. Referring to FIGS. 10A, 11A, 11B, and 11C, together, shown in FIG. 11C is scope 101 attached to rifle 101; reference device support platform 800 removably attached to the rifle 102 such that the reference device support platform first surface 801 is parallel to the rifle's horizontal bore center line 223 and perpendicular to the rifle's vertical bore center line 221; and alignment reference device 1000 removably placed on reference device support platform 800 such that alignment reference device bottom surface 1009 is in contact with reference device support platform first surface 801.

Also shown in FIG. 11C is alignment reference device first side 1001, alignment reference device laser projection or front end 1003, alignment reference device back 1005, alignment reference device top 1007, alignment reference device laser 1011, alignment reference device vertical axis 1013, alignment device horizontal axis 1015, alignment reference device longitudinal axis 1017, and rifle bore center line 211 shown as a dashed line running from rifle barrel receiver end 122 to rifle barrel muzzle end 1150.

Figure 11D:
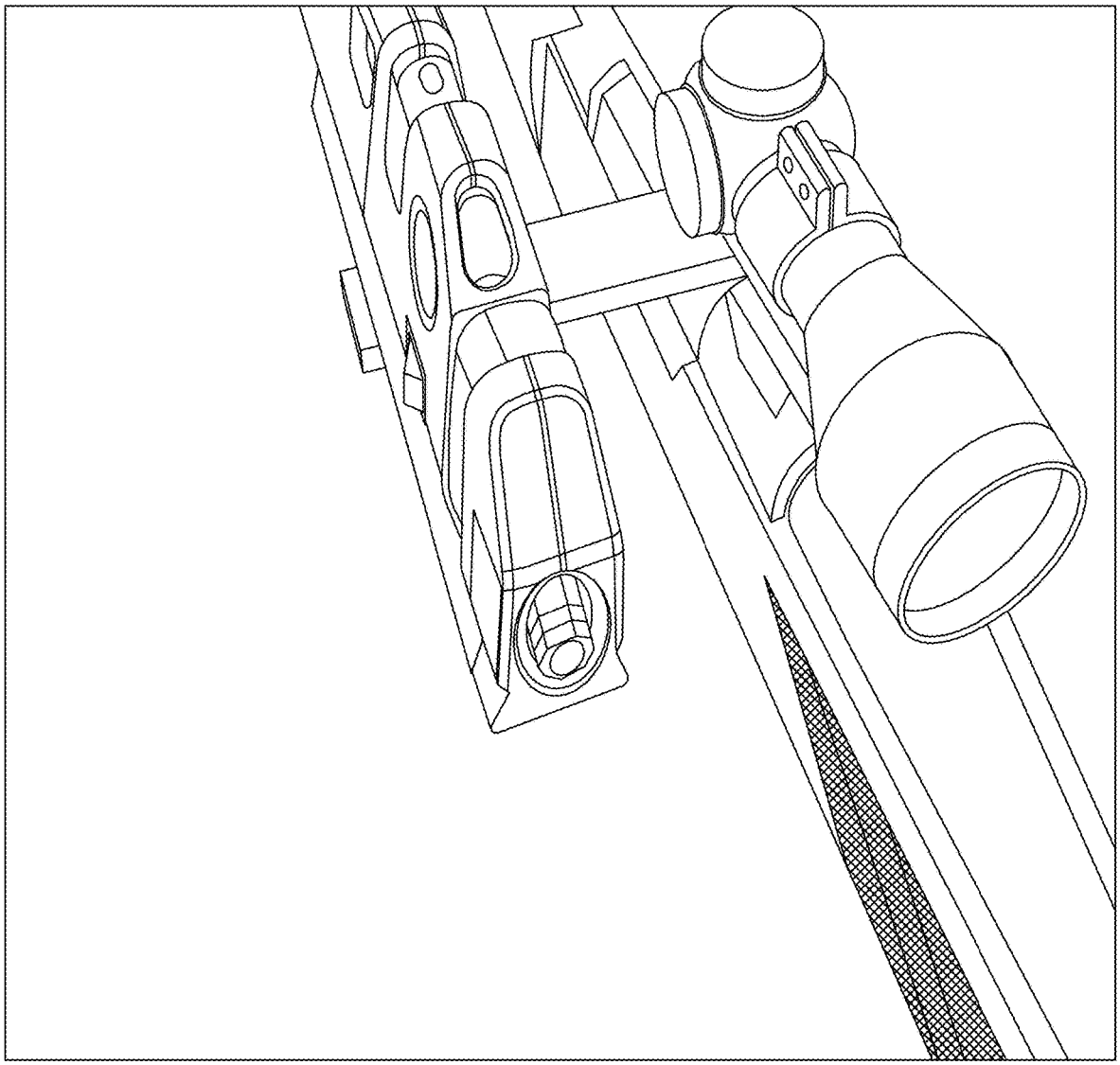
FIG. 11D is a photograph of one embodiment of a reference device support platform removably attached to a rifle and scope system and supporting an alignment reference device.

FIG. 11D is a photograph of one embodiment of a reference device support platform removably attached to a rifle and scope system and supporting an alignment reference device.

Figure 11E:
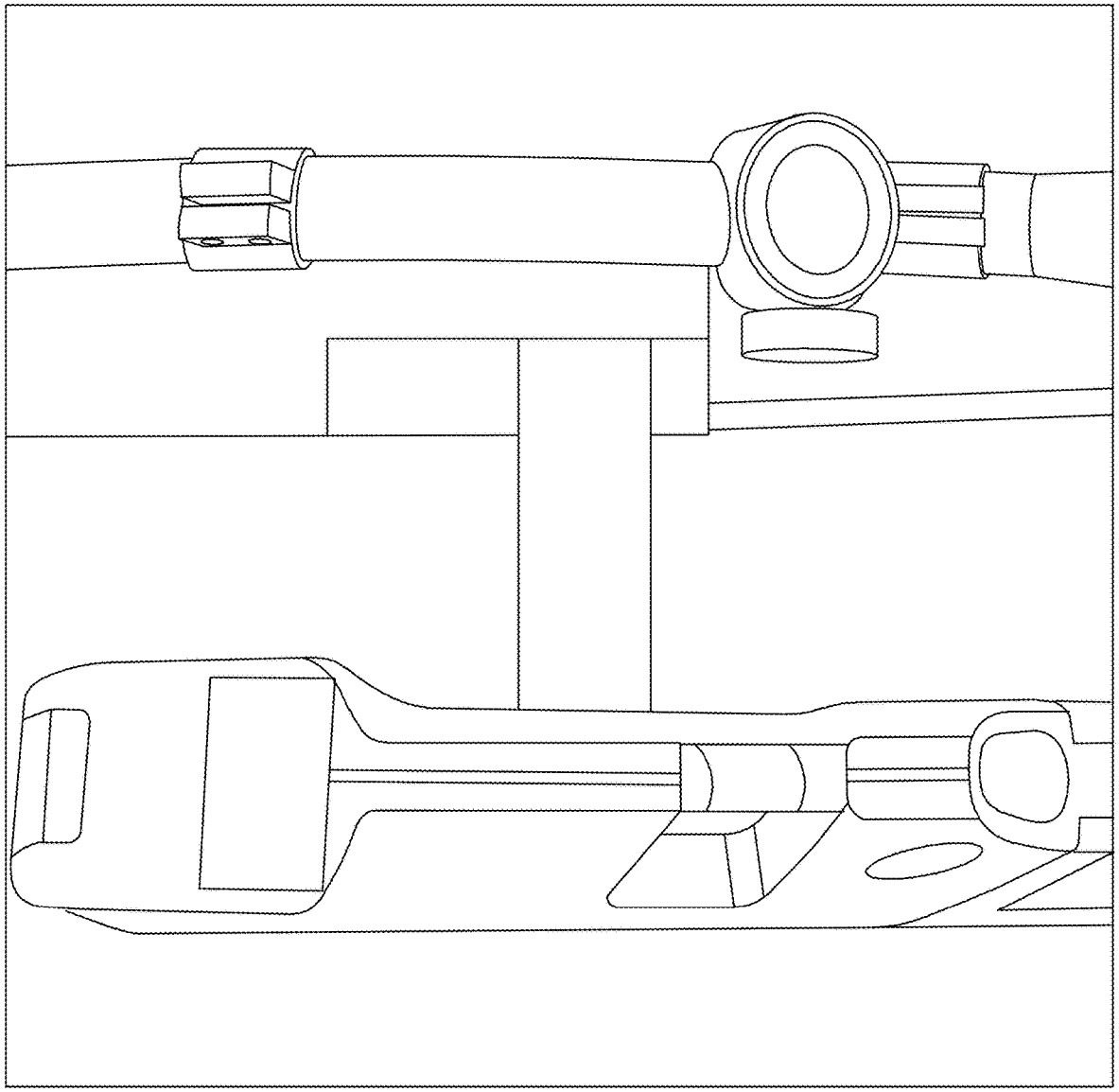
FIG. 11E is a photograph of one embodiment of a reference device support platform removably attached to a rifle and scope system and supporting an alignment reference device.

FIG. 11E is a photograph of one embodiment of a reference device support platform removably attached to a rifle and scope system and supporting an alignment reference device.

Figure 12A:
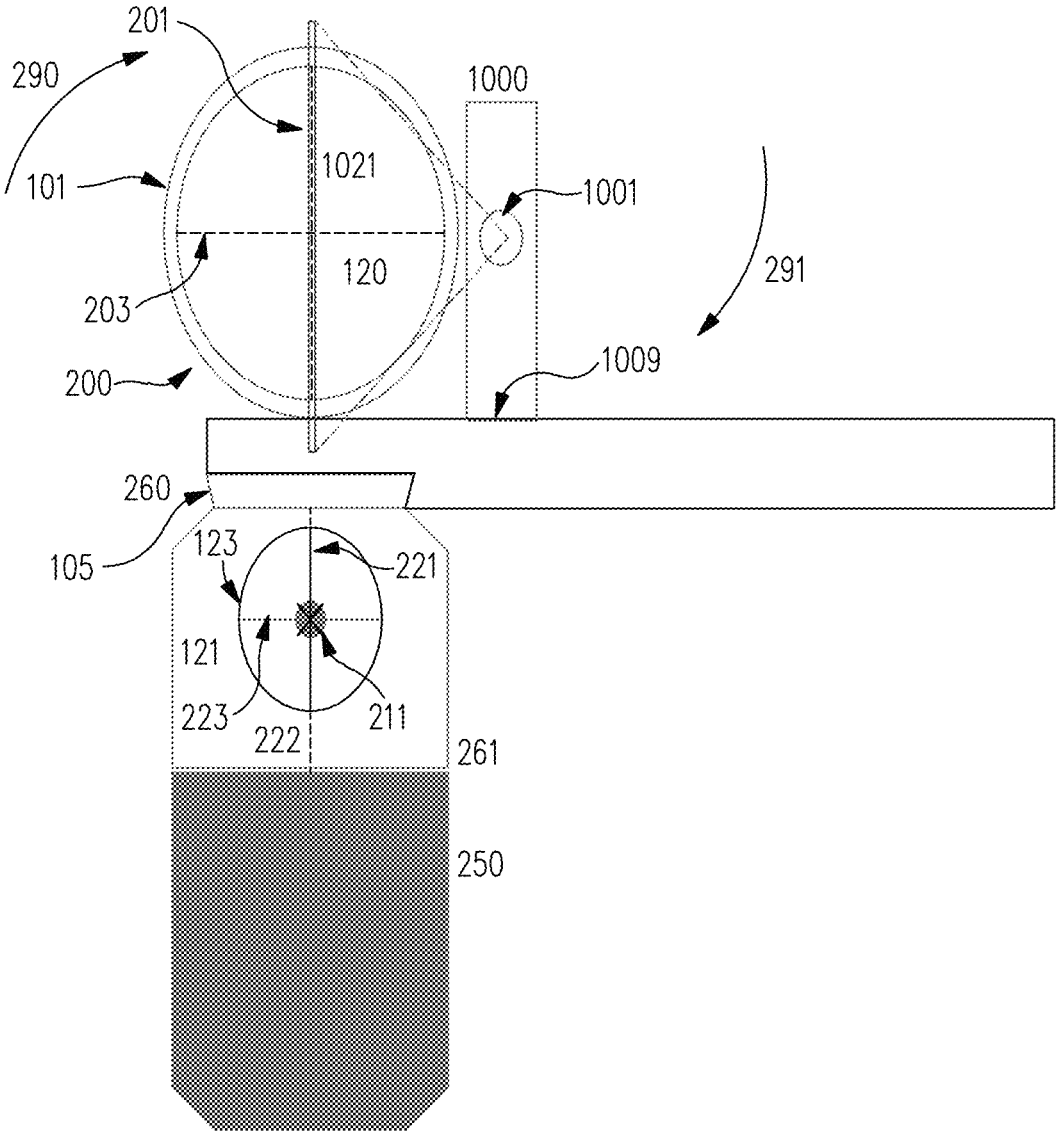
FIG. 12A shows a simplified typical scope reticle view in cutaway, cutaway action, cutaway rifle barrel, and cutaway buttstock as viewed from a viewing end of the scope and with desired scope leveling with the reference device support platform of FIGS. 8A through 8G attached and supporting an alignment reference device that is generating a known good vertical reference line in accordance with one embodiment.

FIG. 12A shows the simplified typical scope reticle view in cutaway, cutaway action, cutaway rifle barrel, and cutaway buttstock as viewed from a viewing end of the scope and with desired scope leveling with the reference device support platform of attached and supporting an alignment reference device of FIG. 11A. Also shown in FIG. 12A is known good vertical reference line generated by in accordance with one embodiment.

Referring to FIG. 1, FIGS. 9A, 10A, 10B, 10C, and 10D, 11A and 12A together, FIG. 12A includes a simplified block diagram of rifle receiver 121 as would be viewed in cutaway from end 120, mounting mechanism 105, in this example a mounting mechanism 105 with a machined flat upper surface 106, as would be viewed in cutaway from end 120, rifle barrel receiver end 122 of rifle barrel 123 as would be viewed in cutaway from end 120, and a simplified representation of a rifle body buttstock 250, in cutaway. FIG. 12A also includes reticle 200 with vertical stadia line 201 and horizontal stadia line 203, referred to collectively as reticle stadia lines.

Also shown in FIG. 12A are vertical and horizontal bore center lines 221 and 223. Vertical bore center line 221 is a theoretical component that runs vertically along rifle receiver centerline 222 through the middle of longitudinal rifle bore center line 211 and at ninety degrees to longitudinal rifle bore center line 211. Likewise, horizontal bore center line 223 is a theoretical component that runs horizontally through the middle of longitudinal rifle bore center line 211 and at ninety degrees to longitudinal rifle bore center line 211 and both rifle receiver centerline 222 and vertical bore center line 221.

Referring to FIGS. 11A, 11B, and 12A, as seen in FIG. 12A, and as discussed above, since vertical reference line 1021 generated by alignment reference device 1000 is parallel to alignment reference device vertical axis 1013, a vertical reference line, such as vertical reference line 1021 generated by alignment reference device 1000 is also parallel to vertical bore center line 221 and perpendicular to horizontal bore center line 223. Consequently, a vertical reference line, such as vertical reference line 1021 generated by alignment reference device 1000 is a known good vertical reference line for scope leveling. In various embodiments, alignment reference device 1000 includes adjustment mechanisms (not shown) for adjusting the horizontal position of vertical reference line 1021 generated by alignment reference device 1000 to the left or right as desired/needed to accommodate for any offset of alignment reference device 1000, and vertical reference line 1021 from the rifle vertical stadia line.

Figure 12B:
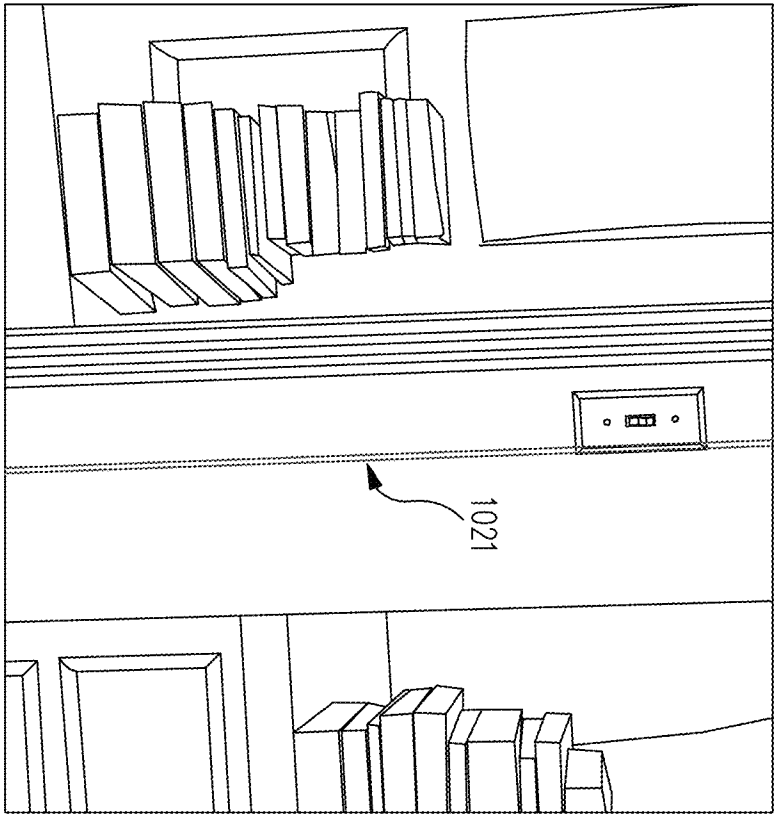
FIG. 12B is a photograph of a known good vertical reference line in accordance with one embodiment.

FIG. 12B is a photograph of a known good vertical reference line 1021 generated by an alignment reference device 1000 in accordance with one embodiment.

Returning to FIG. 12A, since vertical reference line 1021 generated by alignment reference device 1000 is a known good vertical reference line for scope leveling, all the shooter has to do is rotate scope 101 along its longitudinal axis (not shown) clockwise 290 or counterclockwise 291 to line up vertical stadia line 201 of reticle 200 with vertical reference line 1021. Then if the shooter tightens down scope 101 in place while these two lines are in alignment, the scope 101 will be in a leveled state.

Figure 12C:
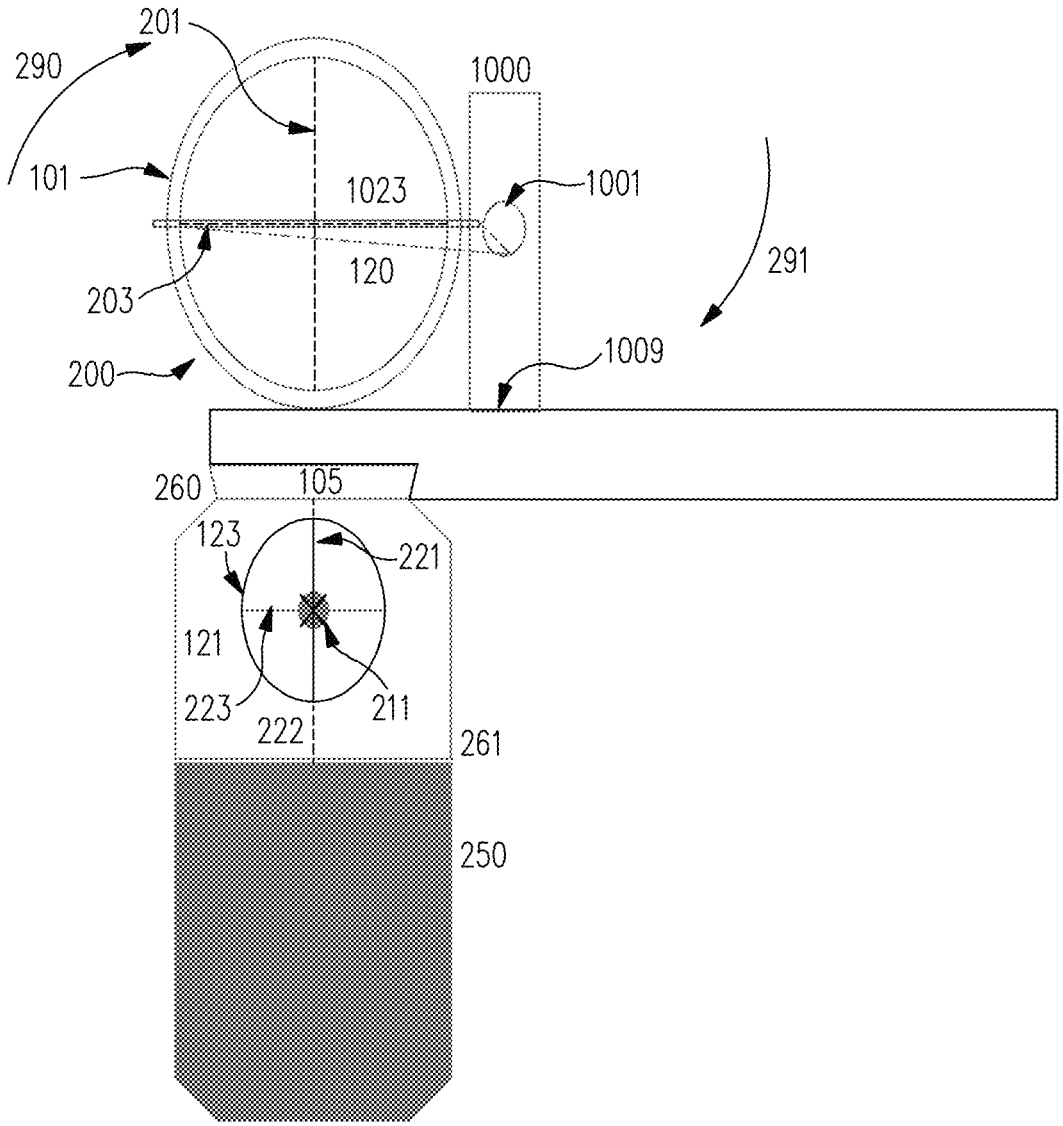
FIG. 12C shows a simplified typical scope reticle view in cutaway, cutaway action, cutaway rifle barrel, and cutaway buttstock as viewed from a viewing end of the scope and with desired scope leveling with the reference device support platform of FIGS. 8A through 8G attached and supporting an alignment reference device that is generating a known good horizontal reference line in accordance with one embodiment.

Likewise, as seen in FIG. 12C, since a horizontal reference line, such as horizontal reference line 1023 generated by alignment reference device 1000 is parallel to alignment reference device horizontal axis 1015, a horizontal reference line, such as horizontal reference line 1023 generated by alignment reference device 1000 is perpendicular to vertical bore center line 221 and parallel to horizontal bore center line 223. Consequently, a horizontal reference line, such as horizontal reference line 1023 generated by alignment reference device 1000 is a known good horizontal reference line for scope leveling. In various embodiments, alignment reference device 1000 includes adjustment mechanisms (not shown) for adjusting the vertical position of horizontal reference line 1023 generated by alignment reference device 1000 up or down as desired/needed to accommodate for any offset of alignment reference device 1000, and horizontal reference line 1023 from the rifle horizontal stadia line.

Since horizontal reference line 1023 generated by alignment reference device 1000 is a known good horizontal reference line for scope leveling, all the shooter has to do is rotate scope 101 along its longitudinal axis (not shown) clockwise 290 or counterclockwise 291 to line up horizontal stadia line 203 of reticle 200 with horizontal reference line 1023. Then if the shooter tightens down scope 101 in place while these two lines are in alignment, the scope 101 will be in a leveled state.

Figure 12D:
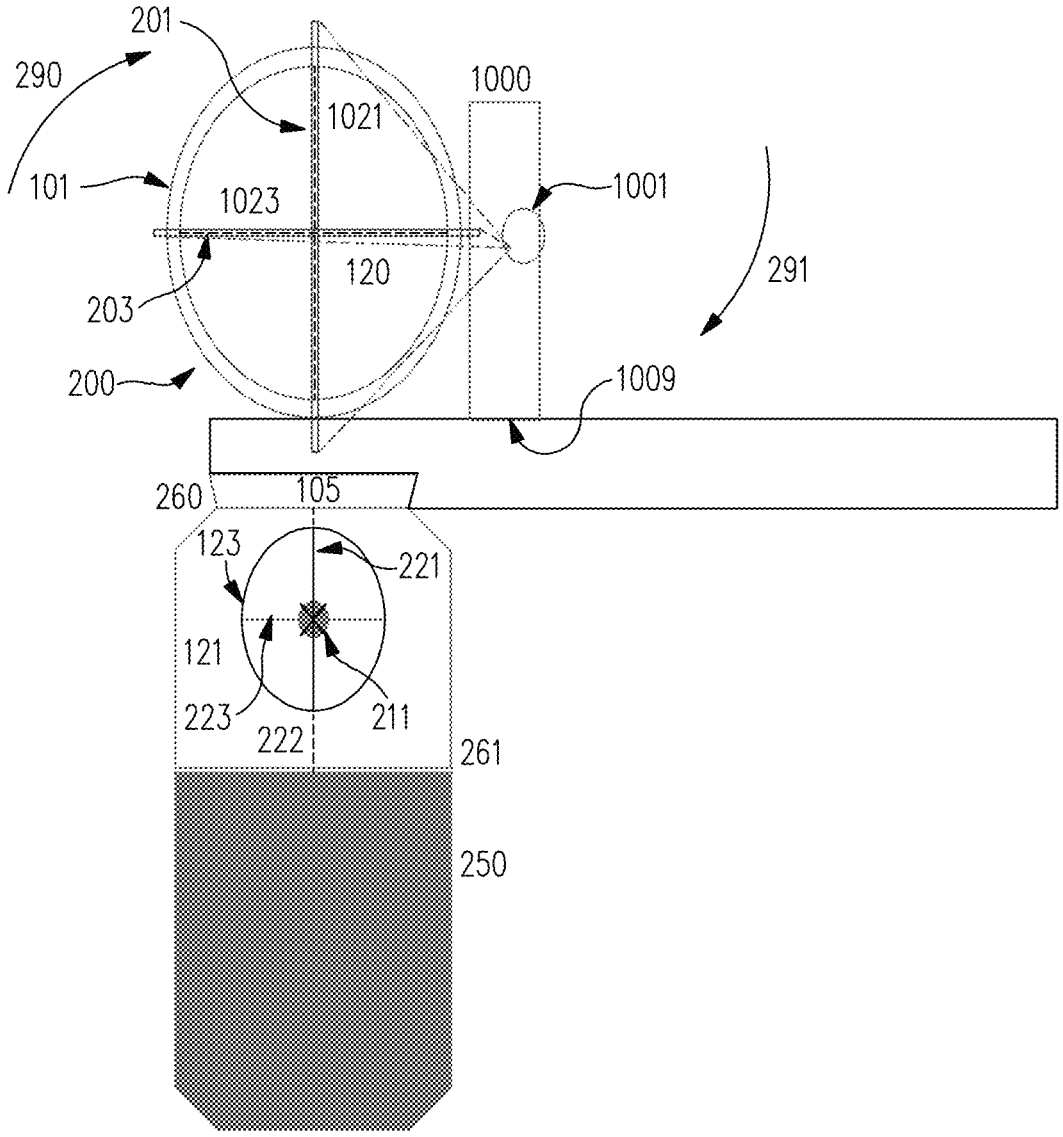
FIG. 12D shows a simplified typical scope reticle view in cutaway, cutaway action, cutaway rifle barrel, and cutaway buttstock as viewed from a viewing end of the scope and with desired scope leveling with the reference device support platform of FIGS. 8A through 8G attached and supporting an alignment reference device that is generating a known good horizontal reference line and a known good vertical reference line in accordance with one embodiment.

Combining the discussion above with respect to FIGS. 12A and 12C, as seen in FIG. 12D since vertical reference line 1021 generated by alignment reference device 1000 is a known good vertical reference line for scope leveling, and horizontal reference line 1023 generated by alignment reference device 1000 is a known good horizontal reference line for scope leveling, all the shooter has to do is rotate scope 101 along its longitudinal axis (not shown) clockwise 290 or counterclockwise 291 to line up vertical stadia line 201 of reticle 200 with vertical reference line 1021 and/or horizontal stadia line 203 of reticle 200 with horizontal reference line 1023. Then if the shooter tightens down scope 101 in place while these lines are in alignment, the scope 101 will be in a leveled state.

As discussed herein, in some embodiments, the reference device support platform is made of a magnetic material or includes magnetic material and/or magnets positioned in only some areas of the reference device support platform. In these embodiments, the alignment reference device can be supported on the reference device support platform via a magnetic force between the reference device support platform and any metallic part of the alignment reference device.

In other embodiments, the alignment reference device can be supported on the reference device support platform via one or more attachment holes and/or one or more mechanical attachment devices such as a clamp or screw mechanism. In other embodiments, the alignment reference device can be supported on the reference device support platform via gravitational force by simply placing the alignment reference device on the first surface of the reference device support platform. In various other embodiments, the alignment reference device can be supported on the reference device support platform using any mechanism discussed herein, and/or as known in the art at the time of filing, and/or as developed after the time of filing for securing and alignment reference device to a support platform.

When the alignment reference device is so placed, a horizontal axis of the alignment reference device will be parallel to the reference device support platform first surface plane. As a result, the horizontal axis of the alignment reference device will also be parallel to the rifle's horizontal bore center line and perpendicular to rifle's vertical bore center line. Likewise, when the alignment reference device is so placed, a vertical axis of the alignment reference device will be perpendicular to the reference device support platform first surface plane. As a result, the vertical axis of the alignment reference device will also be perpendicular to the rifle's horizontal bore center line and parallel to rifle's vertical bore center line.

Consequently, once the alignment reference device is placed on the reference device support platform first surface, any vertical line generated by the alignment reference device will be perpendicular to the rifle's horizontal bore center line and parallel to rifle's vertical bore center line. Likewise, any vertical line generated by the alignment reference device will be parallel to the rifle's horizontal bore center line and perpendicular to rifle's vertical bore center line.

In one embodiment, the alignment reference device is then placed on the reference device support platform first surface and used to generate a vertical reference line, or a horizontal reference line, or both a vertical reference line and a horizontal reference line. A generated vertical reference line can be used for leveling the scope using the fact that the generated vertical reference line is now known to be parallel to rifle's vertical bore center line. A generated horizontal reference line can be used for leveling the scope using the fact that the generated horizontal reference line is now known to be parallel to rifle's horizontal bore center line. Using both a generated horizontal and vertical reference line, both can be used for leveling the scope using the fact that the generated reference lines are now known to be parallel to rifle's vertical bore center line horizontal bore center line, respectively.

Referring back to FIGS. 9A, 9B, 11A, 11B, and 11C, in accordance with the disclosed embodiments, reference device support platform 800 is attached to rifle 102 such that the reference device support platform first surface plane 825, and therefore reference device support platform first surface 801, is parallel to the rifle's horizontal bore center line 223 and perpendicular to the rifle's vertical bore center line 221.

As noted above, one way this orientation is achieved is by removably attaching reference device support platform first or attachment end 807 of reference device support platform 800 to rifle 102 via magnetic forces between a magnetic attachment portion 815 and attachment notch 819 and mounting point/mechanism 105 which, in the example of FIG. 9B, has a metallic flat surface 106 that fits into attachment notch 819. Since metallic flat surface 106 lies in a plane, not shown, that is parallel to horizontal bore center line 223 and perpendicular to rifle receiver centerline 222 and vertical bore center line 221, when reference device support platform first or attachment end 807 of reference device support platform 800 is attached to rifle 102 via attachment to metallic flat surface 106, reference device support platform first surface 801 that lies in reference device support platform first surface plane 825 is also is parallel to horizontal bore center line 223 and perpendicular to rifle receiver centerline 222 and vertical bore center line 221.

Figure 13:
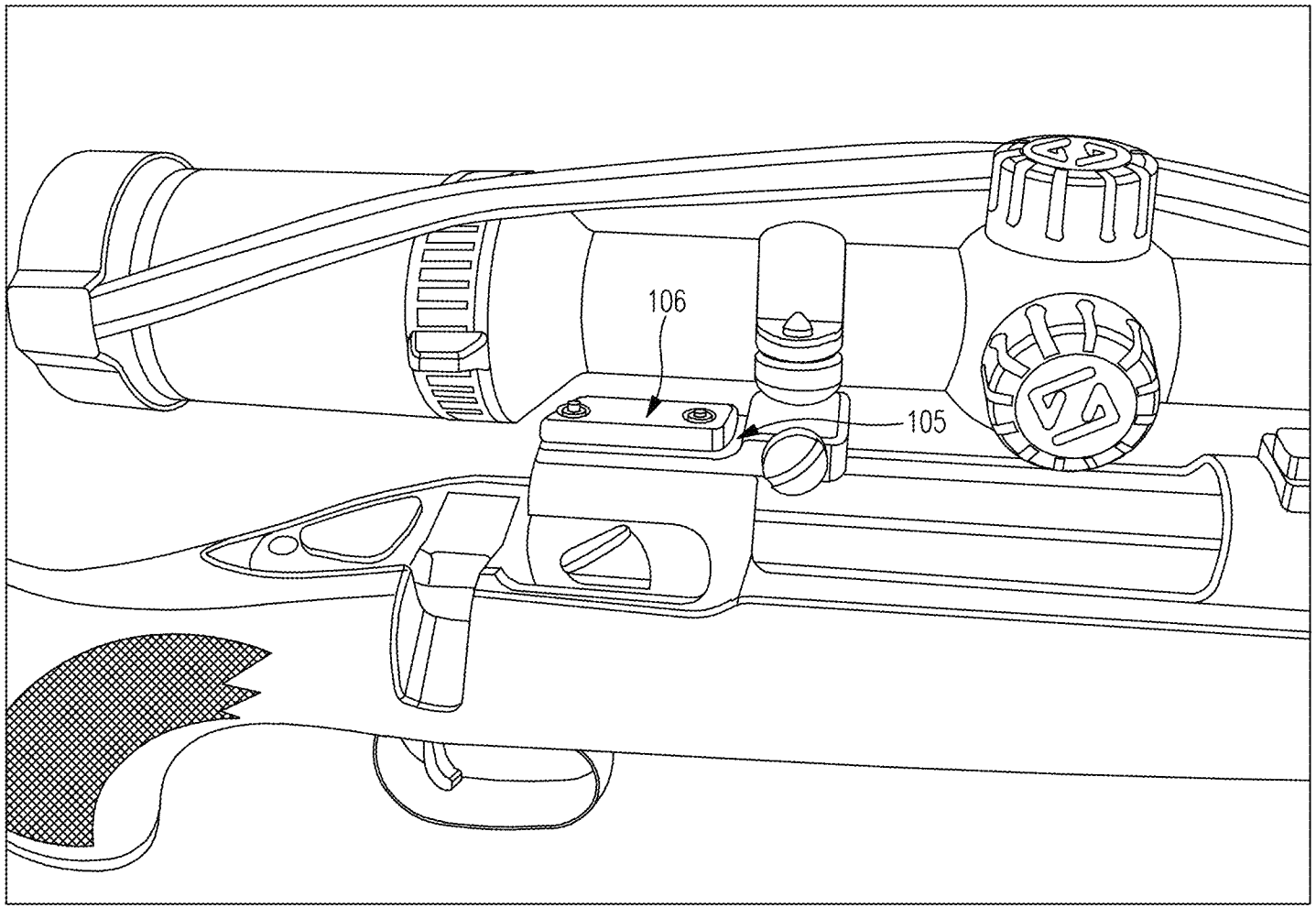
FIG. 13 is a photograph of a scope mounting system mechanism that includes a flat upper surface that is in a plane parallel to the rifle bore horizontal axis and perpendicular to the rifle bore vertical axis.

FIG. 13 is a photograph of a scope mounting system mechanism 105 that includes a flat upper surface 106 that is in a plane (not shown) parallel to the rifles action and rifle bore horizontal axis and perpendicular to the rifle bore vertical axis.

Figure 14A:
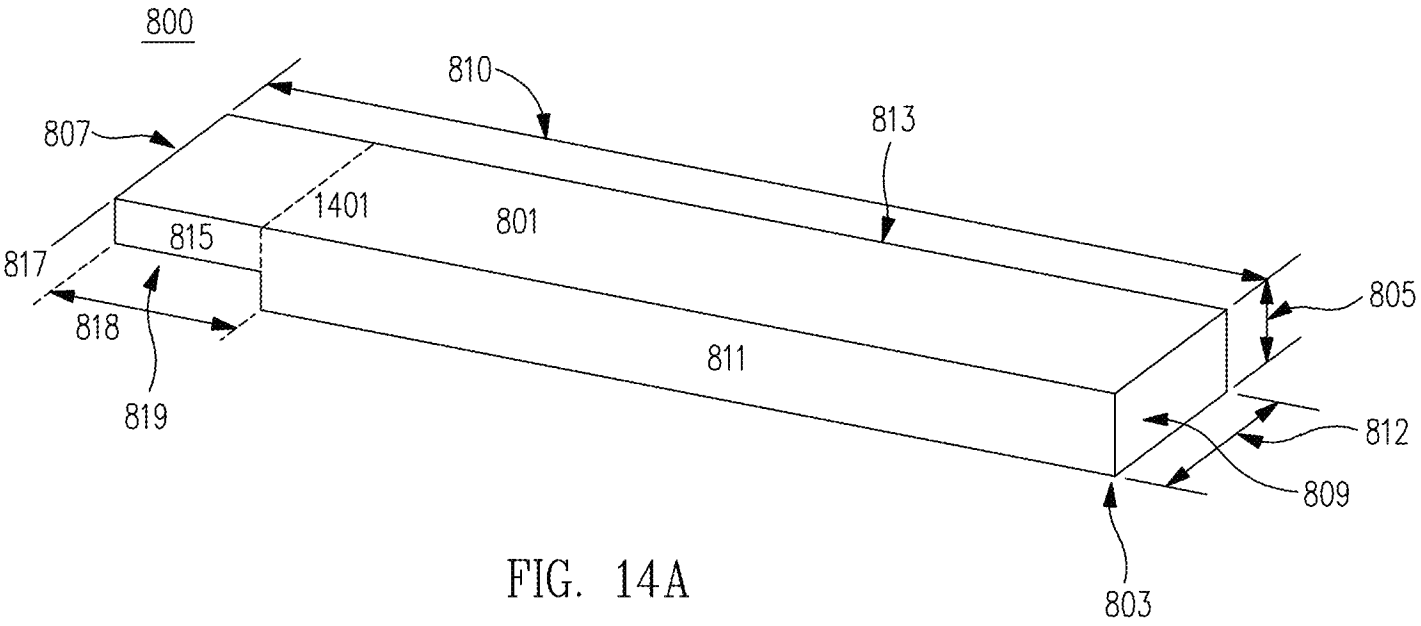
FIG. 14A shows a line drawing of a perspective view of a reference device support platform that can be used with a scope mounting system mechanisms that includes a flat upper surface that is in a plane parallel to the rifle bore horizontal axis and perpendicular to the rifle bore vertical axis in accordance with one embodiment.

FIG. 14A shows a line drawing of a perspective view of the reference device support platform 800 of FIGS. 8A, 8B, 8C, 8D, 8E, 8F, 8G, 9A, 9B, 9C, 11A, 11B, and 11C that can be used with a scope mounting system mechanism 105 that includes a flat upper surface 106 that is in a plane parallel to the rifle bore horizontal axis 203 and perpendicular to the rifle bore vertical axis 201 in accordance with one embodiment. The reader is referred to the discussion above with respect to FIGS. 8A, 8B, 8C, 8D, 8E, 8F, 8G, 9A, 9B, 9C, 11A, 11B, and 11C for a more detailed discussion of the structure and use of reference device support platform 800.

As also shown in FIG. 14A, reference device support platform 800 can be made of a magnetic material in its entirety or can include magnetic material and/or magnets positioned in only some areas of the reference device support platform 800, such as reference device support platform attachment portion 815 of first or attachment end 807, as indicated by dashed line 1401 in FIG. 14A.

As discussed above, and referring to FIGS. 8A, 8B, 8C, 8D, 8E, 8F, 8G, 9A, 9B, 9C, 11A, 11B, and 11C, in these embodiments, the reference device support platform 800 is removably attached to the rifle 102 by magnetic forces by attaching the reference device support platform 800 magnetic portions to metallic surfaces of the firearm's action or scope mounts, or any other metallic part of the rifle that is flat, or provides for flat attachment, and whose flat surface, or surfaces are parallel to the rifle's horizontal bore center line 223 and perpendicular to the rifle's vertical bore center line 221.

As a specific example, in one embodiment, the reference device support platform 800 is removably attached to the rifle 102 by magnetically attaching the reference device support platform 800 magnetic portions to the flat surface of a scope mounting system mechanism that includes a flat upper surface that is in a plane parallel to the rifle bore horizontal axis 223 and perpendicular to the rifle bore vertical axis 221 so that reference device support platform first surface plane 825 and reference device support platform first surface 801 are also parallel to the rifle bore horizontal axis 223 and perpendicular to the rifle bore vertical axis 221.

A very specific illustrative example of this type of scope mounting system mechanism is a Ziess scope mounting system mechanism that includes a scope mounting system mechanisms 105 with a flat upper surface 106 that is in a plane parallel to the rifle bore horizontal axis 223 and perpendicular to the rifle bore vertical axis 221.

As noted, in one embodiment, at least part of the reference device support platform 800 is magnetic. In one embodiment, this magnetic portion is used to removably attach the reference device support platform 800 to the rifle by magnetic forces between the magnetic attachment portion 815 of the reference device support platform 800 and the metallic flat upper surface 106 of the scope mounting system mechanism. The result is that the reference device support platform 800 is attached to the firearm such that the reference device support platform first surface plane 825 is perpendicular to a centerline 222 of the rifle's receiver 121 extending along common vertical line 300 down from the top of the rifle receiver to the bottom of the rifle receiver and parallel to the rifle bore's longitudinal centerline 211. Consequently, when the reference device support platform 800 is removably attached as disclosed, the reference device support platform first surface plane 825, and reference device support platform first surface 801, is parallel to the rifle's horizontal bore center line 223 and perpendicular to the rifle's vertical bore center line 221.

The reader is again referred to the discussion above with respect to 8A, 8B, 8C, 8D, 8E, 8F, 8G, 9A, 9B, 9C, 11A, 11B, and 11C for a more detailed discussion of the use and attachment of reference device support platform 800 with scope mounting system mechanisms that include a flat upper surface that is in a plane parallel to the rifle bore horizontal axis and perpendicular to the rifle bore vertical axis.

Figure 14B:
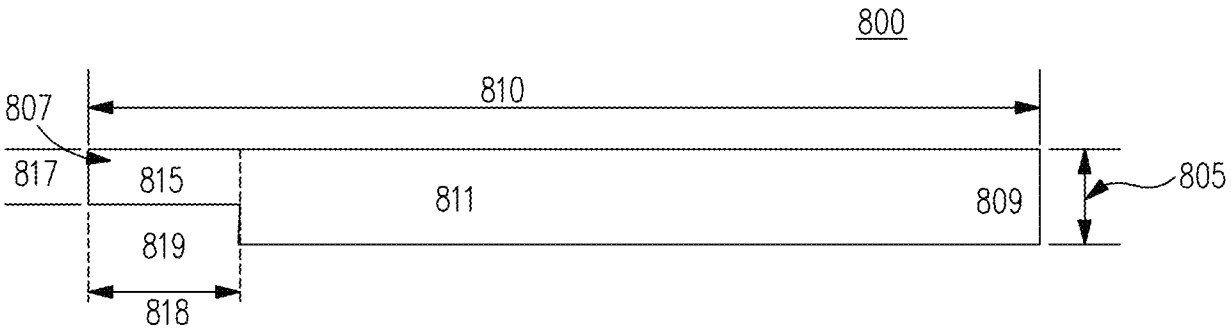
FIG. 14B shows a line drawing of a side view of a reference device support platform that can be used with a scope mounting system mechanisms that includes a flat upper surface that is in a plane parallel to the rifle bore horizontal axis and perpendicular to the rifle bore vertical axis in accordance with one embodiment.

FIG. 14B shows a line drawing of a side view of the reference device support platform 800 of FIG. 14A in accordance with one embodiment.

As discussed above, in some embodiments, reference device support platform 800 is made of a magnetic material or includes magnetic material and/or magnets positioned in only some areas of the reference device support platform 800, such as attachment portion 815. In these embodiments, the reference device support platform 800 is removably attached to the rifle 102 by magnetic forces and by attaching the reference device support platform first or attachment end 807 of reference device support platform 800 to metallic surface flat surface 106.

In one embodiment, once the reference device support platform 800 is removably attached to the rifle 102 such that the reference device support platform first surface 801 is parallel to the rifle's horizontal bore center line 223 and perpendicular to the rifle's vertical bore center line 221, and an alignment reference device 1000 is obtained, the alignment reference device 1000 is removably attached to the reference device support platform 800 such that the alignment reference device bottom surface 1009 is supported by the reference device support platform first surface 801 and alignment reference device bottom surface plane 1012 is parallel to reference device support platform first surface plane 825.

As discussed herein, in some embodiments, the reference device support platform 800 is made of a magnetic material or at least includes magnetic material and/or magnets positioned in only some areas of the reference device support platform, such as first or attachment end 807 and/or second or support end 809. In these embodiments, the alignment reference device 1000 can be supported on the reference device support platform 800 via a magnetic force between the magnetic reference device support platform 800 and the metallic alignment reference device bottom surface.

In other embodiments, the alignment reference device 1000 can be supported on the reference device support platform 800 via one or more attachment holes and/or one or more mechanical attachment devices such as a clamp or screw mechanism and/or a mounting hole in the second or support end 809 of the reference device support platform 800.

Figure 14C:
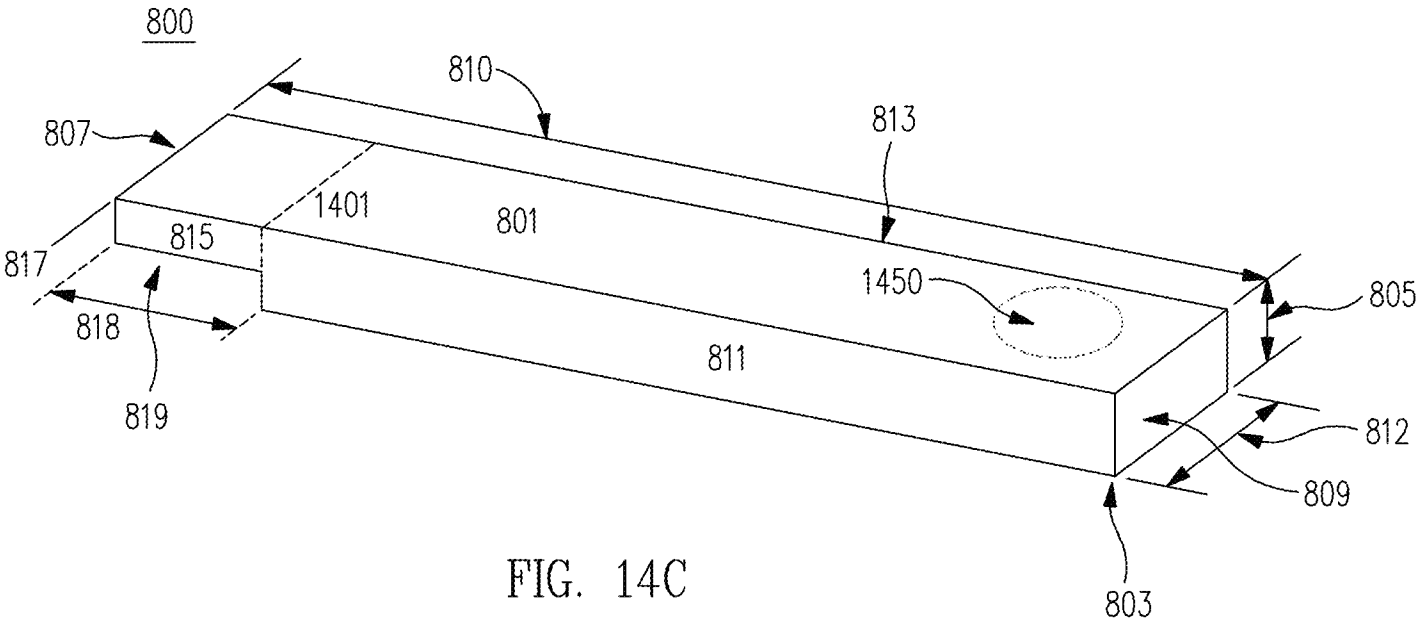
FIG. 14C shows a line drawing of a perspective view of a reference device support platform that can be used with a scope mounting system mechanisms that includes a flat upper surface that is in a plane parallel to the rifle bore horizontal axis and perpendicular to the rifle bore vertical axis and includes a reference device mounting hole in accordance with one embodiment.

FIG. 14C shows a line drawing of a perspective view of a reference device support platform 800 that can be used with a scope mounting system mechanism 105 that includes a flat upper surface 106 that is in a plane parallel to the rifle bore horizontal axis and perpendicular to the rifle bore vertical axis and includes a reference device mounting hole 1403 mounting hole in the second or support end 809 of the reference device support platform 800 in accordance with one embodiment.

Figure 14D:
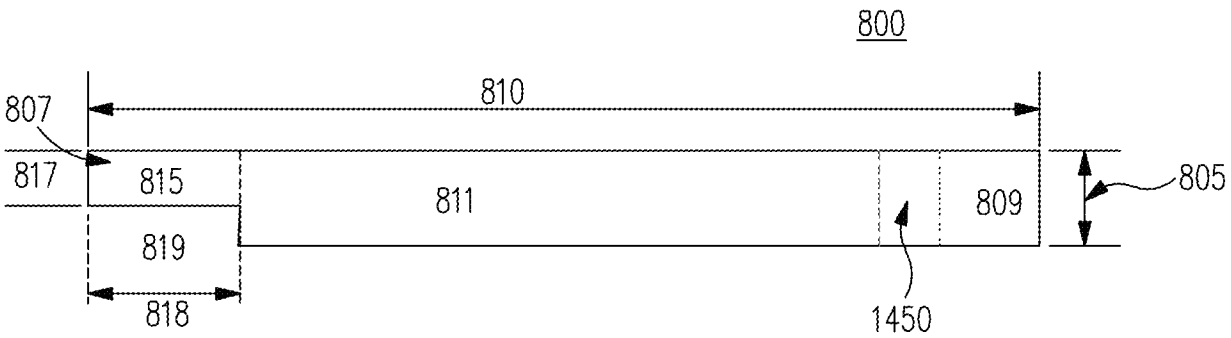
FIG. 14D shows a line drawing of a side view of a reference device support platform that can be used with a scope mounting system mechanisms that includes a flat upper surface that is in a plane parallel to the rifle bore horizontal axis and perpendicular to the rifle bore vertical axis and includes a reference device mounting hole in accordance with one embodiment.

FIG. 14D shows a line drawing of a side view of a reference device support platform that can be used with a scope mounting system mechanisms that includes a flat upper surface that is in a plane parallel to the rifle bore horizontal axis and perpendicular to the rifle bore vertical axis and includes a reference device mounting hole 1403 in accordance with one embodiment.

Figure 14E:
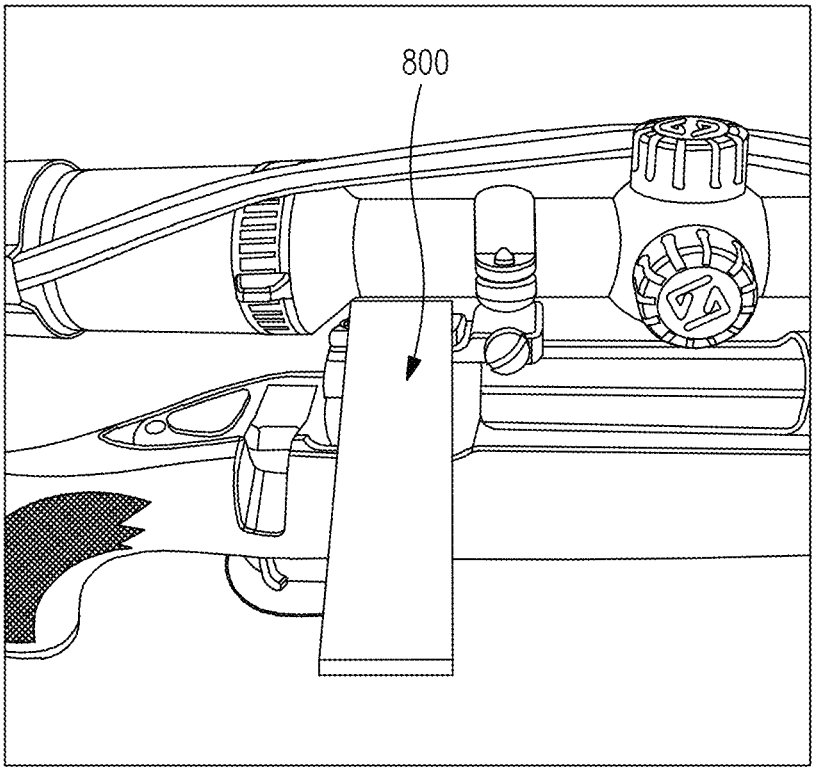
FIG. 14E is a photograph of a reference device support platform attached to a rifle using scope mounting system mechanism that includes a flat upper surface that is in a plane parallel to the rifle bore horizontal axis and perpendicular to the rifle bore vertical axis in accordance with one embodiment.

FIG. 14E is a photograph of a reference device support platform attached to a rifle using scope mounting system mechanism that includes a flat upper surface that is in a plane parallel to the rifle bore horizontal axis and perpendicular to the rifle bore vertical axis in accordance with one embodiment.

As discussed above, in some embodiments, the reference device support platform is removably attached to the rifle using various parts of the rifle, such as bolt guide rails and/or receiver surfaces, that allow the reference device support platform to be removably attached to a rifle such that the reference device support platform first surface plane is perpendicular to a centerline of the rifle's receiver extending down from the top of the rifle receiver to the bottom of the rifle receiver and parallel to the rifle's action and the bore's longitudinal centerline.

Figure 15A:
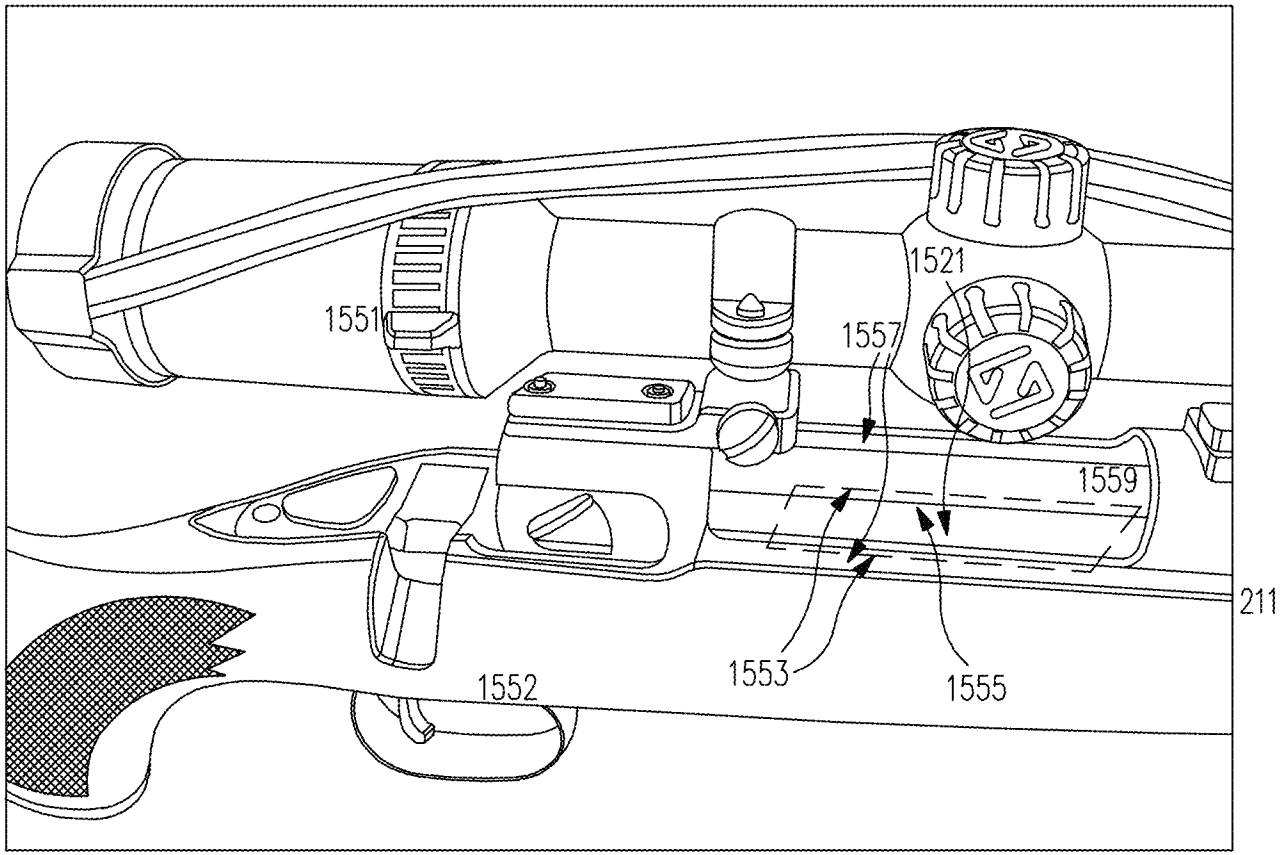
FIG. 15A is a photograph of a rifle and scope system where the bolt rails and bolt rail top surfaces of the rifle lie in a plane parallel to the rifle bore horizontal axis and perpendicular to the rifle bore vertical axis.

FIG. 15A is a photograph of a rifle 1552 and scope 1551 system where the bolt rails 1553 of the rifle 1552 have bolt rail top surfaces 1555 that lie in the same plane 1559 parallel to the rifle bore horizontal axis and perpendicular to the rifle bore vertical axis.

Referring to FIGS. 2 and 15A, as seen in FIG. 15A, rifle receiver 1521 includes bolt rails 1553 that are opposite to each other and lie just below the rifle receiver top surfaces 1557 of the rifle receiver 1521. Bolt rails 1553 have top surfaces 1555 that lie in the same plane 1559. As also shown in FIG. 15A, plane 1559 is parallel to the rifle action and bore centerline 211. Consequently, plane 1559 is parallel to horizontal bore centerline 223 and perpendicular to vertical bore centerline 221. It follows that plane 1559 is also parallel to scope horizontal stadia line 203 and perpendicular to scope vertical stadia line 201.

Rifle 1552 of FIG. 15A is typical of several bolt action rifles such as the Remington 700 series of rifles.

In one embodiment, the Inventor makes use of the fact that bolt rails 1553 have top surfaces 1555 that line in the plane 1559 and that plane 1559 is parallel to horizontal bore centerline 223, and scope horizontal stadia line 203, and perpendicular to vertical bore centerline 221, and scope vertical stadia line 201. The inventor realized that by removably attaching a specially designed reference device support platform 1500 (FIG. 15B) such that the specially designed reference device support platform 1500 bridges rifle receiver 121 and rests on the top surfaces 1555 of bolt rails 1553, a reference device support platform first surface 1501 of the reference device support platform 1500 would lie in plane parallel to rifle receiver top surfaces plane 1559.

Figure 15B:
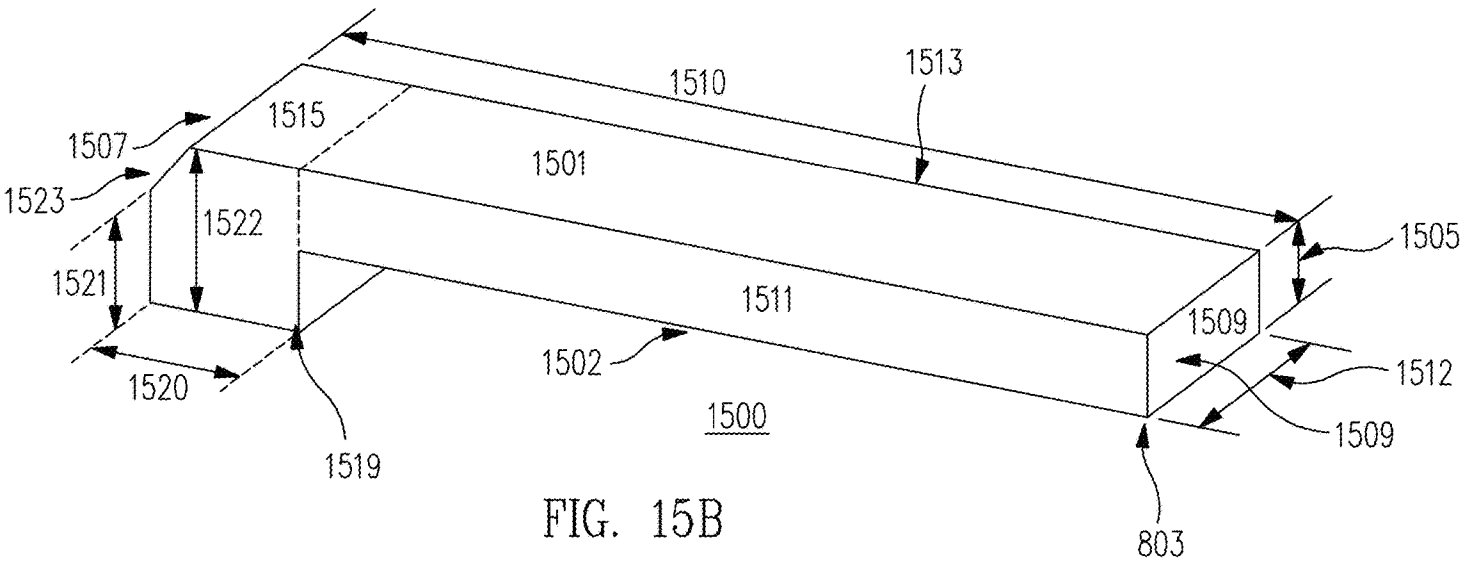
FIG. 15B shows a line drawing of a perspective view of a reference device support platform that can be used with a rifle where the bolt rails and bolt rail top surfaces of the rifle lie in a plane parallel to the rifle bore horizontal axis and perpendicular to the rifle bore vertical axis in accordance with one embodiment.

FIG. 15B shows a line drawing of a perspective view of a reference device support platform 1500 that can be used with a rifle where the bolt rails of the rifle lie in a plane parallel to the rifle bore horizontal axis and perpendicular to the rifle bore vertical axis in accordance with one embodiment.

As seen in FIG. 15B, reference device support platform 1500 includes a reference device support platform first or upper surface 1501 and a reference device support platform second or lower surface 1502 opposite reference device support platform first or upper surface 1501.

As also seen in FIG. 15B, reference device support platform 1500 includes reference device support platform first or attachment end 1507 and reference device support platform second or support end 1509 opposite reference device support platform first end 1507. As also seen in FIG. 15A, reference device support platform first surface 1501 is separated from reference device support platform second surface 1502 by reference device support platform body thickness 1505.

As seen in FIG. 15B, reference device support platform first end 1507 is separated from reference device support platform second end 1509 by reference device support platform length dimension 1510. As also seen in FIG. 15B, reference device support platform 1500 includes reference device support platform first side 1511 and reference device support platform second side 1513 opposite reference device support platform first side 1511. As seen in FIG. 15B, reference device support platform first side 1511 is separated from reference device support platform second side 1513 by reference device support platform width dimension 1512.

Figure 15C:
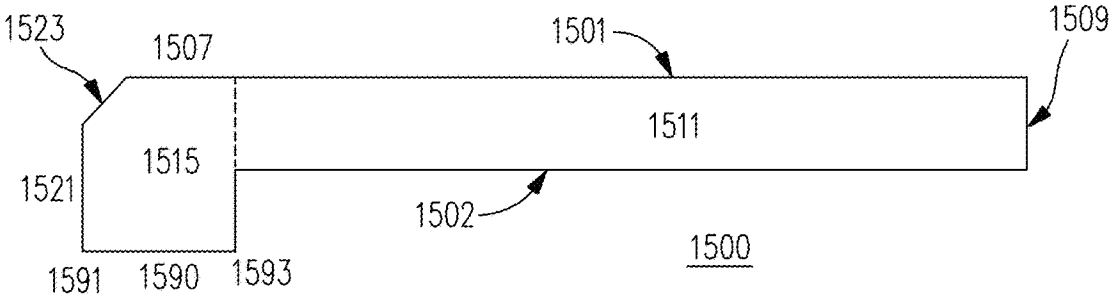
FIG. 15C shows a line drawing of a side view of a reference device support platform that can be used with a rifle where the bolt rails and bolt rail top surfaces of the rifle lie in a plane parallel to the rifle bore horizontal axis and perpendicular to the rifle bore vertical axis in accordance with one embodiment.

FIG. 15C shows a line drawing of one embodiment of reference device support platform 1500 of FIG. 15A, as viewed from reference device support platform first side 1511.

Of note, referring to FIGS. 15A and 15B, the particular embodiment of reference device support platform 1500 of FIG. 15B includes in-receiver attachment portion 1515 at reference device support platform first end 1507 of in-receiver attachment portion thickness 1521 forming an in-receiver attachment portion 1515 of attachment portion length 1520 and, in this specific embodiment, including in-receiver attachment portion notch 1523.

Figure 15D:
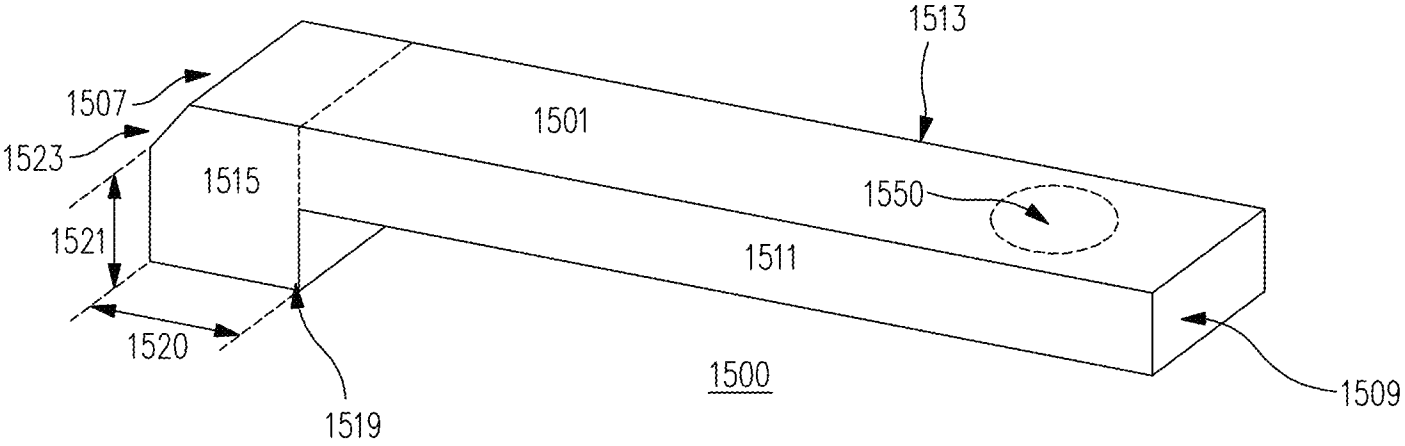
FIG. 15D shows a line drawing of a perspective view of a reference device support platform that can be used with a rifle where the bolt rails and bolt rail top surfaces of the rifle lie in a plane parallel to the rifle bore horizontal axis and perpendicular to the rifle bore vertical axis and includes a reference device mounting hole in accordance with one embodiment.
Figure 15E:
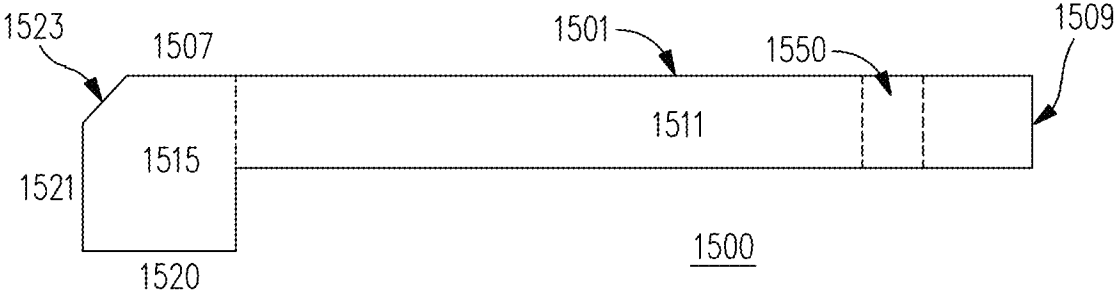
FIG. 15E shows a line drawing of a side view of a reference device support platform that can be used with a rifle where the bolt rails and bolt rail top surfaces of the rifle lie in a plane parallel to the rifle bore horizontal axis and perpendicular to the rifle bore vertical axis and includes a reference device mounting hole in accordance with one embodiment.
Figure 15F:
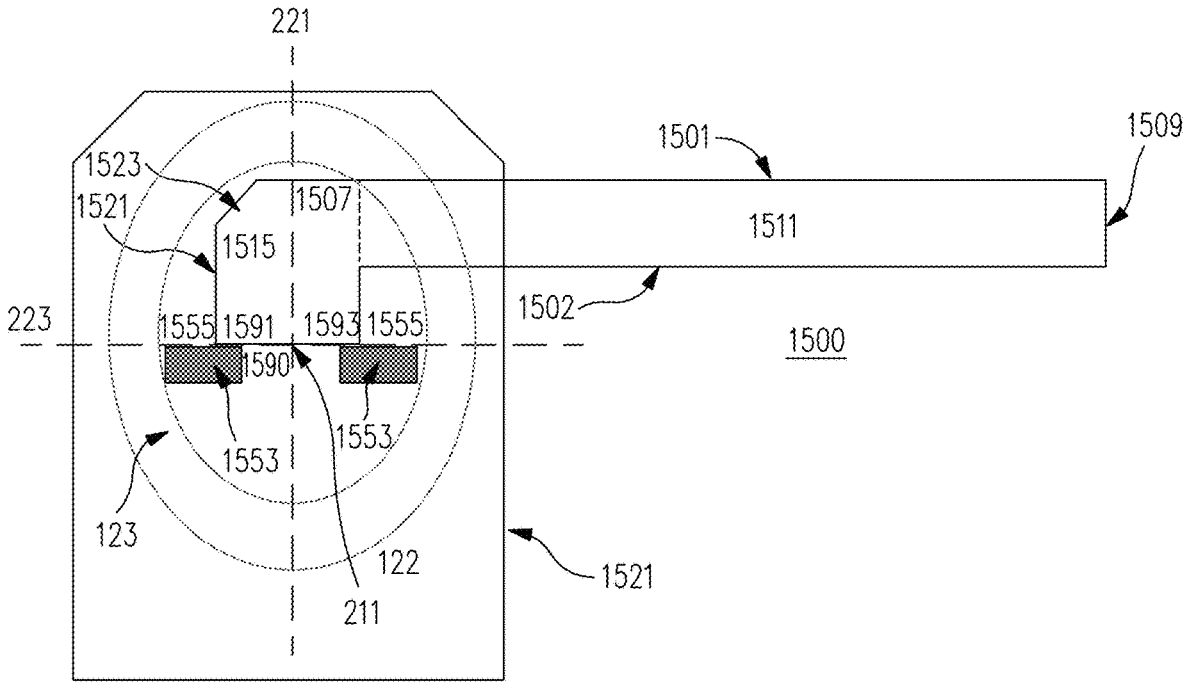
FIG. 15F shows a reference device support platform attached to a rifle where the bolt rails and bolt rail top surfaces of the rifle lie in a plane parallel to the rifle bore horizontal axis and perpendicular to the rifle bore vertical axis in accordance with one embodiment.
Figure 15G:
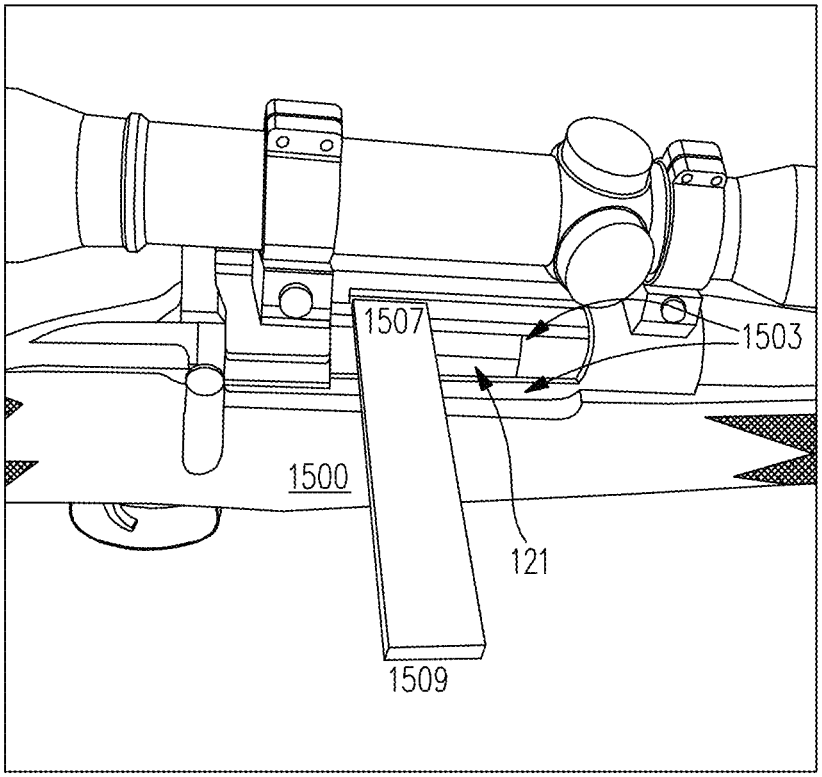
FIG. 15G is a photograph of the reference device support platform of FIGS. 15B through 15F attached to s rifle and scope system where the bolt rails and bolt rail top surfaces of the rifle lie in a plane parallel to the rifle bore horizontal axis and perpendicular to the rifle bore vertical axis.

As discussed in more detail with respect to FIG. 15F and referring to FIGS. 15A, 15B, and 15C, in one embodiment, in-receiver attachment portion 1515 is dimensioned such that in-receiver attachment portion 1515 fits within receiver 1521 such that bottom surface 1590 of in-receiver attachment portion 1515 rests on top surfaces 1555 of bolt rails 1553 such that corner 1591 of bottom surface 1590 rests on the top surface 1555 of one bolt rail 1553 and corner 1593 of bottom surface 1590 rests on the top surface 1555 of the other bolt rail 1553. Consequently, when so positioned, reference device support platform first surface 1501 of reference device support platform 1500 is parallel to plane 1559 and therefore is parallel to horizontal bore centerline 223, and scope horizontal stadia line 203, and perpendicular to vertical bore centerline 221, and scope vertical stadia line 201.

FIG. 15D shows a line drawing of a perspective view of a reference device support platform 1500 that can be used with a rifle 1552 where the bolt rails 1553 of the rifle run parallel to each other and perpendicular to the rile action and rifle bore centerline 211 and the rifle receiver top surfaces plane 1559 is parallel to horizontal bore centerline 223 and perpendicular to vertical bore centerline 221. Also shown in FIG. 15D is reference device mounting hole 1550 in accordance with one embodiment. Reference device mounting hole 1550 is similar in structure and use to reference device mounting hole 1450 discussed above with respect to FIGS. 14C and 14D.

FIG. 15E shows a line drawing of a side view of the reference device support platform 1500 of FIG. 15D in accordance with one embodiment.

FIG. 15F shows a reference device support platform attached to a rifle where top surfaces 1555 of the bolt rails 1553 of the rifle lie in a plane 1559 parallel to the rifle bore horizontal axis 223 and perpendicular to the rifle bore vertical axis 221 in accordance with one embodiment.

Referring to referring to FIGS. 2, 15A, 15B, 15C, 15D, 15E and 15F, the particular embodiment of reference device support platform 1500 of FIG. 15B includes in-receiver attachment portion 1515 at reference device support platform first end 1507 and in-receiver attachment portion notch 1523.

Referring to FIGS. 2, 15A, 15B, 15C, 15D, 15E and 15F in one embodiment, in-receiver attachment portion 1515 is dimensioned such that in-receiver attachment portion 1515 fits within receiver 1521 such that bottom surface 1590 of in-receiver attachment portion 1515 rests on top surfaces 1555 of bolt rails 1553 such that corner 1591 of bottom surface 1590 rests on one top surface 1555 of one bolt rail 1553 and corner 1593 of bottom surface 1590 rests on one top surface 1555 of the other bolt rail 1553. Consequently, when so positioned, reference device support platform first surface 1501 of reference device support platform 1500 is parallel to plane 1559 and therefore is parallel to horizontal bore centerline 223, and scope horizontal stadia line 203, and perpendicular to vertical bore centerline 221, and scope vertical stadia line 201.

As discussed above, in some embodiments, reference device support platform 1500 is made of a magnetic material or includes magnetic material and/or magnets positioned in only some areas of the reference device support platform 1500, such as attachment portion 1515 or a portion of attachment portion 1515, such as bottom surface 1590. In these embodiments, the reference device support platform 1500 is removably attached to the rifle 1502 by magnetic forces and by attaching portions of the reference device support platform second surface 1502 of reference device support platform 1500 to top surfaces 1555 of bolt rails 1553 such the reference device support platform 1500 bridges receiver 1521 and reference device support platform first surface 1501 of the reference device support platform 1500 lies in plane parallel to plane 1559 and therefore is parallel to horizontal bore centerline 223, and scope horizontal stadia line 203, and perpendicular to vertical bore centerline 221, and scope vertical stadia line 201.

Therefore, Referring to FIGS. 11A, 11B, 12A, 12B, 12C, 15A, 15B, 15C, and 15D, a reference device support platform 1500 so placed would have a reference device support platform first surface 1501 parallel to horizontal bore centerline 223, and scope horizontal stadia line 203, and perpendicular to vertical bore centerline 221, and scope vertical stadia line 201. This, in turn, would provide the desired orientation of the reference device support platform 1500. Then, as also discussed above, in one embodiment, once the reference device support platform 1500 is removably attached to the rifle 1502 such that the reference device support platform first surface 1501 is parallel to the rifle's horizontal bore center line 223 and perpendicular to the rifle's vertical bore center line 221, and an alignment reference device is obtained, the alignment reference device is removably attached to the reference device support platform 1500 such that the alignment reference device bottom surface 1009 is supported by the reference device support platform first surface 1501 and alignment reference device bottom surface plane 1012 is parallel to reference device support platform reference device support platform first surface 1501.

When the alignment reference device 1000 is so placed, a horizontal axis of the alignment reference device 1015 will be parallel to the reference device support platform first surface 1501. As a result, the horizontal axis of the alignment reference device 1015 will also be parallel to the rifle's horizontal bore center line 223 and perpendicular to rifle's vertical bore center line 221. Likewise, when the alignment reference device is so placed, a vertical axis of the alignment reference device 1001 will be perpendicular to the reference device support platform first surface 1501. As a result, the vertical axis of the alignment reference device 1001 will also be perpendicular to the rifle's horizontal bore center line 223 and parallel to rifle's vertical bore center line 221.

Consequently, once the alignment reference device 1000 is placed on the reference device support platform first surface 1501, any vertical reference line 1021 generated by the alignment reference device 1000 will be perpendicular to the rifle's horizontal bore center line 223 and parallel to rifle's vertical bore center line 221. Likewise, any horizontal reference line 1023 generated by the alignment reference device 1000 will be parallel to the rifle's horizontal bore center line 223 and perpendicular to rifle's vertical bore center line 221.

In one embodiment, the alignment reference device 1000 is then placed on the reference device support platform first surface 1501 and used to generate a vertical reference line 1021, or a horizontal reference line 1023, or both a vertical reference line 1021 and a horizontal reference line 1023 in the same way discussed above with respect to FIGS. 12A, 12B, and 12C.

A generated vertical reference line 1021 can be used for leveling the scope 1551 using the fact that the generated vertical reference line 1021 is now known to be parallel to rifle's vertical bore center line 221. A generated horizontal reference line can 1023 be used for leveling the scope 1551 using the fact that the generated horizontal reference line 1023 is now known to be parallel to rifle's horizontal bore center line 223. Using both a generated horizontal and vertical reference line, 1023 and 1021, respectively, both can be used for leveling the scope 1551 using the fact that the generated reference lines 1021 and 1023 are now known to be parallel to rifle's vertical bore center line 221 horizontal bore center line 223, respectively.

As discussed herein, in some embodiments, the reference device support platform 1500 is made of a magnetic material, or at least includes magnetic material and/or magnets, positioned in only some areas of the reference device support platform, such as first or attachment end 1507 and/or second or support end 1509. In these embodiments, the alignment reference device 1000 can be supported on the reference device support platform 1500 via a magnetic force between the magnetic reference device support platform 1500 and the metallic alignment reference device bottom surface.

In other embodiments, the alignment reference device 1000 can be supported on the reference device support platform 1500 via one or more mechanical attachment devices such as a clamp or screw mechanism and/or a mounting hole 1550 in the second or support end 1509 of the reference device support platform 1500. In other embodiments, the alignment reference device 1000 can be supported on the reference device support platform 1500 via gravitational force by simply placing the alignment reference device 1000 on the reference device support first surface 1501 of the reference device support platform 1500. In various other embodiments, the alignment reference device 1000 can be supported on the reference device support platform 1500 using any mechanism discussed herein, and/or as known in the art at the time of filing, and/or as developed after the time of filing for securing and alignment reference device to a support platform.

In other embodiments, the reference device support platform is removably attached to the rifle using mechanical mechanisms and various attachment systems such as a picatinny or weaver rail system that allows the reference device support platform to be removably attached to a rifle such that the reference device support platform first surface plane is perpendicular to a centerline of the rifle's receiver extending down from the top of the rifle receiver to the bottom of the rifle receiver and parallel to the rifle's action and the bore's longitudinal centerline.

Figure 16A:
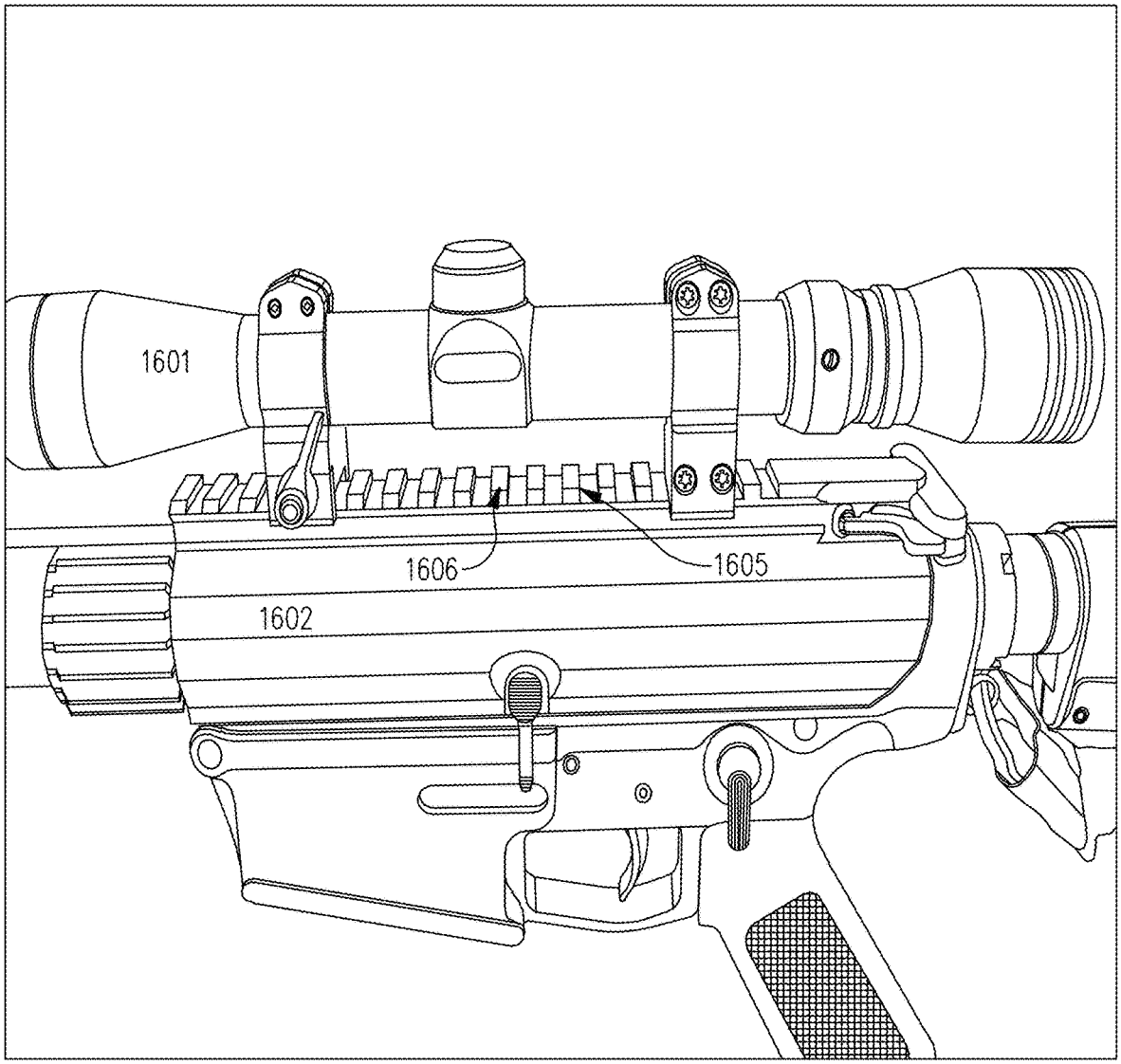
FIG. 16A shows a rifle and scope system using a rail system, such as a weaver or picatinny rail system, to attach the scope to the rifle.

FIG. 16A shows a rifle and scope system using a rail system, such as a weaver or picatinny rail system, to attach the scope to the rifle. As seen in FIG. 16A, scope 1601 is mounted to rifle 1602 via rail system 1605 and attachment points 1606.

Figure 16B:
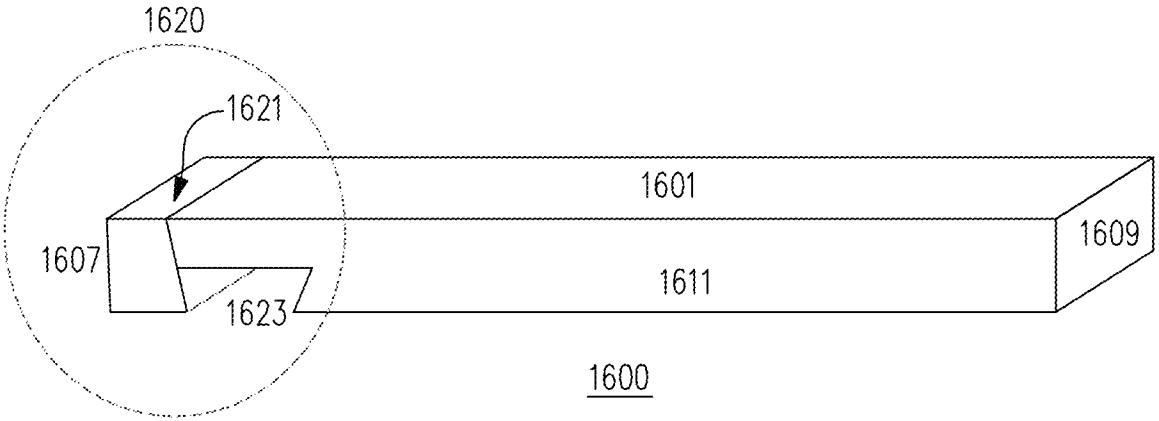
FIG. 16B shows a line drawing of a perspective view of a reference device support platform that can be used with a rifle where scope system is attached using a rail system, such as a weaver or picatinny rail system, in accordance with one embodiment.

FIG. 16B shows a line drawing of a perspective view of a reference device support platform that can be used with a rifle such as rifle 1602 of FIG. 16A, where scope system is attached using a rail system, such as a weaver or picatinny rail system, in accordance with one embodiment.

Figure 16C:
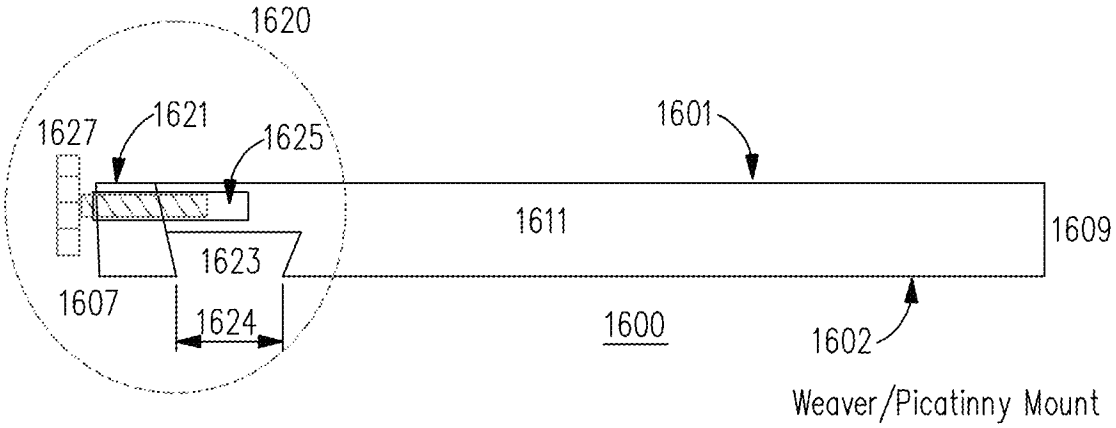
FIG. 16C shows a line drawing of a side view of a reference device support platform that can be used with a rifle where scope system is attached using a rail system, such as a weaver or picatinny rail system, in accordance with one embodiment.

FIG. 16C shows a line drawing of one embodiment of reference device support platform 1600 of FIG. 16B, as viewed from reference device support platform first side 1611.

As seen in FIGS. 16B and 16C, reference device support platform 1600 includes a reference device support platform first or upper surface 1601 and a reference device support platform second or lower surface 1602 opposite reference device support platform first or upper surface 1601.

As also seen in FIGS. 16B and 16C, reference device support platform 1600 includes reference device support platform first or attachment end 1607 and reference device support platform second or support end 1609 opposite reference device support platform first end 1607.

As also seen in FIGS. 16B and 16C, the particular embodiment of reference device support platform 1600 of 16B and 16C includes rail system attachment portion 1620 including movable portion 1621 and attachment notch 1623 at reference device support platform first end 1607. As seen in FIG. 16C, rail system attachment portion 1620 includes threaded hole 1625 into which threaded knurled knob 1627 can be screwed in or out to decrease or increase the length 1624 of attachment notch 1623. Attachment mechanisms such as rail system attachment portion 1620 are well known in the art. Therefore, a more detailed discussion of rail system attachment portion 1620 is omitted here to avoid detracting from the invention.

Referring to FIGS. 16A, 16B, and 16C, when attachment portion 1620 of reference device support platform 1600 is attached to any of the mounting positions 1606 of rail system 1605 reference device support platform first surface 1601 of reference device support platform 1600 is parallel to horizontal bore centerline 223, and scope horizontal stadia line 203, and perpendicular to vertical bore centerline 221, and scope vertical stadia line 201.

Figure 16D:
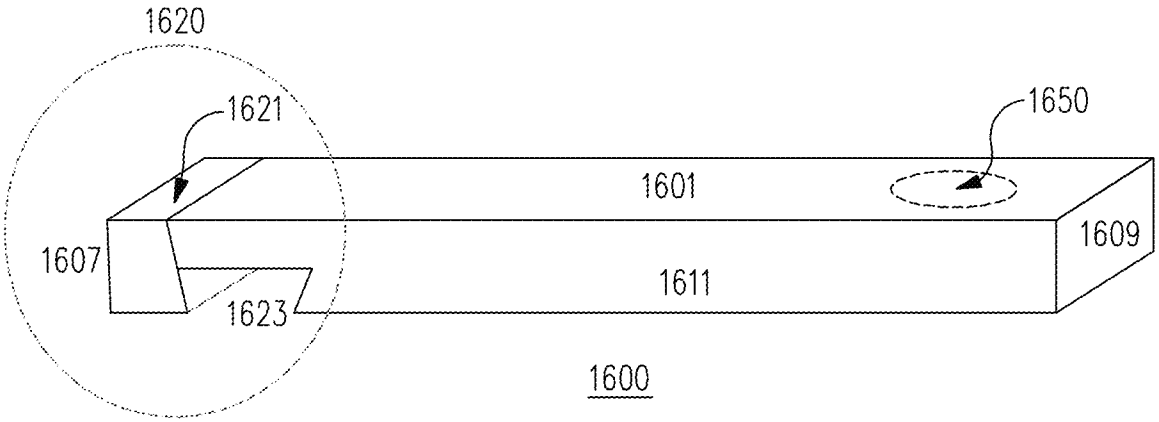
FIG. 16D shows a line drawing of a perspective view of a reference device support platform that can be used with a rifle where scope system is attached using a rail system, such as a weaver or picatinny rail system, and includes a reference device mounting hole in accordance with one embodiment.
Figure 16E:
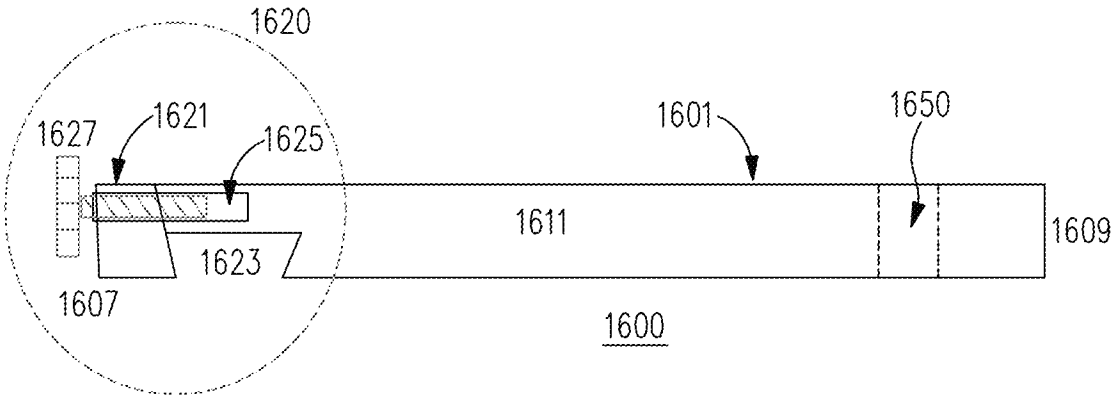
FIG. 16E shows a line drawing of a side view of a reference device support platform that can be used with a rifle where scope system is attached using a rail system, such as a weaver or picatinny rail system, and includes a reference device mounting hole in accordance with one embodiment.

FIGS. 16D and 16E are line drawings the reference device support platform 1600 of FIGS. 16B and 16C that also include mounting hole 1650.

Figure 16F:
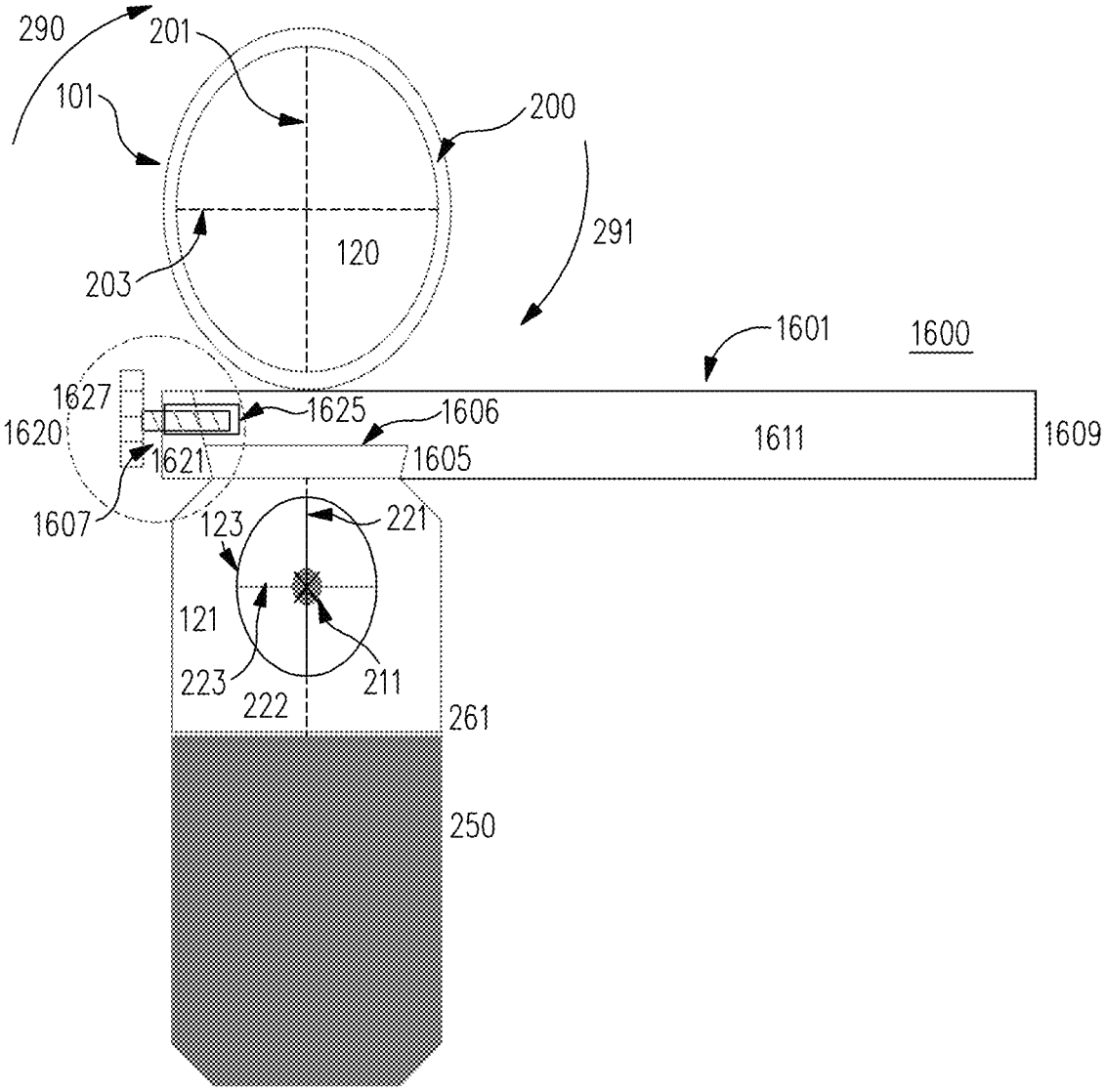
FIG. 16F shows a reference device support platform attached to a rifle where scope system is attached using a rail system, such as a weaver or picatinny rail system, in accordance with one embodiment.

Referring to FIGS. 2, 16A, 16B, 16C, 16D, 16E, and 16F together, FIG. 16F shows reference device support platform 1600 of FIGS. 16B and 16C, attached to a rifle using rail mounting position 1606 of rail mounting system 1605 and rail system attachment portion 1620 including threaded hole 1625 into which threaded knurled knob 1627. As seen in FIG. 16F, when reference device support platform 1600 is so attached, reference device support platform first surface 1601 is parallel to the rifle bore horizontal axis 223 and perpendicular to the rifle bore vertical axis 221.

In one embodiment, a reference device support platform is attached to a rifle where the bolt rails and bolt rail top surfaces of the rifle lie in a plane parallel to the rifle bore horizontal axis and perpendicular to the rifle bore vertical axis that includes a right-angle attachment portion that is perpendicular to a reference device support platform portion In this embodiment, the right-angle attachment portion is inserted in the rifle action with the bolt removed such that in-receiver right-angle attachment portion rests on the top surface of the bolt rails. Then the reference device support platform portion is perpendicular to the longitudinal axis of the right-angle attachment portion and is oriented such that a reference device support platform portion first surface is parallel to the horizontal bore centerline of the rifle, and scope horizontal stadia line, and perpendicular to the vertical bore centerline, and scope vertical stadia line. This, in turn, provides the desired orientation of the reference device support platform discussed in detail above.

Figure 17A:
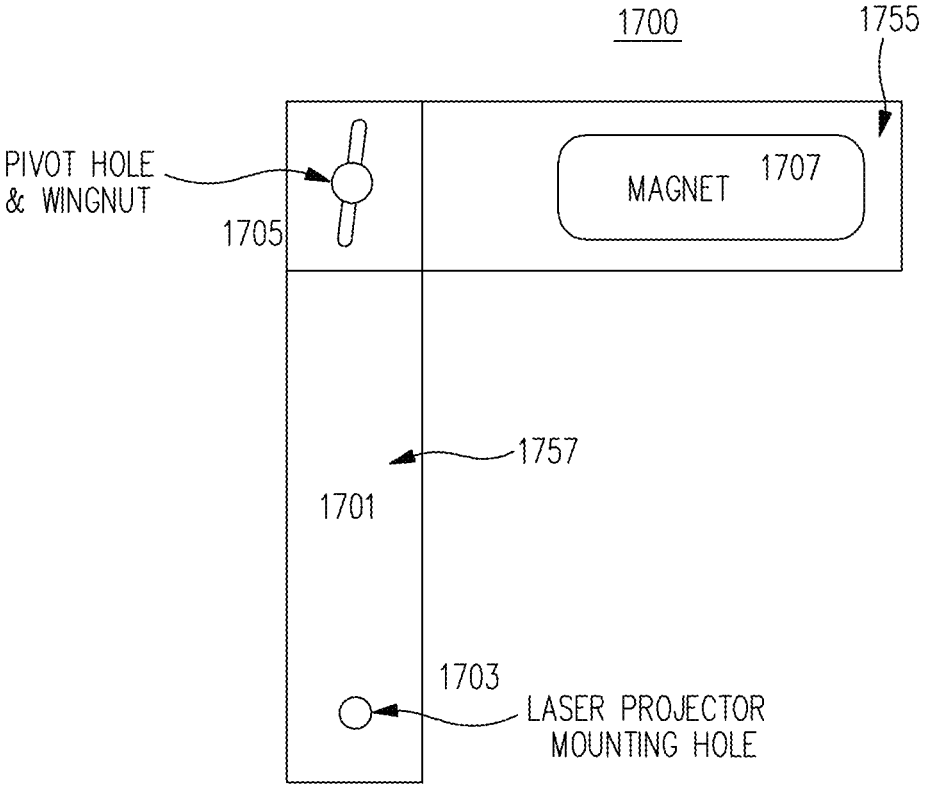
FIG. 17A is a line drawing of a reference device support platform system for use with a rifle where the bolt rails and bolt rail top surfaces of the rifle lie in a plane parallel to the rifle bore horizontal axis and perpendicular to the rifle bore vertical axis in accordance with one embodiment.

FIG. 17A is a line drawing of a reference device support platform system 1700 for use with a rifle where the bolt rails and bolt rail top surfaces of the rifle lie in a plane parallel to the rifle bore horizontal axis and perpendicular to the rifle bore vertical axis in accordance with one embodiment.

Figure 17B:
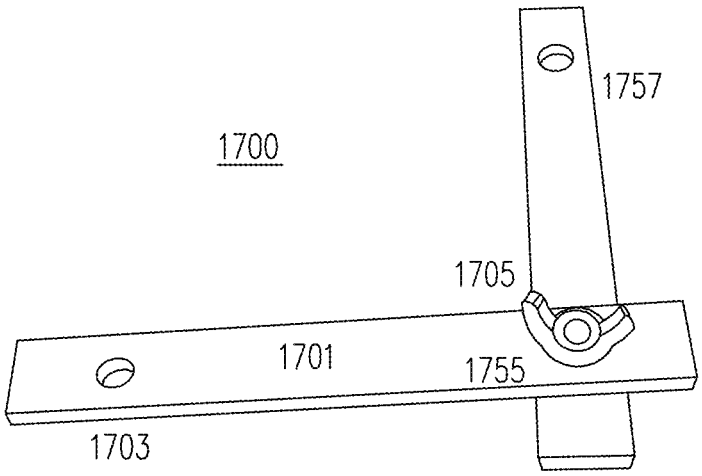
FIG. 17B is a photograph of a reference device support platform system for use with a rifle where the bolt rails and bolt rail top surfaces of the rifle lie in a plane parallel to the rifle bore horizontal axis and perpendicular to the rifle bore vertical axis in accordance with one embodiment.

FIG. 17B is a photograph of a reference device support platform system 1700 for use with a rifle where the bolt rails and bolt rail top surfaces of the rifle lie in a plane parallel to the rifle bore horizontal axis and perpendicular to the rifle bore vertical axis in accordance with one embodiment.

Figure 17C:
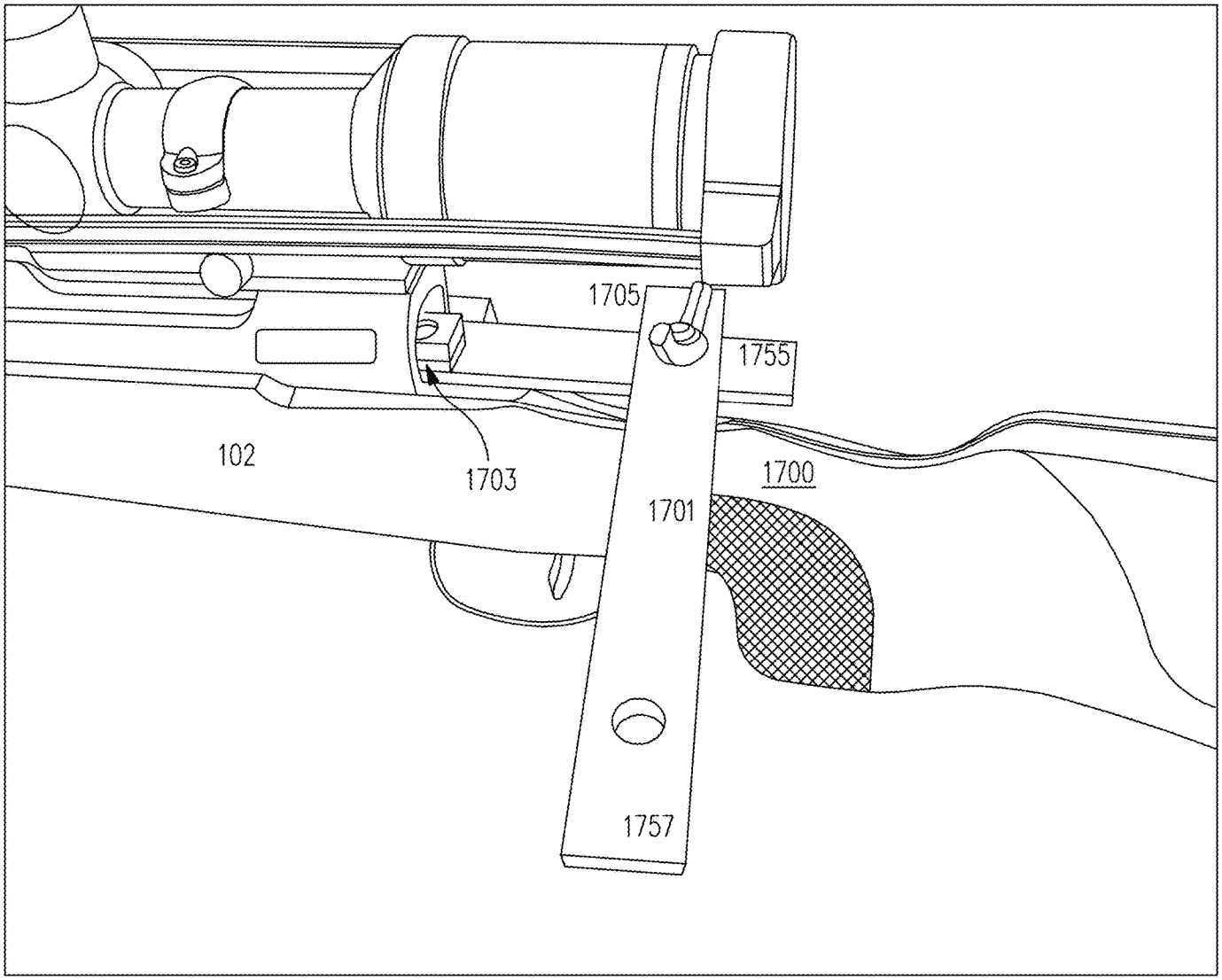
FIG. 17C is a photograph of the reference device support platform system of FIG. 17A attached to s rifle and scope system where the bolt rails and bolt rail top surfaces of the rifle lie in a plane parallel to the rifle bore horizontal axis and perpendicular to the rifle bore vertical axis.

FIG. 17C is a photograph of the reference device support platform system 1700 of FIG. 17A attached to s rifle and scope system where the bolt rails and bolt rail top surfaces of the rifle lie in a plane parallel to the rifle bore horizontal axis and perpendicular to the rifle bore vertical axis.

Referring to FIGS. 17A, 17B, and 17C, reference device support platform system 1700 includes right-angle attachment portion 1755 and reference device support platform portion 1757. As seen in FIGS. 17A, 17B, and 17C, in one embodiment, right-angle attachment portion 1755 and reference device support platform portion 1757 are connected using a pivot hole (not shown) and a wingnut, or other connecting mechanism 1705.

As seen in FIGS. 17A, 17B, and 17C reference device support platform system 1700 is attached to rifle 102 by inserting right-angle attachment portion 1755 in the rifle action 1703 with the bolt removed such that right-angle attachment portion 1755 rests on the top surface of the bolt rails (such as shown and discussed in FIG. 15A). As also seen in FIG. 17A, in one embodiment, right-angle attachment portion 1755 includes magnet portion 1707. As seen in FIGS. 17B and 17C, When right-angle attachment portion 1755 is so placed, the reference device support platform portion 1757 is perpendicular to the longitudinal axis of the right-angle attachment portion 1755 and is oriented such that a reference device support platform portion first surface 1701 is parallel to the horizontal bore centerline of the rifle, and scope horizontal stadia line, and perpendicular to the vertical bore centerline, and scope vertical stadia line. This, in turn, provides the desired orientation of the reference device support platform.

As seen in FIGs. FIGS. 17A, 17B, and 17C, in one embodiment, reference device support platform portion 1757 includes reference device mounting hole 1703 for attaching an alignment reference device as discussed above. As also discussed in more detail above, in one embodiment, once the reference device support platform system 1700 is removably attached to the rifle 102 such that the reference device support platform portion first surface 1701 is parallel to the rifle's horizontal bore center line and perpendicular to the rifle's vertical bore center line, and an alignment reference device is obtained, the alignment reference device is removably attached to the reference device support platform portion 1757 such that the alignment reference device bottom surface is supported by the reference device support platform portion first surface 1701 and the alignment reference device bottom surface plane is parallel to reference device support platform reference device support platform portion first surface 1701.

When an alignment reference device is so placed, a horizontal axis of the alignment reference device will be parallel to the reference device support platform portion first surface 1701. As a result, the horizontal axis of the alignment reference device will also be parallel to the rifle's horizontal bore center line and perpendicular to rifle's vertical bore center line. Likewise, when the alignment reference device is so placed, a vertical axis of the alignment reference device will be perpendicular to the reference device support platform portion first surface 1701. As a result, the vertical axis of the alignment reference device will also be perpendicular to the rifle's horizontal bore center line and parallel to rifle's vertical bore center line.

In some embodiments, a reference device support platform is provided that is removably attached to a rifle such that a reference device support platform first surface is perpendicular to the rifle's action, and therefore the rifle's horizontal bore center line, and parallel to rifle's receiver centerline and therefore the rifle's vertical bore center line. In one embodiment, once the reference device support platform is removably attached to the rifle such that a reference device support platform first surface is perpendicular rifle's horizontal bore center line and parallel to rifle's vertical bore center line, an alignment reference device, such as a laser leveling device, can be placed on the reference device support platform first surface and thereby be supported by the reference device support platform.

When the alignment reference device is so placed, a horizontal axis of the alignment reference device will automatically be perpendicular to the rifle's horizontal bore center line and parallel to rifle's vertical bore center line. Likewise, when the alignment reference device is so placed, a vertical axis of the alignment reference device will be parallel to the rifle's horizontal bore center line and perpendicular to rifle's vertical bore center line. Consequently, when the alignment reference device generates vertical and/or horizontal reference lines, such as laser leveling lines, a generated vertical reference line will be parallel to the rifle's horizontal bore center line and a generated horizontal reference line will be to parallel the rifle's vertical bore center line.

Figure 18A:
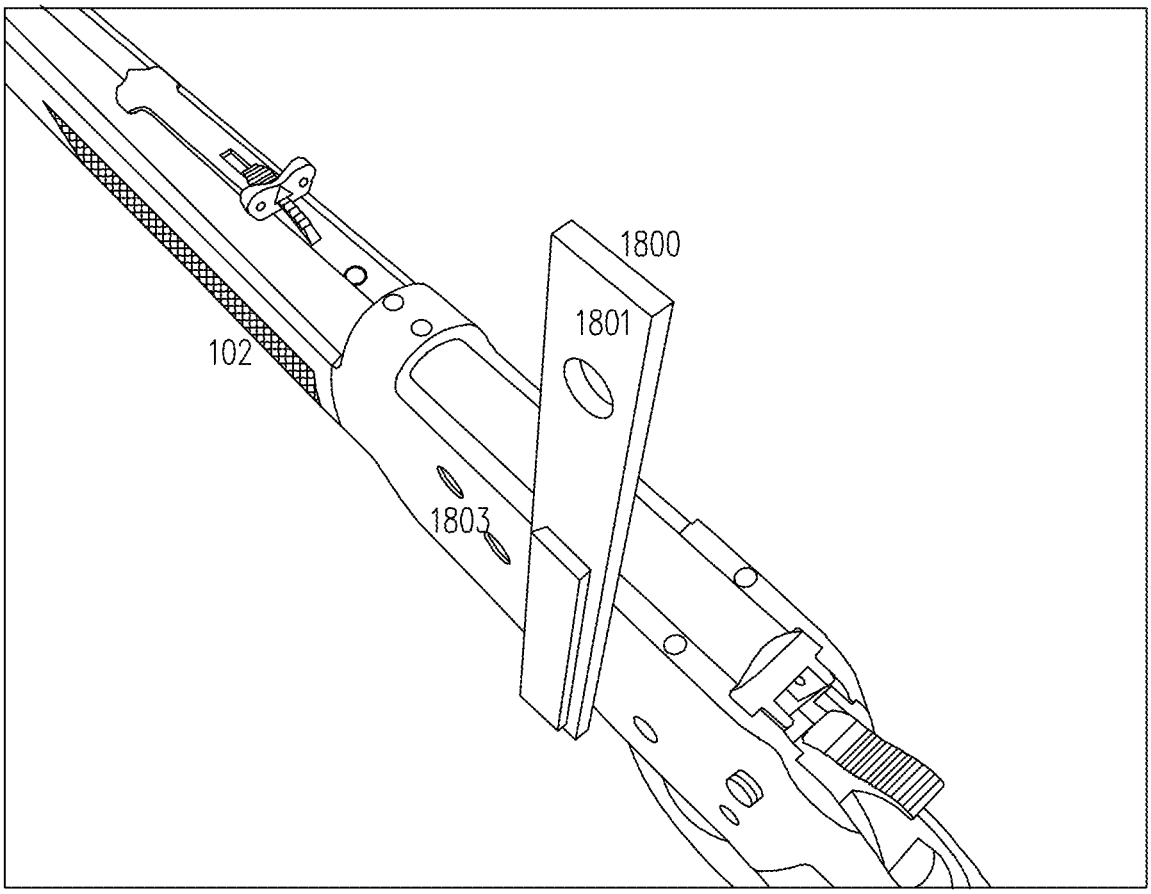
FIG. 18A shows a reference device support platform attached to a rifle where the reference device support platform is attached to a vertical surface of the rifle such that a reference device support platform first surface is perpendicular to the rifle's action, and therefore the rifle's horizontal bore center line, and parallel to rifle's receiver centerline and therefore the rifle's vertical bore center line.

FIG. 18A shows a reference device support platform 1800 attached to a rifle 102 where the reference device support platform 1800 is attached to the vertical side surface 1803 of the rifle receiver such that a reference device support platform first surface 1801 is perpendicular to the rifle's action, and therefore the rifle's horizontal bore center line, and parallel to rifle's receiver centerline and therefore the rifle's vertical bore center line.

Figure 18B:
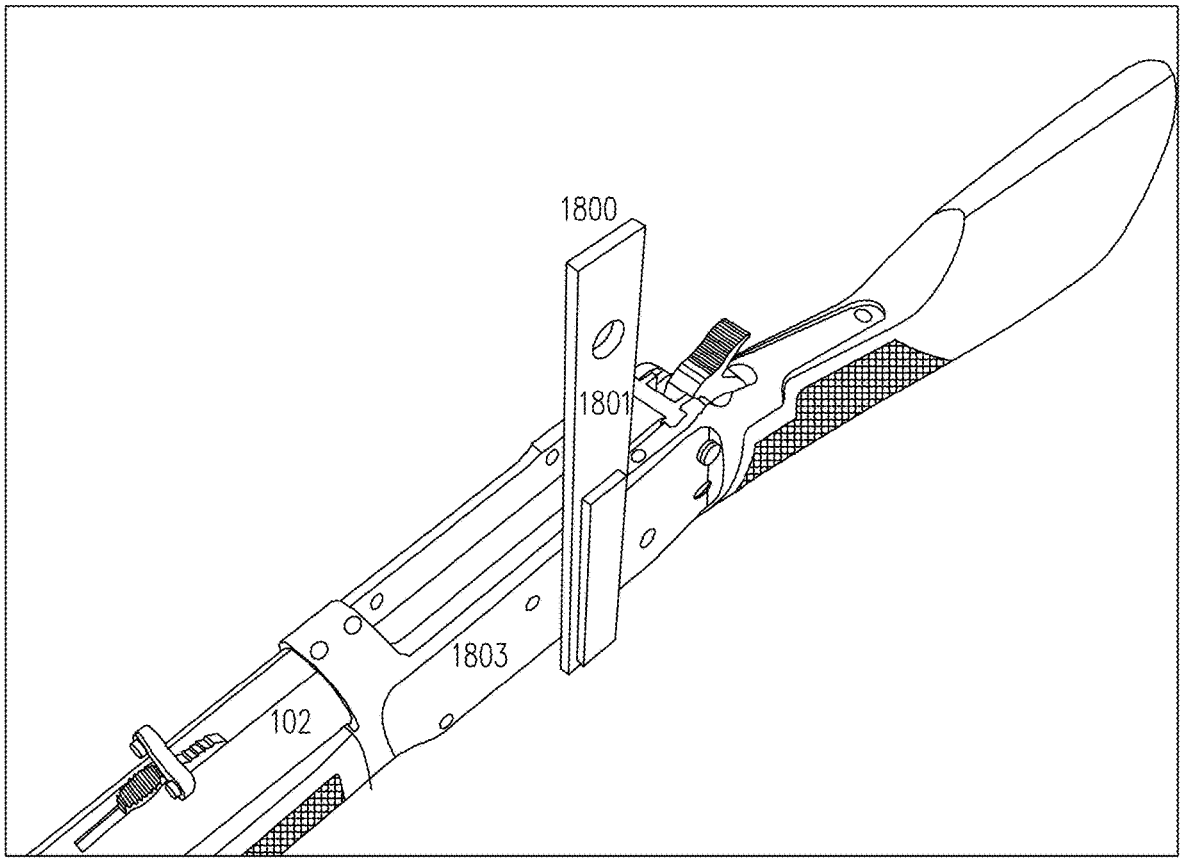
FIG. 18B shows a reference device support platform attached to a rifle where the reference device support platform is attached to a vertical surface of the rifle such that a reference device support platform first surface is perpendicular to the rifle's action, and therefore the rifle's horizontal bore center line, and parallel to rifle's receiver centerline and therefore the rifle's vertical bore center line.

FIG. 18B shows another view of the reference device support platform 1800 of FIG. 18A attached to a rifle 102 where the reference device support platform 1800 is attached to the vertical side surface 1803 of the rifle receiver such that a reference device support platform first surface 1801 is perpendicular to the rifle's action, and therefore the rifle's horizontal bore center line, and parallel to rifle's receiver centerline and therefore the rifle's vertical bore center line.

In one embodiment, once the reference device support platform is removably attached to the rifle as shown in FIGS. 18A and 18B, such that a reference device support platform first surface 1801 is perpendicular rifle's horizontal bore center line and parallel to rifle's vertical bore center line, an alignment reference device, such as a laser leveling device, can be placed on the reference device support platform first surface and thereby be supported by the reference device support platform.

When the alignment reference device is so placed, a horizontal axis of the alignment reference device will automatically be perpendicular to the rifle's horizontal bore center line and parallel to rifle's vertical bore center line. Likewise, when the alignment reference device is so placed, a vertical axis of the alignment reference device will be parallel to the rifle's horizontal bore center line and perpendicular to rifle's vertical bore center line. Consequently, when the alignment reference device generates vertical and/or horizontal reference lines, such as laser leveling lines, a generated vertical reference line will be parallel to the rifle's horizontal bore center line and a generated horizontal reference line will be to parallel the rifle's vertical bore center line.

Consequently, using the disclosed embodiments, known "good" or true vertical and/or horizontal reference lines, such as laser leveling lines, i.e., vertical reference lines known to be parallel to the rifle's horizontal bore center line and horizontal reference lines known to be parallel to the rifle's vertical bore center line, are provided. The scope's vertical stadia line and/or horizontal stadia line, can then be adjusted to line up with these known good vertical and/or horizontal reference lines, respectively. Then once lined up, the scope rings, or other attachment mechanism, can be tightened or adjusted to secure the scope in place in a now known leveled position.

The present invention has been described in particular detail with respect to specific possible embodiments. Those of skill in the art will appreciate that the invention may be practiced in other embodiments. For example, the nomenclature used for components, capitalization of component designations and terms, the attributes, or structural aspect is not significant, mandatory, or limiting, and the mechanisms that implement the invention or its features can have various different names, formats, or protocols. Also, particular divisions of functionality between the various components described herein are merely exemplary, and not mandatory or significant. Consequently, functions performed by a single component may, in other embodiments, be performed by multiple components, and functions performed by multiple components may, in other embodiments, be performed by a single component.

In addition, the operations and structures shown in the figures, or as discussed herein, are identified using a particular nomenclature for ease of description and understanding, but other nomenclature is often used in the art to identify equivalent operations.

Therefore, numerous variations, whether explicitly provided for by the specification or implied by the specification or not, may be implemented by one of skill in the art in view of this disclosure.

What is claimed is:

1. A reference device support platform system for firearm scope leveling comprising:

a firearm, the firearm including a firearm barrel, the firearm barrel having a firearm barrel bore, the firearm barrel bore having longitudinal bore centerline extending down a centerline of the firearm barrel bore from a receiver end of the firearm barrel to a muzzle end of the firearm barrel, the firearm barrel bore having a vertical bore centerline perpendicular to the longitudinal bore centerline, the firearm barrel bore having a horizontal bore centerline perpendicular to both the longitudinal bore centerline and the vertical bore centerline;

a firearm scope attached to the firearm, the firearm scope having at least one reticle stadia line, the at least one reticle stadia line being at least one of a vertical reticle stadia line or a horizontal reticle stadia line;

a reference device support platform, the reference device support platform including a reference device support platform first surface; the reference device support platform including a reference device support platform second surface, the reference device support platform second surface being opposite the reference device support platform first surface; the reference device support platform including a reference device support platform first side surface; the reference device support platform including a reference device support platform second side surface, the reference device support platform second side surface being opposite the reference device support platform first side surface and separated from the reference device support platform first side surface by a reference device support platform width dimension; the reference device support platform including a reference device support platform first end surface; the reference device support platform including a reference device support platform second end surface the reference device support platform second end surface being separated from the reference device support platform first end surface by reference device support platform length dimension wherein the reference device support platform is removably attached to the firearm such that a reference device support platform first surface plane in which the reference device support platform first surface lies is parallel to the longitudinal bore centerline and perpendicular to vertical bore centerline; and an alignment reference device, the alignment reference device including an alignment reference device vertical axis, the alignment reference device including an alignment reference device horizontal axis, the alignment reference device including an alignment reference device bottom surface, the alignment device bottom surface lying in an alignment reference device bottom surface plane, the alignment reference device bottom surface plane being parallel to the alignment reference device horizontal axis and perpendicular to the alignment reference device vertical axis, the alignment reference device generating one or more of a horizontal reference line or a vertical reference line, the alignment reference device being removably attached to the reference device support platform such that the alignment reference device bottom surface rests on a portion of the reference device platform first surface and the reference device bottom surface plane is parallel to the reference device platform first surface plane so that the alignment reference device horizontal axis is parallel to the horizontal bore centerline and perpendicular to the vertical bore centerline and the longitudinal bore centerline and the alignment reference device vertical axis is parallel to the vertical bore centerline and perpendicular to the horizontal bore centerline and the longitudinal bore centerline, wherein the alignment reference device is a laser-based alignment reference device generating a horizontal reference line that is parallel to the alignment reference device horizontal axis and therefore parallel to horizontal bore centerline and perpendicular to the vertical bore centerline.

2. A reference device support platform system for firearm scope leveling comprising:

a firearm, the firearm including a firearm barrel, the firearm barrel having a firearm barrel bore, the firearm barrel bore having longitudinal bore centerline extending down a centerline of the firearm barrel bore from a receiver end of the firearm barrel to a muzzle end of the firearm barrel, the firearm barrel bore having a vertical bore centerline perpendicular to the longitudinal bore centerline, the firearm barrel bore having a horizontal bore centerline perpendicular to both the longitudinal bore centerline and the vertical bore centerline;

a firearm scope attached to the firearm, the firearm scope having at least one reticle stadia line, the at least one reticle stadia line being at least one of a vertical reticle stadia line or a horizontal reticle stadia line;

a reference device support platform, the reference device support platform including a reference device support platform first surface; the reference device support platform including a reference device support platform second surface, the reference device support platform second surface being opposite the reference device support platform first surface; the reference device support platform including a reference device support platform first side surface; the reference device support platform including a reference device support platform second side surface, the reference device support platform second side surface being opposite the reference device support platform first side surface and separated from the reference device support platform first side surface by a reference device support platform width dimension; the reference device support platform including a reference device support platform first end surface; the reference device support platform including a reference device support platform second end surface the reference device support platform second end surface being separated from the reference device support platform first end surface by reference device support platform length dimension wherein the reference device support platform is removably attached to the firearm such that a reference device support platform first surface plane in which the reference device support platform first surface lies is parallel to the longitudinal bore centerline and perpendicular to vertical bore centerline; and an alignment reference device, the alignment reference device including an alignment reference device vertical axis, the alignment reference device including an alignment reference device horizontal axis, the alignment reference device including an alignment reference device bottom surface, the alignment device bottom surface lying in an alignment reference device bottom surface plane, the alignment reference device bottom surface plane being parallel to the alignment reference device horizontal axis and perpendicular to the alignment reference device vertical axis, the alignment reference device generating one or more of a horizontal reference line or a vertical reference line, the alignment reference device being removably attached to the reference device support platform such that the alignment reference device bottom surface rests on a portion of the reference device platform first surface and the reference device bottom surface plane is parallel to the reference device platform first surface plane so that the alignment reference device horizontal axis is parallel to the horizontal bore centerline and perpendicular to the vertical bore centerline and the longitudinal bore centerline and the alignment reference device vertical axis is parallel to the vertical bore centerline and perpendicular to the horizontal bore centerline and the longitudinal bore centerline, wherein the alignment reference device is a laser-based alignment reference device generating a vertical reference line that is parallel to the alignment reference device vertical axis and therefore parallel to vertical bore centerline and perpendicular to the horizontal bore centerline.

3. A method for firearm scope leveling comprising:

providing a firearm, the firearm including a firearm barrel, the firearm barrel having a firearm barrel bore, the firearm barrel bore having longitudinal bore centerline extending down a centerline of the firearm barrel bore from a receiver end of the firearm barrel to a muzzle end of the firearm barrel, the firearm barrel bore having a vertical bore centerline perpendicular to the longitudinal bore centerline, the firearm barrel bore having a horizontal bore centerline perpendicular to both the longitudinal bore centerline and the vertical bore centerline;

attaching a firearm scope to the firearm, the firearm scope having at least one reticle stadia line, the at least one reticle stadia line being at least one of a vertical reticle stadia line or a horizontal reticle stadia line;

providing a reference device support platform, the reference device support platform including a reference device support platform first surface; the reference device support platform including a reference device support platform second surface, the reference device support platform second surface being opposite the reference device support platform first surface; the reference device support platform including a reference device support platform first side surface; the reference device support platform including a reference device support platform second side surface, the reference device support platform second side surface being opposite the reference device support platform first side surface and separated from the reference device support platform first side surface by a reference device support platform width dimension; the reference device support platform including a reference device support platform first end surface; the reference device support platform including a reference device support platform second end surface, the reference device support platform first end surface being separated from the reference device support platform first end surface by reference device support platform length dimension;

removably attaching the reference device support platform to the firearm such that a reference device support platform first surface plane in which the reference device support platform first surface lies is parallel to the longitudinal bore centerline and perpendicular to vertical bore centerline;

removably attaching an alignment reference device to the reference device support platform, the alignment reference device including an alignment reference device vertical axis, the alignment reference device including an alignment reference device horizontal axis, the alignment reference device including an alignment reference device bottom surface, the alignment device bottom surface lying in an alignment reference device bottom surface plane, the alignment reference device bottom surface plane being parallel to the alignment reference device horizontal axis and perpendicular to the alignment reference device vertical axis, the alignment reference device generating one or more of a horizontal reference line or a vertical reference line, the alignment reference device being removably attached to the reference device support platform such that the alignment reference device bottom surface rests on a portion of the reference device platform first surface and the reference device bottom surface plane is parallel to the reference device platform first surface plane so that the alignment reference device horizontal axis is parallel to the horizontal bore centerline and perpendicular to the vertical bore centerline and the longitudinal bore centerline and the alignment reference device vertical axis is parallel to the vertical bore centerline and perpendicular to the horizontal bore centerline and the longitudinal bore centerline;

activating the alignment reference device so that the alignment reference device generates one or more of a known good horizontal reference line parallel to the alignment reference device horizontal axis or a known good vertical reference line alignment reference device vertical axis, the alignment reference device being removably attached to the reference device support platform such that the alignment reference device bottom surface rests on a portion of the reference device platform first surface and the reference device bottom surface plane is parallel to the reference device platform first surface plane so that the alignment reference device horizontal axis is parallel to the horizontal bore centerline and perpendicular to the vertical bore centerline and the longitudinal bore centerline and the alignment reference device vertical axis is parallel to the vertical bore centerline and perpendicular to the horizontal bore centerline and the longitudinal bore centerline;

adjusting a longitudinal axis of the firearm scope in a clockwise or counterclockwise direction such that at least one reticle stadia line of the firearm scope reticle lines up with at least one of the horizontal reference line or vertical reference line generated by the alignment reference device; and securing the firearm scope in a position where the at least one reticle stadia line of the firearm scope reticle lines up with at least one of the horizontal reference line or vertical reference line generated by the alignment reference device.

4. The method of claim 3 wherein at least part of the reference device support platform is magnetic and the reference device support platform is removably attached to the firearm, at least in part, by magnetic forces between the reference device support platform and at least one metallic portion of the firearm.

5. The method of claim 3 wherein at least part of the reference device support platform is magnetic and the reference device support platform is removably attached to the firearm, at least in part, by magnetic forces between the reference device support platform and a firearm scope mounting mechanism that includes a scope mounting mechanism flat surface that lies in a scope mounting mechanism flat surface plane that is parallel to the reference device support platform first surface plane.

6. The method of claim 3, wherein the firearm includes a firearm receiver, the firearm receiver having parallel firearm receiver top surfaces lying in a firearm receiver top surfaces plane that is parallel to the horizontal bore centerline and perpendicular to the vertical bore centerline;

further wherein the reference device support platform second surface rests on the firearm receiver top surfaces such that the reference device support platform first surface plane is parallel to the firearm receiver top surfaces plane and the horizontal bore centerline and perpendicular to the vertical bore centerline.

7. The method of claim 6, wherein the firearm receiver top surfaces are metallic and at least part of the reference device support platform second surface is magnetic;

further wherein the reference device support platform is removably attached to the firearm, at least in part, by magnetic forces between the reference device support platform second surface and the metallic firearm receiver top surfaces.

8. The method of claim 3 wherein the firearm includes a firearm receiver, the firearm receiver having parallel firearm receiver top surfaces lying in a firearm receiver top surfaces plane that is parallel to the horizontal bore centerline and perpendicular to the vertical bore centerline;

further wherein, the reference device support platform includes an in-receiver attachment portion formed at the reference device support platform first end, the in-receiver attachment portion being positioned in the firearm receiver when the reference device support platform second surface rests on the firearm receiver top surfaces such that the reference device support platform first surface plane is parallel to the firearm receiver top surfaces plane and the horizontal bore centerline and perpendicular to the vertical bore centerline.

9. The method of claim 3 wherein the firearm scope is attached to the firearm via a rail mounting system and the reference device support platform includes a rail system attachment portion formed at the reference device support platform first end;

further wherein at least part of the reference device support platform is removably attached to the firearm using a rail mounting system such that the reference device support platform first surface plane is parallel to the horizontal bore centerline and perpendicular to the vertical bore centerline.

10. The method of claim 9, wherein the rail mounting system is a weaver rail system or a picatinny rail system.

* * * * *